US011986099B2

(12) United States Patent
Garcia

(10) Patent No.: US 11,986,099 B2
(45) Date of Patent: May 21, 2024

(54) PORTABLE FOLDING CHAIR

(71) Applicant: Reflex Outdoor Supply and Equipment LLC, Port St. Lucie, FL (US)

(72) Inventor: Christian Joel Garcia, Port St. Lucie, FL (US)

( * ) Notice: Subject to any disclaimer, the term of this patent is extended or adjusted under 35 U.S.C. 154(b) by 0 days.

(21) Appl. No.: 17/830,944

(22) Filed: Jun. 2, 2022

(65) Prior Publication Data

US 2022/0386779 A1 Dec. 8, 2022

Related U.S. Application Data

(60) Provisional application No. 63/195,802, filed on Jun. 2, 2021.

(51) Int. Cl.

| | |
|---|---|
| ***A47C 4/28*** | (2006.01) |
| ***A47C 3/18*** | (2006.01) |
| ***A47C 4/30*** | (2006.01) |
| ***A47C 4/34*** | (2006.01) |
| ***A47C 7/54*** | (2006.01) |

(52) U.S. Cl.

CPC ..... *A47C 4/286* (2013.01); *A47C 3/18* (2013.01); *A47C 4/28* (2013.01); *A47C 4/30* (2013.01); *A47C 4/34* (2013.01); *A47C 7/54* (2013.01)

(58) Field of Classification Search

CPC .. A47C 4/286; A47C 3/18; A47C 4/28; A47C 4/30; A47C 4/34; A47C 1/025; A47C 4/52; A47C 7/54

USPC ..... 297/16.2, 46, 51

See application file for complete search history.

(56) References Cited

U.S. PATENT DOCUMENTS

| | | | | |
|---|---|---|---|---|
| 4,317,552 | A * | 3/1982 | Weidler | F16M 13/00 248/168 |
| 4,597,119 | A * | 7/1986 | Padgett | A47C 1/14 5/656 |
| 10,010,179 | B1 | 7/2018 | Stump et al. | |
| 10,194,751 | B1 * | 2/2019 | Frankel | A47C 9/105 |
| D933,985 | S * | 10/2021 | Stump | D6/368 |
| 11,234,523 | B2 * | 2/2022 | Sun | A47C 4/22 |
| 11,344,125 | B1 * | 5/2022 | Sun | A47C 4/028 |

(Continued)

FOREIGN PATENT DOCUMENTS

WO WO-2010081089 A1 * 7/2010 ..... A47C 4/286

OTHER PUBLICATIONS

International Search Report issued in related PCT application No. PCT/US2022/031995 dated Oct. 28, 2022; 6 pages.

(Continued)

*Primary Examiner* — Robert Canfield
(74) *Attorney, Agent, or Firm* — Sam Pierce

(57) ABSTRACT

The present invention is directed to a portable folding chair including a central assembly having an upper portion and a lower portion. The lower portion may be connectable to the upper portion so that the upper portion may swivel with respect to the lower portion. The portable folding chair may include leg members attached to the lower portion of the central assembly. Each of the leg members may be moveable between a folded position and a deployed position. The portable folding chair may further include seat members that may be attached to the upper portion of the central assembly. Each of the seat members may be moveable between a folded position and a deployed position.

24 Claims, 54 Drawing Sheets

(56) References Cited

U.S. PATENT DOCUMENTS

| | | | | |
|---|---|---|---|---|
| 11,786,041 | B1 * | 10/2023 | Chen | A47C 9/105 297/16.1 |
| 11,832,732 | B2 * | 12/2023 | Zhu | A47C 4/286 |
| 11,844,439 | B1 * | 12/2023 | Wang | A47C 3/40 |
| 2009/0174233 | A1 * | 7/2009 | Hoffman | A47C 4/286 297/16.2 |
| 2010/0314926 | A1 * | 12/2010 | Chesness | A47C 9/105 297/258.1 |
| 2011/0156449 | A1 * | 6/2011 | Obolewicz | A47C 4/286 297/16.2 |
| 2011/0254325 | A1 * | 10/2011 | Obolewicz | A47C 4/286 297/16.2 |
| 2012/0274107 | A1 | 11/2012 | Chesness | |
| 2013/0049410 | A1 * | 2/2013 | Stafford | A47C 7/624 297/16.1 |
| 2014/0306493 | A1 * | 10/2014 | Obolewicz | A47C 4/42 297/16.2 |
| 2015/0189994 | A1 * | 7/2015 | Lee | A47C 4/30 297/16.1 |
| 2017/0181548 | A1 * | 6/2017 | Yoo | A47C 4/30 |
| 2022/0039556 | A1 * | 2/2022 | Fulbright | A47C 4/286 |
| 2022/0265048 | A1 * | 8/2022 | Frankel | A47C 4/286 |
| 2023/0000238 | A1 * | 1/2023 | Sun | A63G 9/12 |
| 2023/0172400 | A1 * | 6/2023 | van Dongen | A61G 5/1072 4/611 |
| 2023/0200539 | A1 * | 6/2023 | Chen | A47C 4/286 297/47 |

OTHER PUBLICATIONS

Written Opinion issued in related PCT application No. PCT/US2022/031995 dated Oct. 28, 2022; 10 pages.

* cited by examiner

PORTABLE FOLDING CHAIR

RELATED APPLICATIONS

This application claims priority to U.S. Provisional Application Ser. No. 63/195,802 filed Jun. 2, 2021 titled "PORTABLE COMPACT FOLDING SWIVEL CHAIR," the contents of which is incorporated herein by reference in its entirety except to the extent that the disclosure therein conflicts with the disclosure herein.

FIELD OF THE INVENTION

The present invention relates to folding chairs and, more specifically, to folding chairs that can be easily folded and transported by a user, and associated methods.

BACKGROUND OF THE INVENTION

In order to unfold or deploy a folding chair, one typically pushes the backrest portion of the chair in an opposite direction from the seat portion. One or more linkage members (also known as links or link members in the art), are pivotably connected to the various structural members of the chair. These linkage members, in thru, cause the entire chair to fully open with continued force applied thereto by the user so that the user can comfortably and stably sit down in the chair once the chair is placed on a relatively flat surface. The various structural members include the backrest members, seat members, armrest members, and leg members. Sometimes such chairs have a locking mechanism that allows for the structure to lock in both folded and deployed states similar to that of an umbrella that locks in both folded and deployed states.

Rivets, screws, and/or other types of fasteners in combination with washers and/or spacers often provide a connection between links and structural members so that the structural parts of the chair can freely rotate with respect to one another without any excessive dynamic frictional forces. In most cases, however, the links referenced above limit the overall relative movement between the structural members of the deployed chair, and the linkage members often remain in tension during use (under load) to better distribute the loads within the structure of the chair and to prevent the chair from collapsing.

The upholstery of typical chairs is generally sewn or riveted into the chair. In some designs, the upholstery is removable for the purpose of either cleaning or replacement. In the designs where the upholstery is removable, materials like hook and loop fasteners, snaps, zippers, and/or buttons are generally used to attach/separate the upholstery to/from the structural frame.

Current folding chairs fold generally flat with a large rectangular profile. This profile is bulky and makes it difficult to transport the folded chair. Further, it is generally desirable for a user to transport a folded chair by attaching it to a bicycle (or motorcycle, skateboard, rollerblade, scooter, etc.), or to simply walk from a vehicle to a desired location with the folded chair. Further, it is generally desirable for a user to transport/carry more than one folded chair at a time. This can be difficult with the current designs of folding chairs that fold into a large rectangular provide, especially on a windy day where the wind could catch the large surface area of the chair profile and might pose a danger to the user transporting the chair.

Further, typical prior art folding chairs are stationary in nature once they are in the deployed position. More specifically, Prior archers do not allow for rocking motions or swiveling motions when deployed while also allowing the chair to fold in a very compact package when stowed. This causes prior art form chairs to be somewhat uncomfortable.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a portable folding chair including a central assembly having an upper portion and a lower portion. The lower portion may be connectable to the upper portion so that the upper portion may swivel with respect to the lower portion. The portable folding chair may include leg members attached to the lower portion of the central assembly. Each of the leg members may be moveable between a folded position and a deployed position. The portable folding chair may further include seat members that may be attached to the upper portion of the central assembly. Each of the seat members may be moveable between a folded position and a deployed position.

The upper portion of the central assembly may be prevented from swiveling with respect to the lower portion when the leg members and the seat members are in the folded position. The lower portion of the central assembly may be fixed in place and the upper portion may be adapted to swivel with respect to the lower portion when the leg members and the seat members are in the deployed position.

The portable folding chair may further include seat connection members that may be connected to an end of the seat members, and lower seat members that may be rotatably connected to the seat connection members. The portable folding chair may include a pair of upper seat members that may be connected to two of the lower seat members. The lower seat members and the upper seat members may be moveable between a folded position and a deployed position. The lower seat members and the upper seat members may be movable to the deployed position when the seat members are in the deployed position.

The upper seat members may be connectable to end portions of the lower seat members. The upper seat members may each be telescoping. The upper seat members may be adapted to be moved between a collapsed position and an extended position. The portable folding chair may further include a chair upholstery member that may have portions adapted to be removably attached to the lower seat members, and portions that may be adapted to be attached to both the lower seat members and the upper seat members. The chair upholstery member may include a backrest upholstery member, a seat upholstery member and a pair of armrest upholstery members.

The portable folding chair may also include upper geared ends and lower geared ends. The upper geared ends may each include a seat member connection stem. The seat members may be connectable to the seat member connection stems. The lower geared ends may each include a leg member connection stem. The leg members may be connectable to each of the leg member connection stems. Adjacent ones of the upper geared members may be adapted to matingly engage one another so that rotation of one of the upper geared members may cause rotation of each of the upper geared members. Adjacent ones of the lower geared members may be adapted to matingly engage one another so that rotation of one of the lower geared members may cause rotation of each of the lower geared members.

The portable folding chair may further include an upper lock member and a lower lock member. Each of the upper lock member and lower lock member may be moveable between an engaged position and a disengaged position. The respective seat members and leg members may be moveable between the deployed position and the folded position.

The portable folding chair may still further include torsion members that may be connected between the lower portion of the central assembly and each of the lower geared members. The torsion members may also be connected between the upper portion of the central assembly and each of the upper geared members. Each of the torsion members may be configured to move the leg members connected to the lower gear members to the deployed position when the lower lock member is in the disengaged position and may be configured to move the seat members connected to the upper gear members to the deployed position when the upper lock member is in the disengaged position.

Another embodiment of the present invention may be directed to a portable chair that includes a central assembly having an upper portion, a medial portion connected to the upper portion, and a lower portion connected to the medial portion. The portable chair may also include leg members attached to the lower portion of the central assembly. Each of the leg members may be moveable between a folded position and a deployed position. The portable chair may also include seat members attached to the upper portion of the central assembly. Each of the seat members may be moveable between a folded position and a deployed position. The medial portion of the central assembly may be adapted to swivel with respect to the lower portion of the central assembly. The upper portion of the central assembly may be pivotable with respect to the medial portion of the central assembly. Furth the medial portion of the central assembly may be prevented from swiveling with respect to the lower portion of the central assembly when the leg members and the seat members are in the folded position. The upper portion of the central assembly may be prevented from pivoting with respect to the medial portion of the central assembly when the leg members and the seat members are in the folded position.

BRIEF DESCRIPTION OF THE DRAWINGS

Some embodiments of the present invention are illustrated as an example and are not limited by the figures of the accompanying drawings, in which like references may indicate similar elements.

FIG. 308 is a perspective view of a portable folding chair according to an embodiment of the present invention, showing the upper portion of the central assembly pivoting with respect to the lower portion of the central assembly.

DETAILED DESCRIPTION OF THE INVENTION

Figure 1:
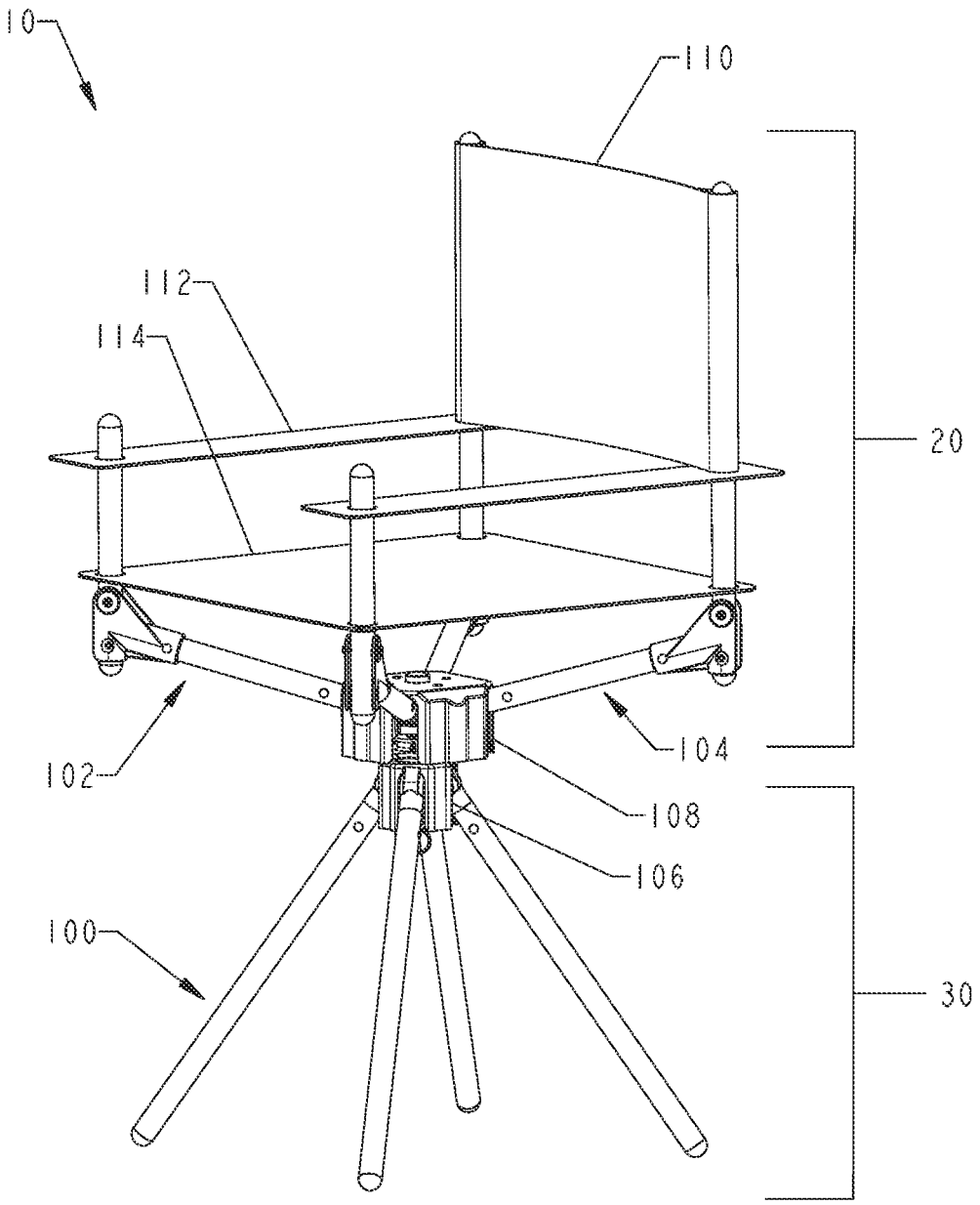
FIG. 1 is a perspective view of a portable folding chair according to an embodiment of the present invention, shown in a deployed position with chair upholstery members connected thereto.
Figure 2:
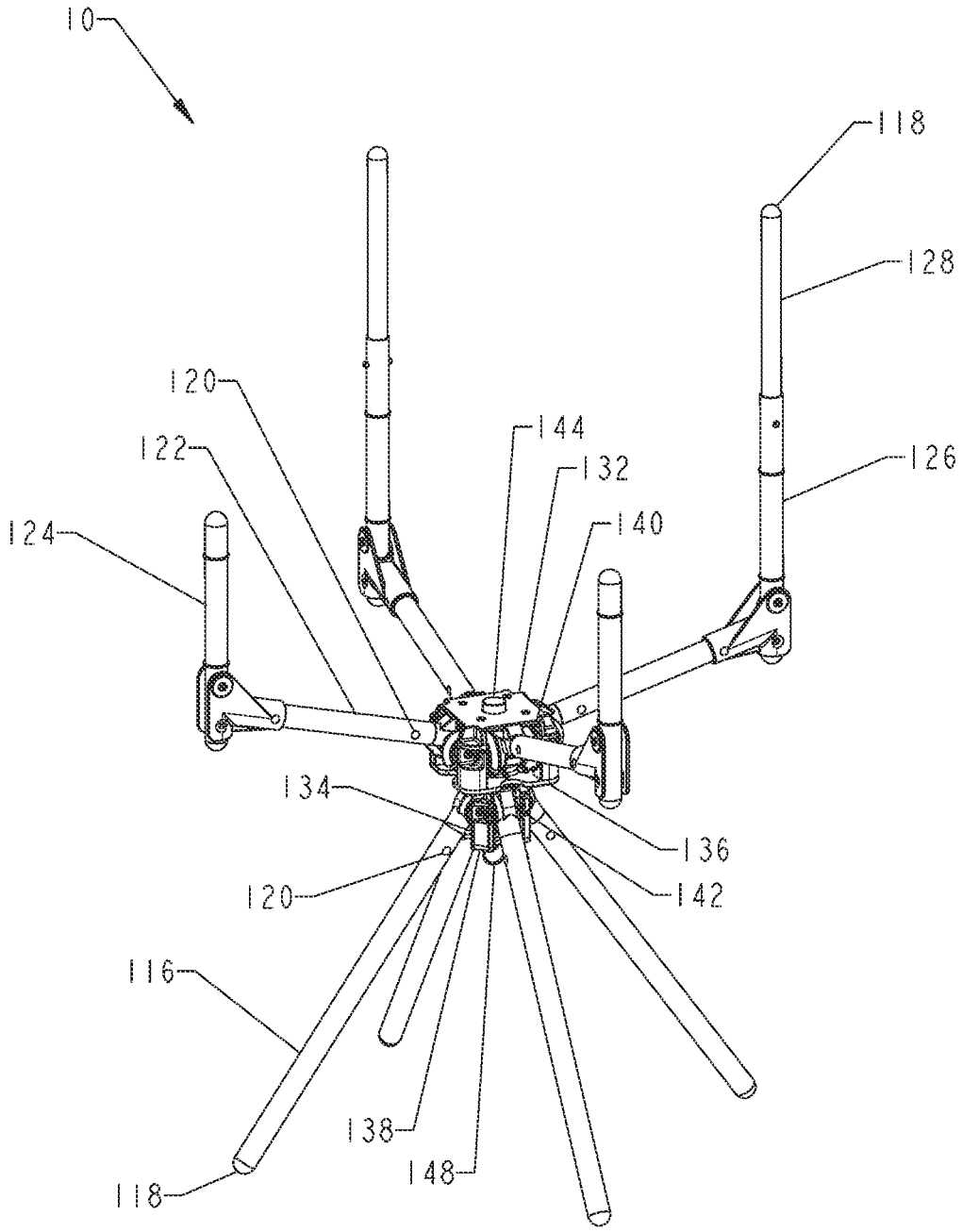
FIG. 2 is a perspective view of the portable folding chair illustrated in FIG. 1, with the chair upholstery members removed.
Figure 3:
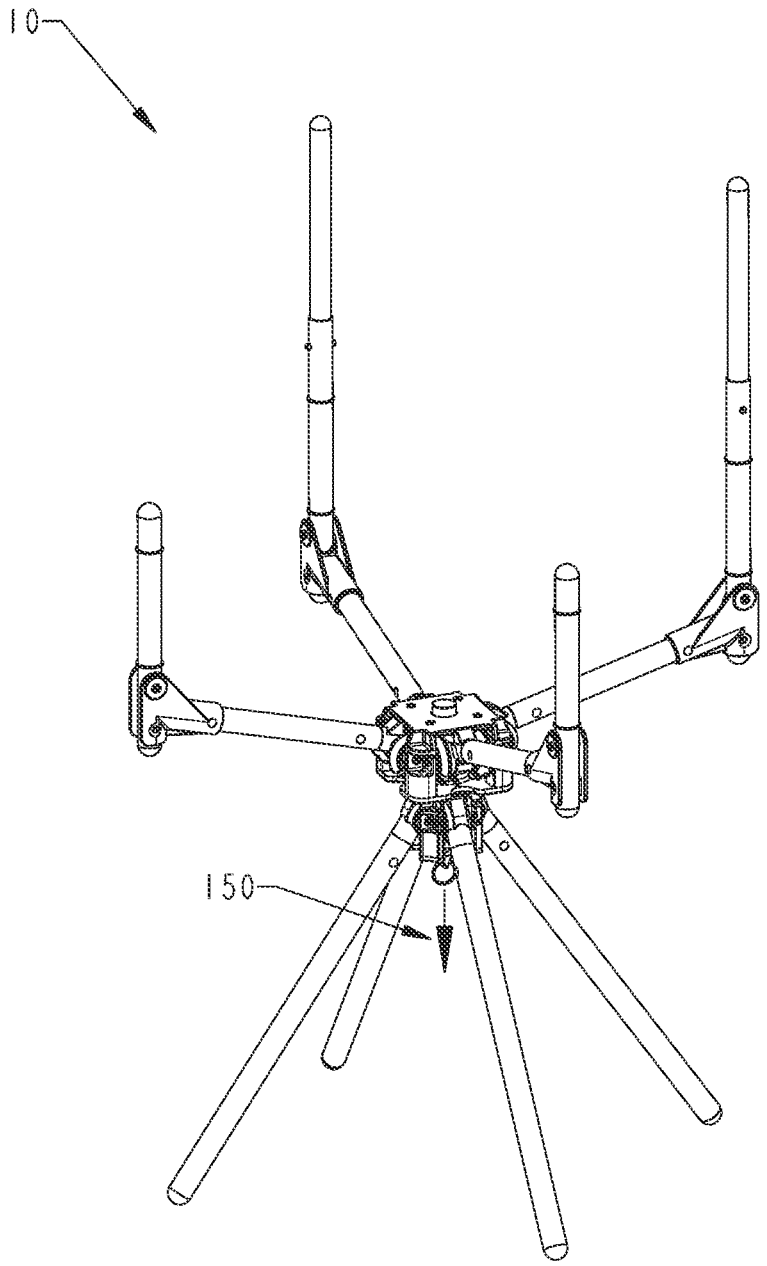
FIG. 3 is a perspective view of the portable folding chair illustrated in FIG. 2, showing a lower lock member being pulled in a downwards direction to a lower lock disengaged position.
Figure 4:
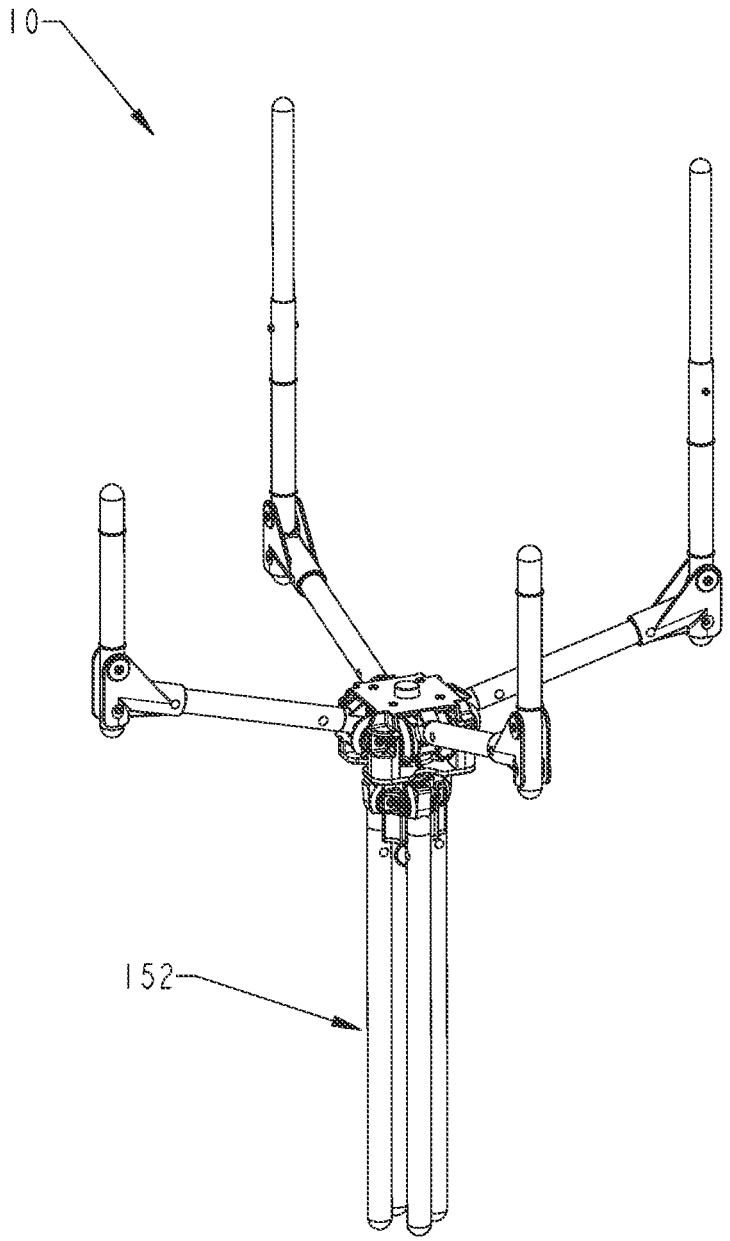
FIG. 4 is a perspective view of the portable folding chair illustrated in FIG. 3, showing the lower portion of the central assembly in a folded position.
Figure 5:
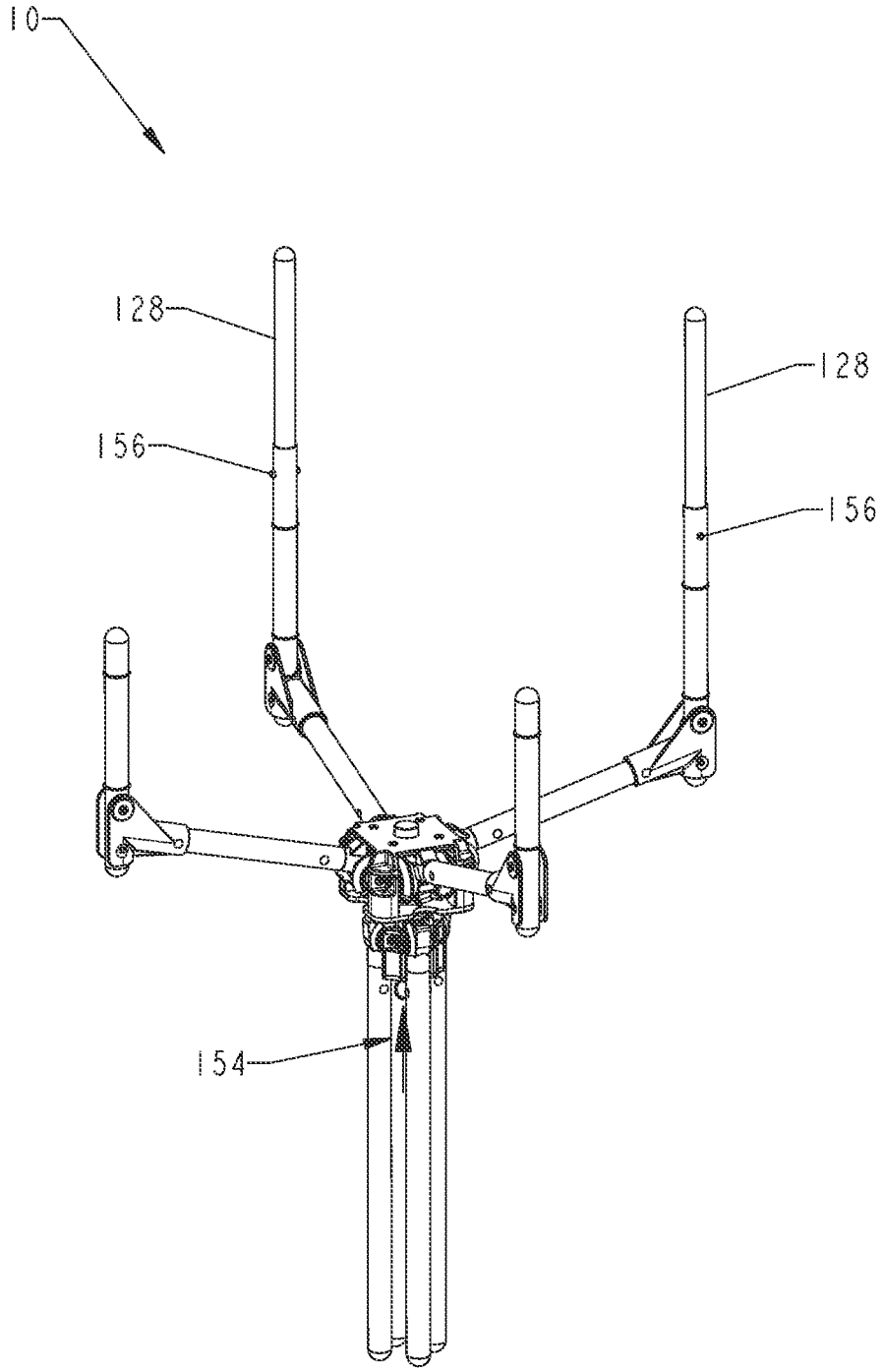
FIG. 5 is a perspective view of the portable folding chair illustrated in FIG. 4, showing the lower lock being moved in an upwards direction to a lower lock engaged position.
Figure 6:
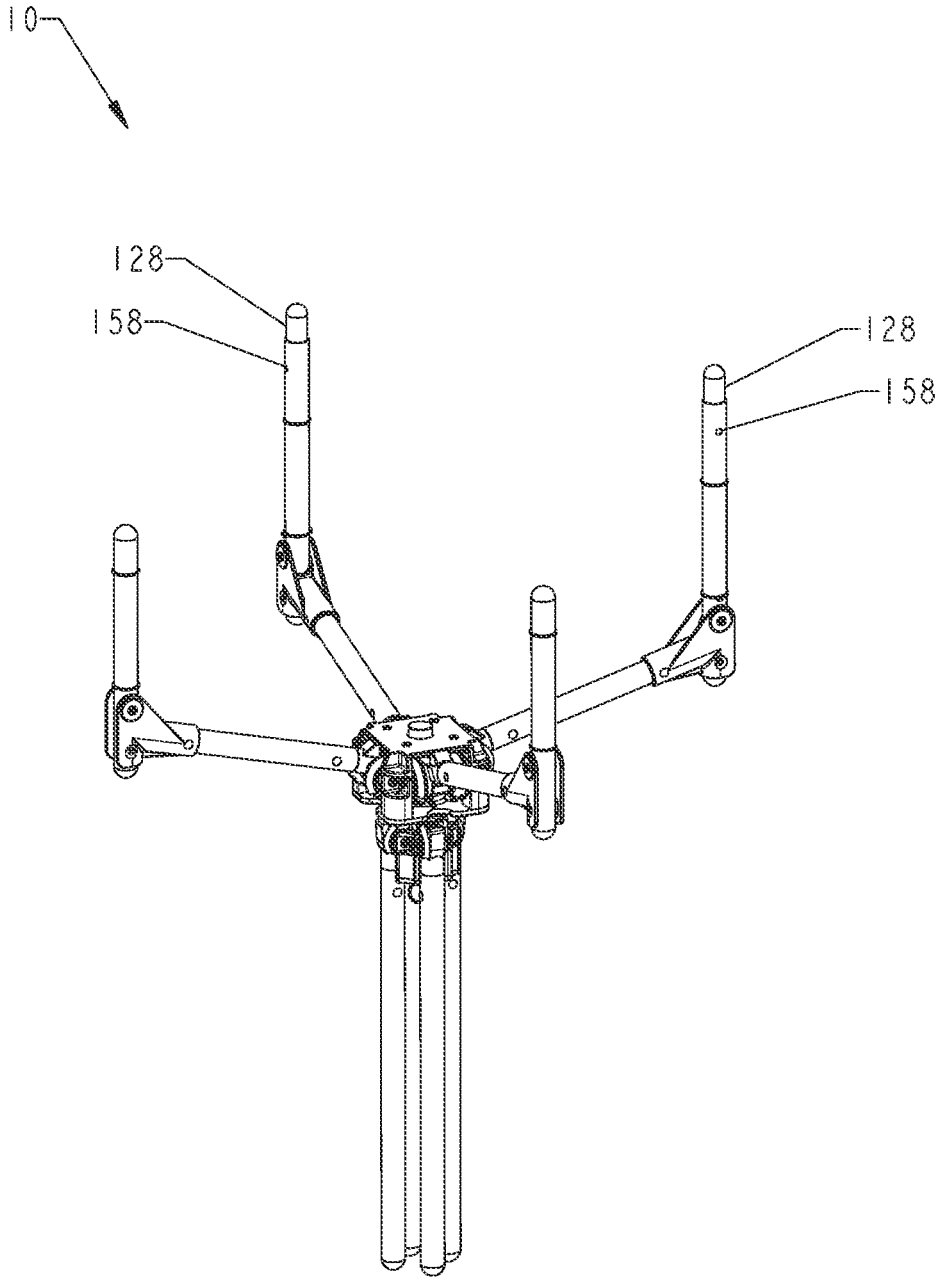
FIG. 6 is a perspective view of the portable folding chair illustrated in FIG. 5, showing the telescopically attached upper seat members in a collapsed position.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

For the purposes of the present invention, the term "swivel" may be defined the same as the term "yaw" (and may be used interchangeably), and refers generally to describing the twisting or oscillating movement about an axis of an object in three-dimensional space that is generally a vertical axis of the object. However, for the purposes of the present invention, a "swivel" and/or "yaw" movement of an object may be about any axis of the object with the axis generally extends linearly in and upwards and downwards direction with respect to the object.

For the purposes of the present invention, the term "pivot" and its various forms and inflections may be defined the same as the term "pitch" and its various forms and inflections (and may be used interchangeably) and refers generally to the rotational movement of an object in three-dimensional space about an axis that is generally a lateral axis of the object. However, for the purposes of the present invention, a "pivot" or "pitch" movement of an object may be about any axis of the object with the axis generally extends linearly in a side-to-side direction with respect to the object.

An embodiment of the invention, as shown and described by the various figures and accompanying text, provides a chair assembly 10, also known throughout the specification and the claims as a portable folding chair 10, that is advantageously collapsible and deployable for portability and convenience.

With reference to FIGS. 1-47E, the portable folding chair 10 may include an upper yoke assembly 20, also known throughout this specification and the claims as an upper assembly 20, and a lower yoke assembly 30, also known throughout this specification and the claims as a lower assembly 30.

An embodiment of the portable folding chair 10 according to the present invention may be adapted to be moved between a folded position and a deployed position. The present invention contemplates that the portable folding chair 10 may have different folded positions, such as, for example, a first folded position and a second folded position. These may also be referred to as a partially folded position and a fully folded position. The deployed position may be defined as when the upper assembly 20 and/or the lower assembly 30 are moved outwards so that the upper assembly 20 and/or the lower assembly 30 is extended outwards. The folded position (or a first folded position) may be defined as when the upper assembly 20 and/or the lower assembly 30 is rotationally moved inwards so that the upper assembly 20 and/or the lower assembly 30 is un-extended. The fully folded position (or the second folded position) may be defined as when the upper assembly 20 and/or the lower assembly 30 is rotationally moved inwards as far as an embodiment of the present invention functionally allows. The present invention may also distinguish between the deployed position, referenced above, and a fully deployed position, which may be defined as when the upper assembly and/or the lower assembly 30 is rotationally moved outwards so that the they are extended as far as an embodiment of the present invention functionally allows.

An embodiment of the present invention may include seat front member assemblies 102 and seat rear member assemblies 104, also known throughout this specification and the claims as the seat members 102, 104, that may be connected to the upper assembly 20. The seat members 102, 104 may also be connected to the upper assembly 20 via a respective number of upper gear ends 140 that may be attached to an end of the seat members 102, 104, and which will be discussed in greater detail below.

The upper assembly 20 may have an upper yoke 132, also known throughout this specification and the claims as the upper portion of the central assembly 132. A plurality of upper geared ends 140 may be attached to the upper portion of the central assembly 132 using, for example, spacer hardware 200 that may allow the upper geared ends 140 to rotate with respect to the upper portion of the central assembly 132. Those skilled in the art will appreciated that the geared ends 140 may be attached to the upper portion of the central assembly 132 in any number of ways, and that various number of connection assemblies are contemplated by the present invention.

The seat members 102, 104 may include a seat member 122, also known throughout this specification and the claims as a lower seat member 122, which may be attached to the upper geared end 140. The upper geared end may include a tube connection stem 234, also known throughout the specification and the claims as a seat member connection stem 234, The lower seat members 122 may have a tubular inner diameter profile that may be adapted or configured to matingly engage and/or slide over the seat member connection stem 234 of the upper geared end 140. The seat member connection stems 234 may have one or more concentric holes 218, also known throughout the specification and the claims as upper geared end channels 218.

The upper geared end channels 218 may be configured and/or adapted to accept or be matingly engaged with and/or by a rivet 120, which may attach the seat member connection stem 234 with the lower seat member 122. A pivot 130, also known throughout this specification and the claims as a seat connection member 130, may be attached at an end of the lower seat member 122. The seat connection member 130 may matingly engage with and/or slide over an outer diameter of the lower seat member 122. The seat connection members 130 and the lower seat members 122 may be secured to each other via a rivet 120.

The upper assembly 20 may include an armrest support member 124, a lower backrest member 126, and an upper backrest support member 128. Each of the armrest support member 124, the lower backrest member 126, and the upper backrest support member 128 are also known throughout the specification and the claims collectively as an upper seat member 124,126,128. One or more upper seat members 124,126,128 may be attached to one or more seat connection members 130. One or more upper seat members 124,126, 128 may be attached to the seat connection members 130 with a pivot spacer 260 positioned between the upper seat member 124,126,128 and the seat connection member 130. The pivot spacer 260 may be used so that the upper seat members 124,126,128 may more freely rotate while attached to one of the seat connection members 130. Those skilled in the art will appreciate that any type of connection member may be used for the upper seat members 124,126,128 may be rotatably attached to one of the seat connection members 130, and that the present invention is not meant to be limited to the connection member provided by a pivot spacer 260.

Figure 7:
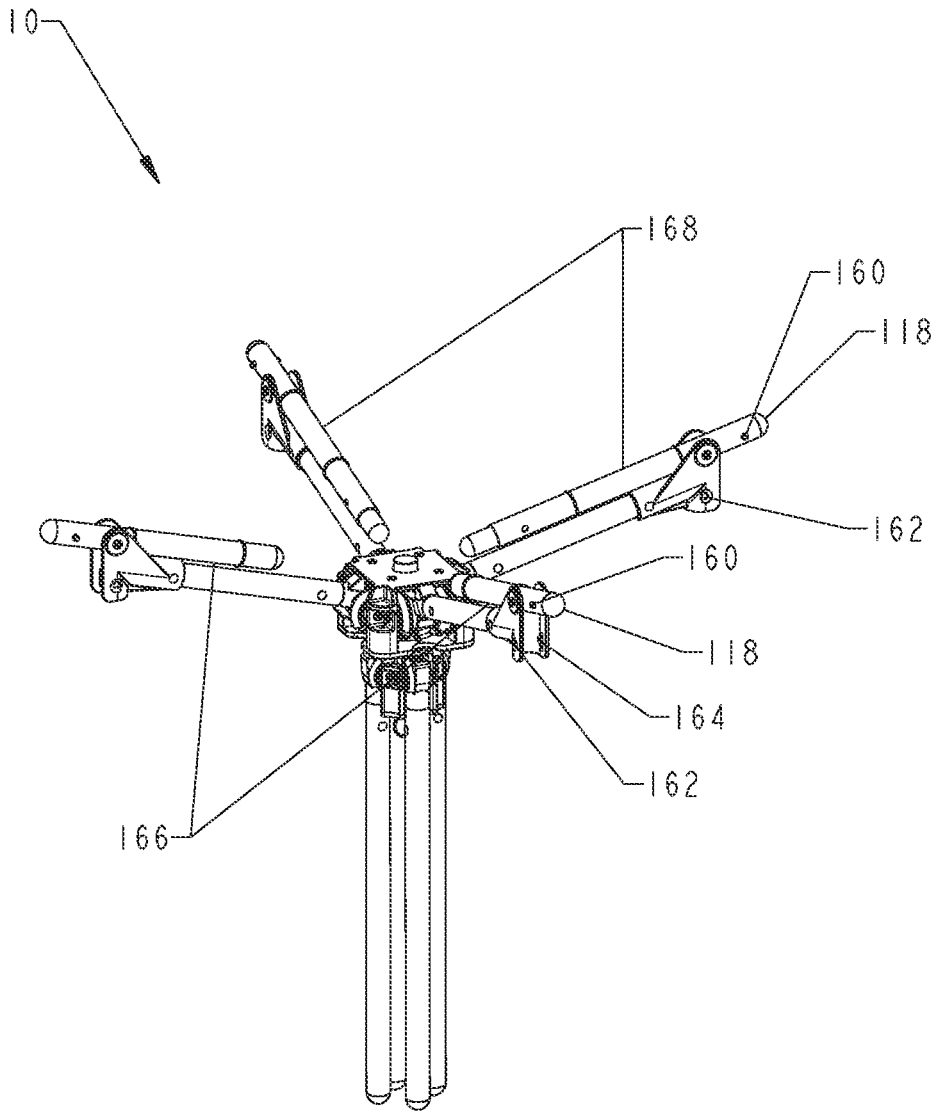
FIG. 7 is a perspective view of the portable folding chair illustrated in FIG. 6, showing the upper seat members in a folded position.
Figure 8:
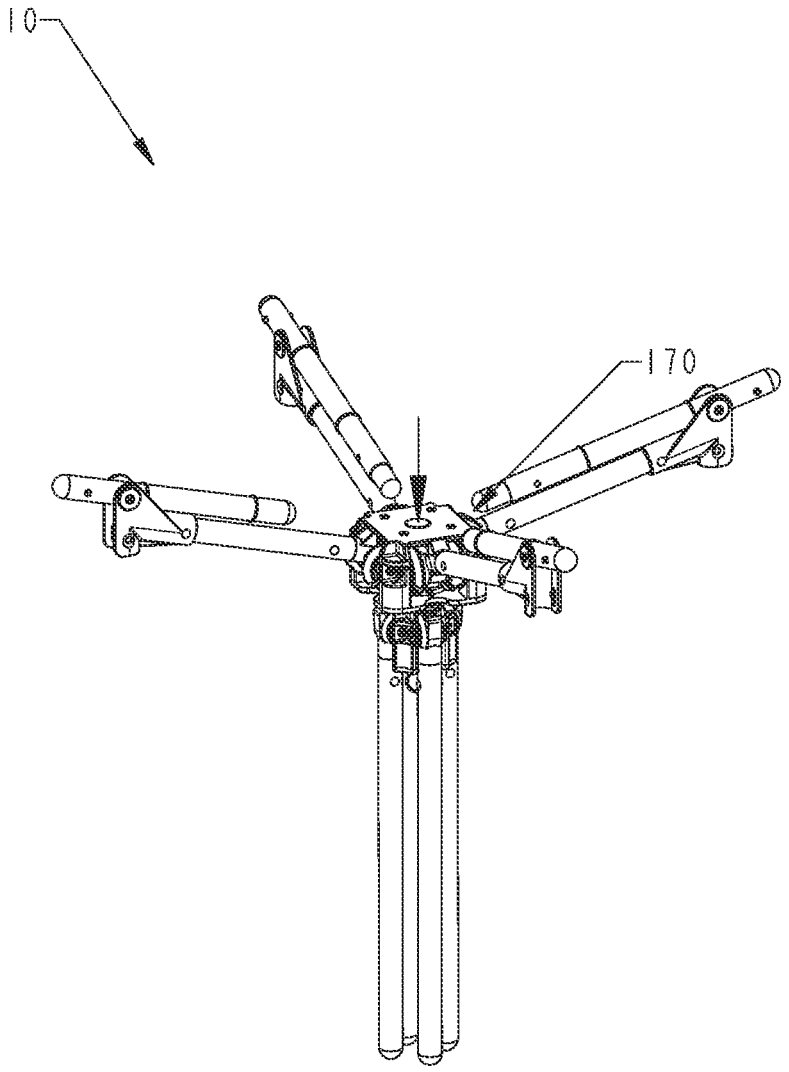
FIG. 8 is a perspective view of the portable folding chair illustrated in FIG. 7, showing an upper lock button being pressed in a downwards direction to a disengage position.
Figure 9:
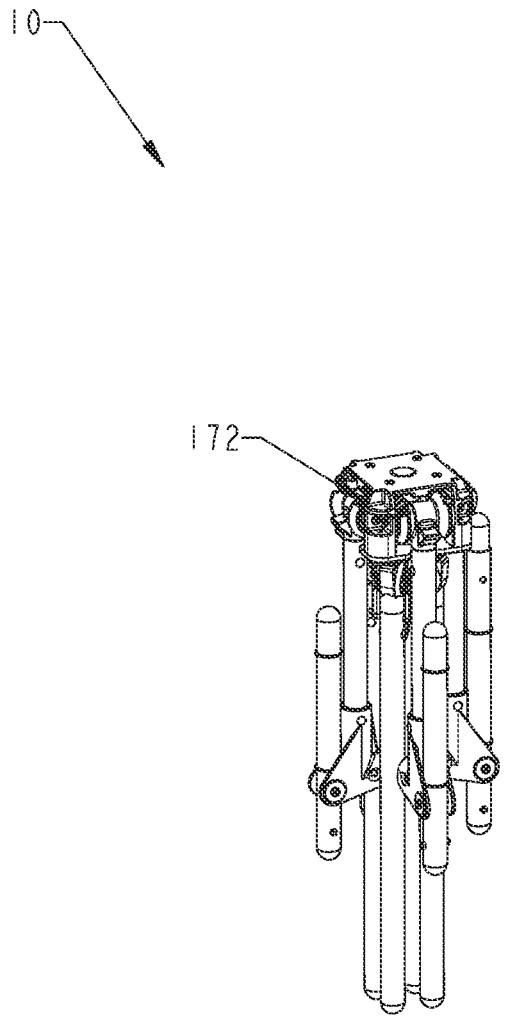
FIG. 9 is a perspective view of the portable folding chair illustrated in FIG. 8, showing the portable folding chair in a folded position.
Figure 10:
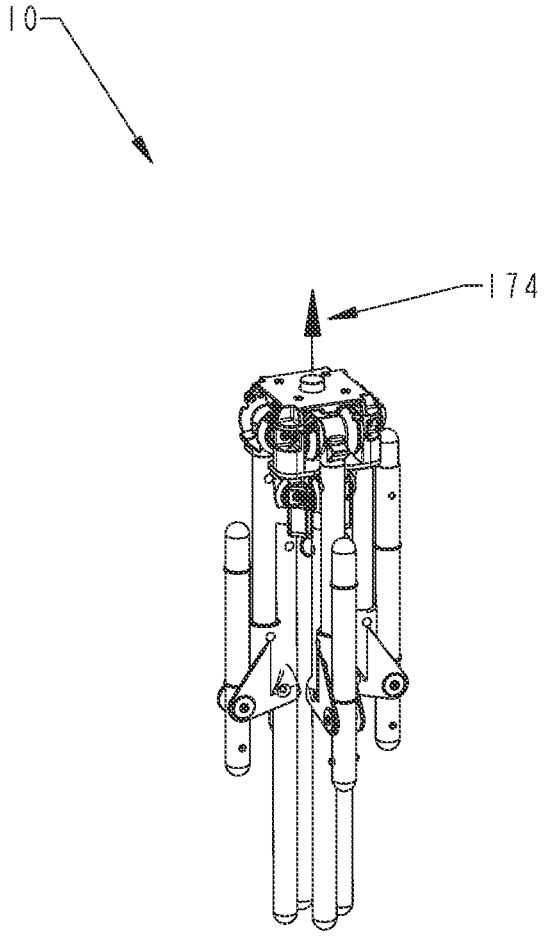
FIG. 10 is a perspective view of the portable folding chair illustrated in FIG. 9, showing the upper lock member being moved in an upwards direction to the engaged position.
Figure 11:
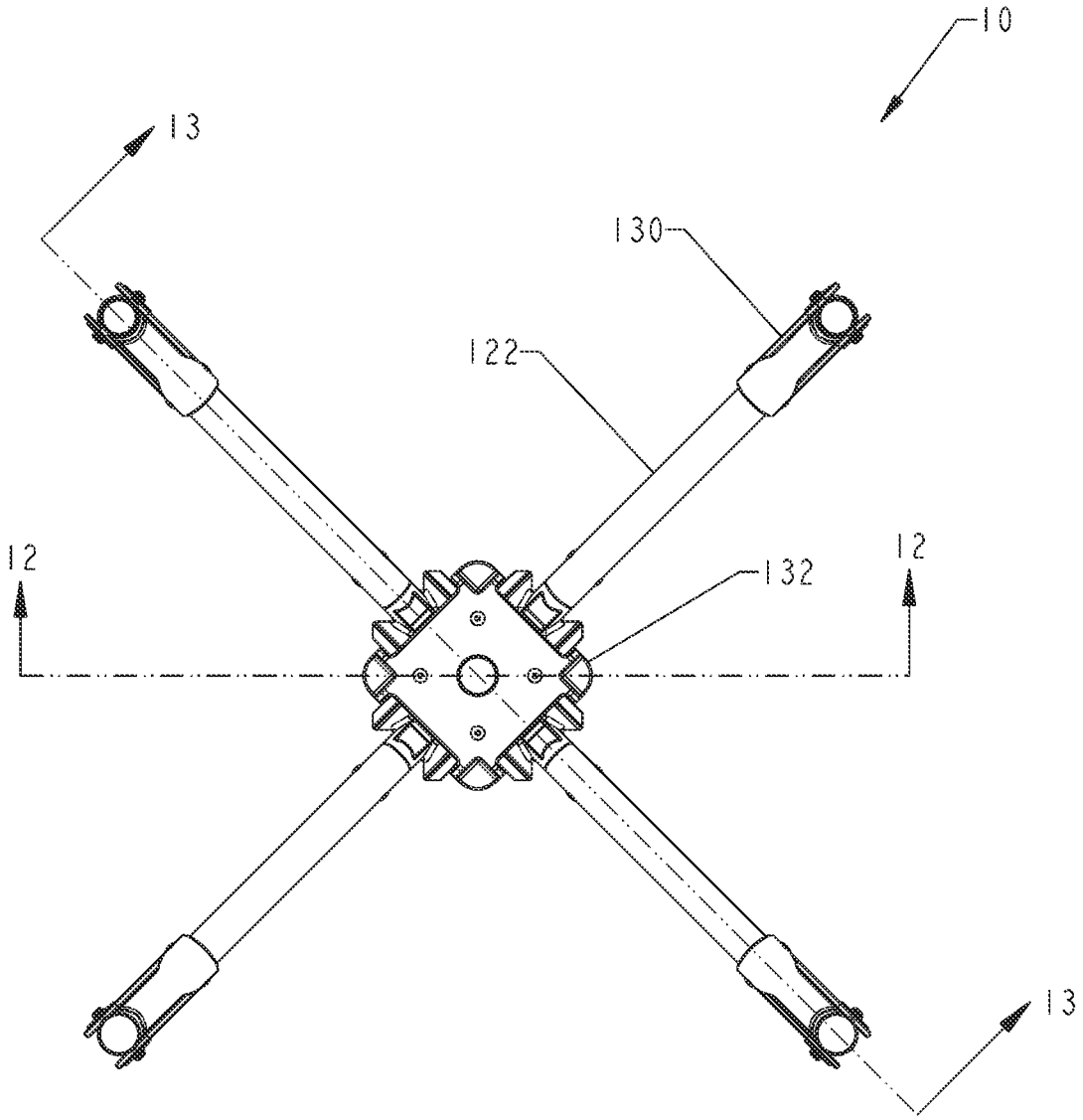
FIG. 11 is a top plan view of a portable folding chair according to an embodiment of the present invention, shown in a deployed state.
Figure 12:
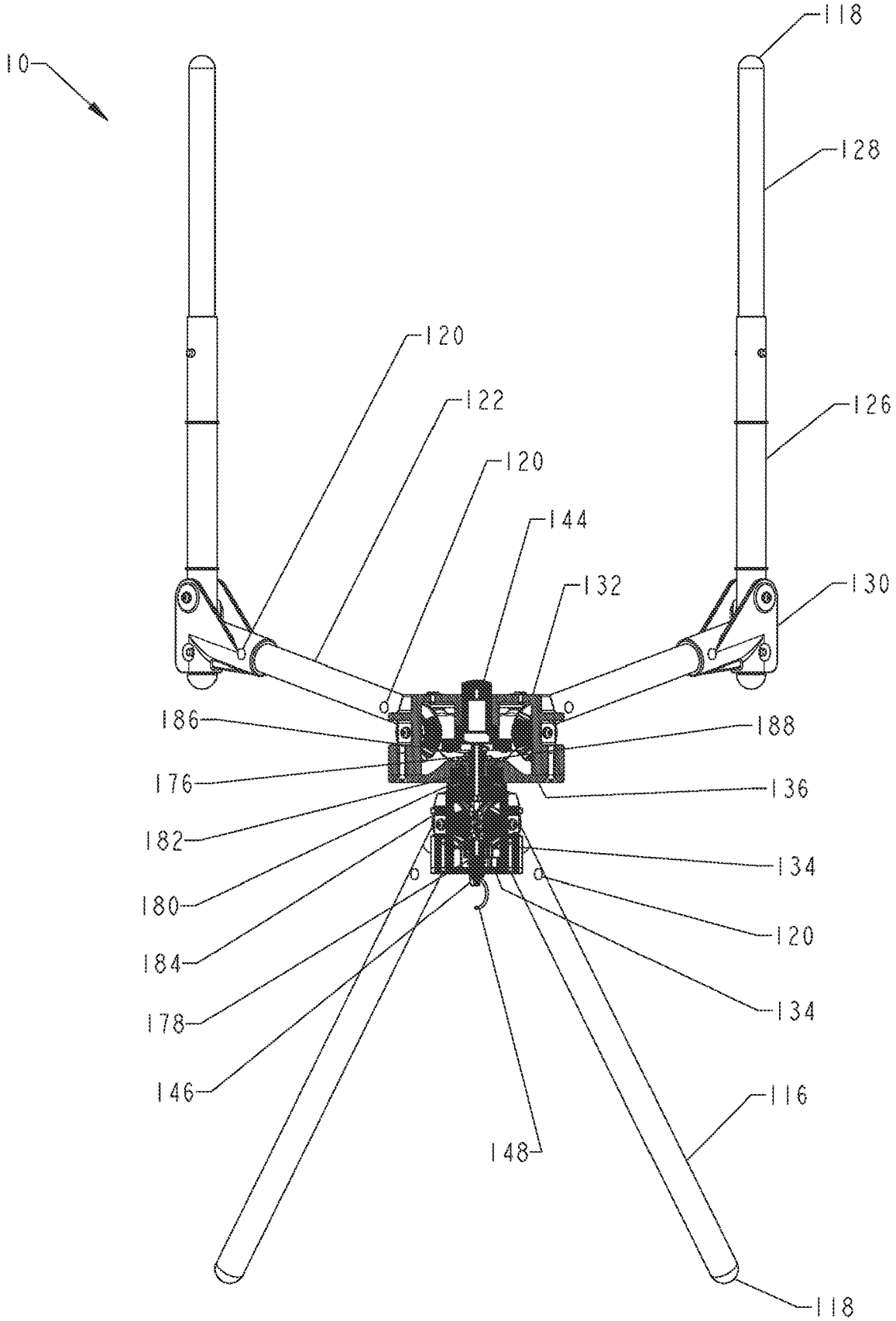
FIG. 12 is a cross section view of the portable folding chair illustrated in FIG. 11.
Figure 13A:
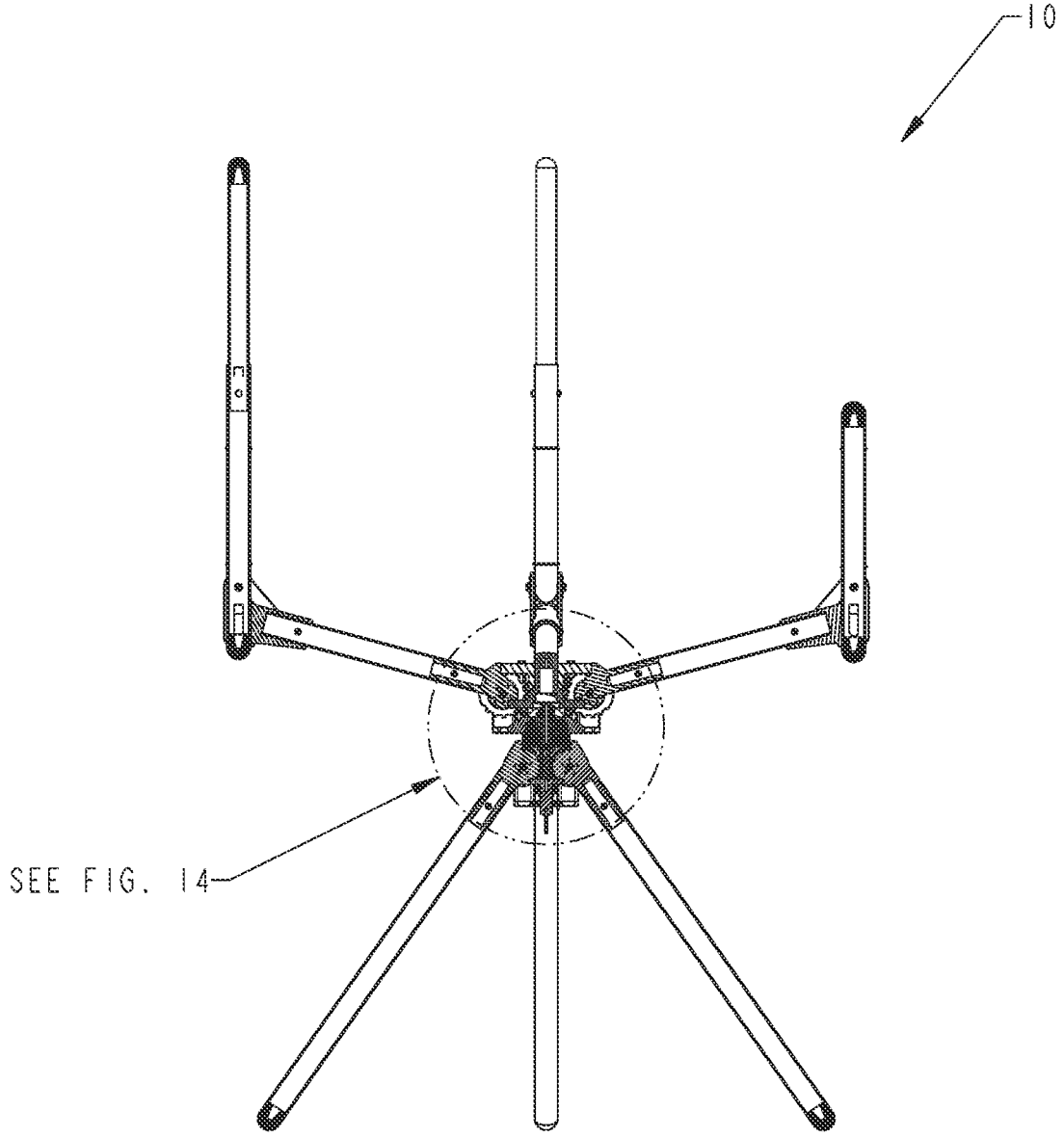
FIG. 13A is another cross section view of the portable folding chair illustrated in FIG. 11.
Figure 13B:
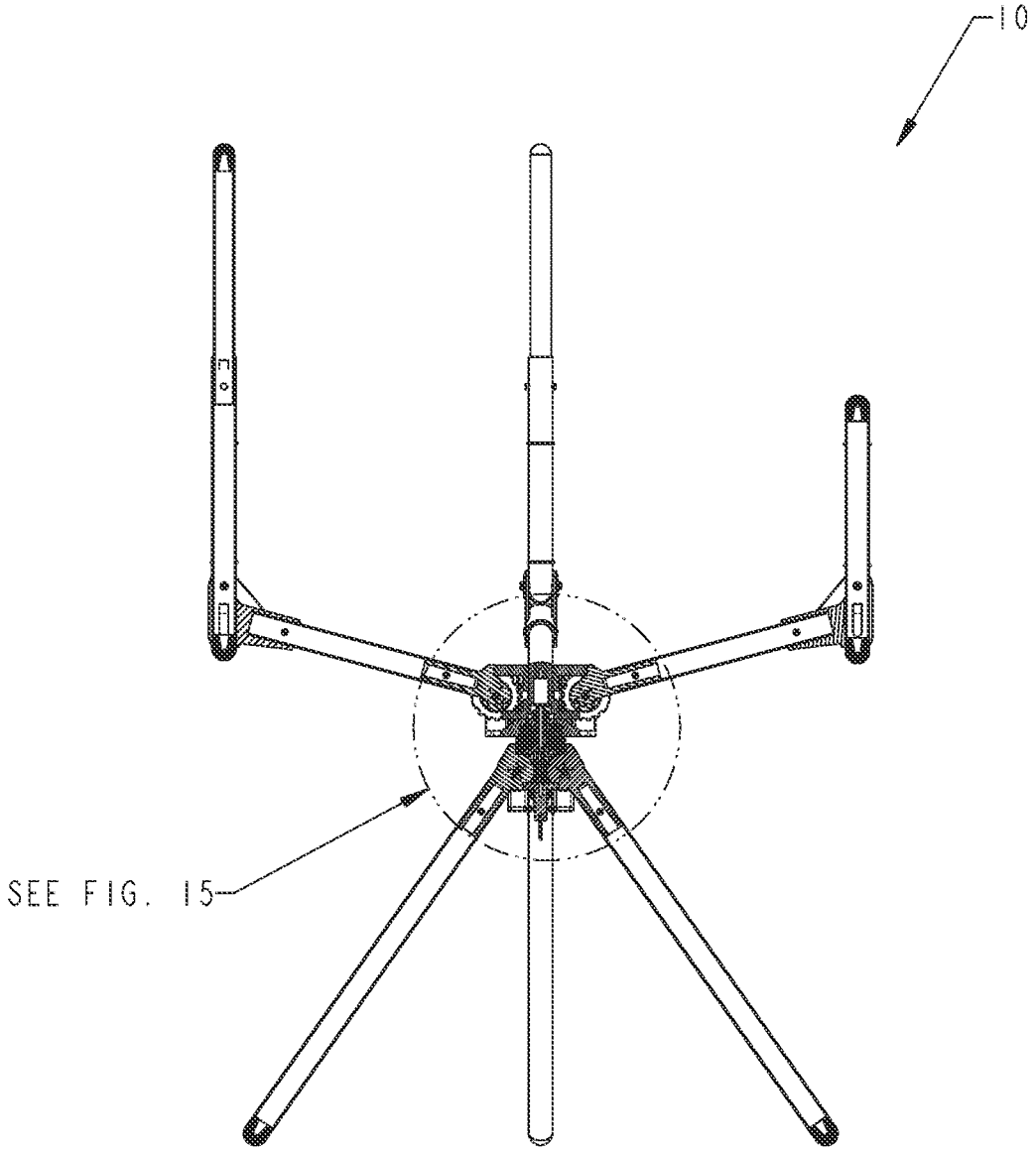
FIG. 13B is another cross section view of a portable folding chair according to an embodiment of the present invention.
Figure 14:
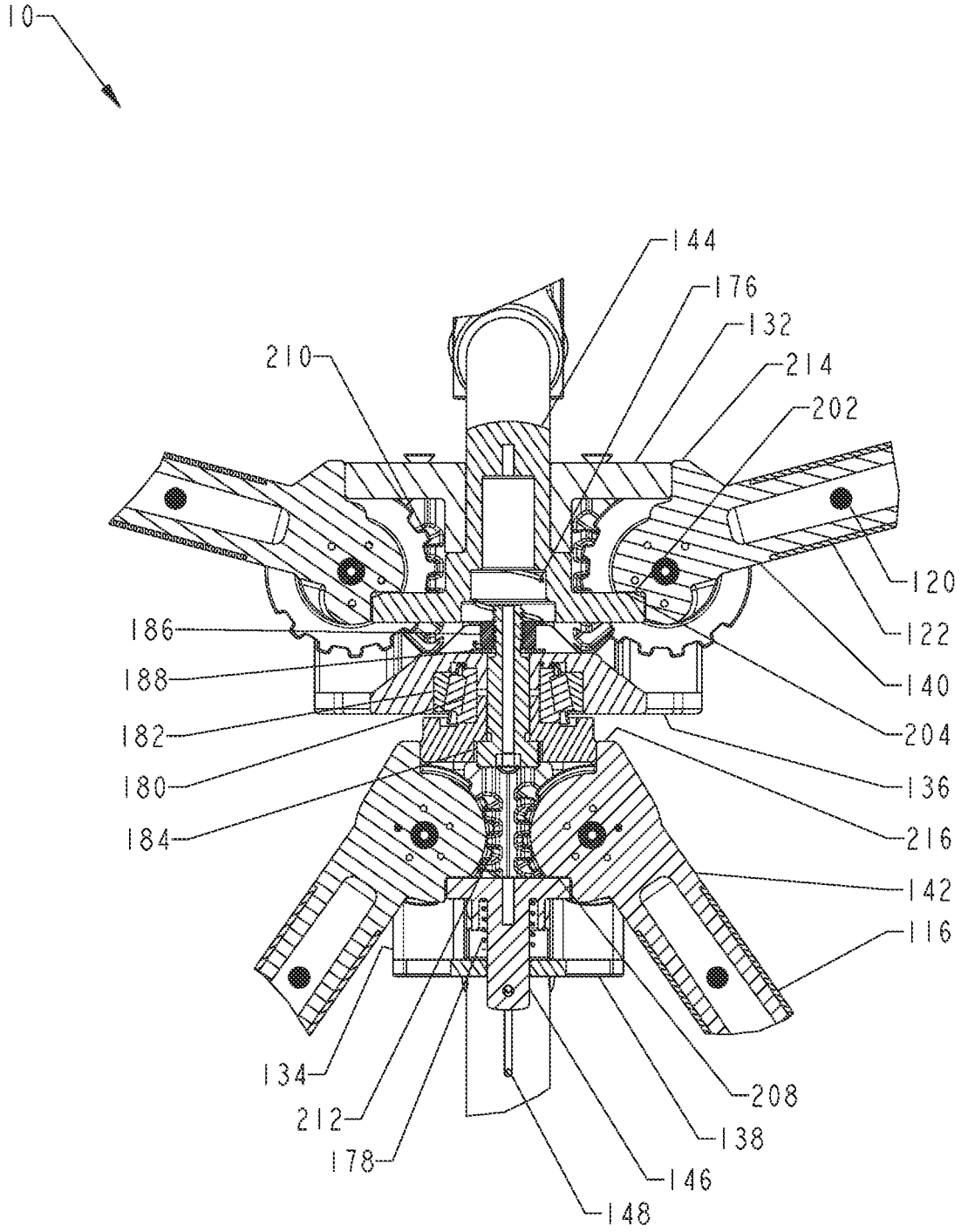
FIG. 14 is a partial perspective view of the portable folding chair illustrated in FIG. 13A.

The upper seat members 124,126,128 may include a tube button 160, also known throughout the specification and the claims as a seat connection member lock 160. The seat connection members 130 may include a tube button lock hole 162, also known throughout the specification and the claims as a seat connection member lock passageway 162. The seat connection member lock passageway 162 may be positioned extending through a portion of the seat connection member 130 and may be configured to align with the tube button on the upper seat members 124,126,128 when in the deployed position. Referring now more specifically to FIG. 7, one end of the seat connection member lock passageways 162 may include a detent feature 164. The detent feature 164 may be used to capture and/or secure the upper seat members 124,126,128 and/or the seat connection member lock 160 (also illustrated in FIG. 7) when in the deployed position. The seat connection member lock 160 on the seat members 124,126,128 may also be configured to removably matingly engage the seat connection member passageway 162 on the seat connection member 130.

As the upper seat member 124,126,128 is deployed within the seat connection member 130, the upper seat member 124,126,128 may be captured by the detent feature 164 in the seat connection member 130 and then positively locked in place as the tube button 160 engages with the seat connection member lock passageway 162 in the seat connection member 130.

An embodiment of the present invention may include one or more pairs of upper seat members 124,126,128 that may be attached at one of each other's ends, and each of the attached pair of upper seat members 124,126,128 may have different diameters so that one of them may be translated into or out from the other. The attached pair of upper seat members 124,126,128 may be attached in a telescopic configuration so that the pair of the upper seat members 124,126,128 may be translated telescopically with each other. The pair of telescopically attached upper seat members 124,126,128 may include one or more lock button holes 158 (perhaps best illustrated in FIGS. 6, 16, 28 and 29), also known throughout the specification and the claims as a telescope lock passageway 158. The pair of telescopically attached upper seat members 124,126,128 may also include one or more tube buttons 156 (also illustrated in FIGS. 6, 16, 28 and 29), also known throughout the specification and the claims as a telescope lock 156. The telescope lock 156 may be configured to matingly engage the telescope lock passageway 158 when the telescope lock 156 is aligned with the telescope lock passageway 158. The telescope lock 156 may be a spring-loaded push button that may be operated by a user to press the telescope lock 156 inwards into the upper seat member 124,126,128, which may, in turn, cause the telescope lock 156 to be disengaged from the telescope lock passageway 158, allowing the upper seat members 124,126,128 to be telescopically translated. A telescope lock 156 that is a spring-loaded push button may readily engage the telescope lock passageway 158 when the telescope lock 156 is aligned with said telescope lock passageway 158.

The pair of telescopically attached upper seat members 124,126,128 may be adapted to move between an extended position and a collapsed position. The extended position may be defined as when the pair of telescopically attached upper seat members 124,126,128 are extended to a fully extended length so that the telescope lock 156 engages the telescope lock passageway 158. To move the upper seat members 124, 126,128 from the extended position to the collapsed position, the telescope lock 156 may be disengaged from the telescope lock passageway 158. Upon disengaging the telescope lock 156 from the telescope lock passageway 158, the upper seat members 124,126,128 may then be moved to the collapsed position, which may be defined as when the pair of telescopically attached upper seat members 124,126,128 are telescopically translated to a length shorter than the fully extended length.

An embodiment of the present invention may include a torsion spring 196, 222 (which is perhaps best illustrated in FIG. 16, as well as in FIGS. 35 and 37) also known throughout the specification and the claims as a torsion member 196, 222. The torsion member 196, 222 may be positioned and/or inserted between the upper geared end 140 and the upper portion of the central assembly 132. The torsion member 196, 222 may be constrained at either end by a tang 198, 224 (which is perhaps best illustrated in FIG. 17, as well as in FIG. 16) that engages with spring tang notch 248 (which is perhaps best illustrated in FIG. 17) and spring tang engagement hole 244 (which is perhaps best illustrated in FIGS. 21 and 34) to provide for spring bias to either help open the upper assembly 20. In another embodiment, the torsion member 196, 222 could be biased to help close the upper assembly 20 by changing the winding direction of the torsion member 196, 222. The seat members 102, 104 may be inserted into the upper portion of the central assembly 132 and rotation spacer hardware 200 may be fastened in place to retain the seat members 102, 104.

The lower assembly 30 may include a lower yoke 134, also known throughout the claims and the specification as the lower portion of the central assembly 134. The lower assembly 30 may also include a leg assembly 100. The leg assembly 100 may include leg members 116, tube ends 118, and lower geared ends 142.

The lower geared ends 142 may include a tube connection stem 242 (which is perhaps best illustrated in FIGS. 22 and 44), also known throughout the specification and the claims as a leg member connection stem 242. The lower geared ends 142 may also include left beveled gear teeth 238 and right beveled gear teeth 240, also known throughout the specification and the claims as lower geared end teeth 238, 240.

A plurality of the lower geared ends 142 may be rotatably attached to the lower portion of the central assembly 134 by one or more spacer hardware 226. The space hardware 226 may allow the lower geared ends 142 to reduce the rotational friction caused by rotating the lower geared ends 142 with respect to the lower portion of the central assembly 134.

The leg assembly 100 may be rotationally attached to the lower portion of the central assembly 134. The leg members 116 of the leg assembly 100 may be rotatably attached to the lower portion of the central assembly 134 and/or attached to the lower geared ends 142. The leg members 116 may also be matingly engaged with and/or attached to a portion of the leg member connection stems 242 of the lower geared ends 142. The leg members 116 and/or the leg member connection stem 242 may include a concentric hole 220 (which is perhaps best illustrated in FIGS. 18 and 44), also known throughout the specification and the claims as a lower rivet channel 220. The leg members 116 may be attached and/or connected to the leg member connection stem 242 and/or the lower geared end using a rivet 120. The lower rivet channel 220 may be configured to be matingly engaged with the rivet 120, which may attach, connect, and/or secure the leg member 116 and the leg member connection stem 242 together. Those skilled in the art will appreciate that the present invention contemplates that the leg members 116 may be connected to the leg member connection stem 242 in any other number of ways, and that the present invention is not meant to be limited to connecting the leg members to the leg member connection stem using rivets.

The torsion members 196, 222 may be inserted, attached, positioned, and/or connected between each of the lower geared ends 142 and the lower portion of the central assembly 134. The torsion member 196, 222 may have a spring tang 198, 224, also known throughout the specification and the claims as a tang 198, 224, at one or more ends on the torsion member 196, 222. The lower portion of the central assembly may have a plurality of spring tang notches 250 (which is perhaps best illustrated in FIG. 18), also known throughout the specification and the claims as a lower assembly tang notch 250. One of the plurality of torsion members 196, 222 may be engaged with and/or connected to one of the lower assembly tang notches 250. Specifically, one or more of the tangs of the plurality of torsion members 196, 222 may be engaged with and/or connected to one or more of the lower assembly tang notches 250.

The plurality of torsion members 196, 222 may be engaged and/or connected to one or more of a plurality of spring tang engagement holes 246, also known throughout the specification and the claims as a lower geared end torsion member engagement channel 246. The lower geared end torsion member engagement channels 246 may be positioned on the lower portion of the central assembly 134 adjacent to each of the lower geared ends 142. The torsion members 196, 222 may comprise, without limitation, a spring. The plurality of torsion members 196, 222 may be used to provide for spring bias to readily deploy the lower assembly 30 to a deployed position.

In an embodiment of the present invention, the torsion members 196, 222, and/or the tangs 198, 224 of the torsion members 196, 222, may be configured, engaged with and/or connected to the lower portion of the central assembly 134, the lower assembly tang notches 250, and/or the lower geared end torsion member engagement channels 246 to readily close the lower assembly 30 to a folded position. A rotation spacer hardware 200 may be positioned between the leg assembly 100 and the lower portion of the central assembly 134.

The upper geared ends 140 may have left beveled gear teeth 230 and right beveled gear teeth 232, also known throughout the specification and the claims as upper geared end teeth 230, 232. The upper geared end teeth 230, 232 may be configured to be concentric with the center of rotation of the upper geared end 140. The upper geared end teeth 230, 232 may be configured to be out of phase by a half tooth pitch with adjacent upper geared end teeth 230, 232 on an adjacent upper geared end 140 so that the upper geared end teeth 230, 232 on each upper geared end 140 may matingly engaged with each other so that all the upper geared ends 140 of an embodiment of the present invention may be at the same angle of rotation. This out of phase configuration of the upper geared end teeth 140 may advantageously allow cause rotational movement in all the upper geared ends 140 upon rotationally moving any one of the upper geared ends 140. This aforementioned configuration of the upper geared end teeth 230, 232 is advantageous to enable a user to only have to move one lower seat member 122 to move all lower seat members 122 of an embodiment of the present invention.

The upper geared ends 140 may include a hard stop 214 (illustrated, for example, in FIG. 17) positioned on an upper side of the upper geared end 140. The hard stop 214 may be configured to abut the upper portion of the central assembly 132 when the upper geared end 140 is rotationally moved to the fully deployed position or deployed position so that the upper geared end 140 may be prevented from rotationally moving any further in that direction.

An embodiment of the present invention may include one or more chair upholstery members 80. The chair upholstery members 80 may be removably attached to and/or removably connected to one or more of the lower seat members 122, the seat connection members 130, and the upper seat members 124,126,128. The chair upholstery members 80 may include a backrest upholstery member 110, a seat upholstery member 114, and one or more armrest upholstery members 112. Although the figures depict that the backrest upholstery member 110, the seat upholstery member 114, and the armrest upholstery members 112 are illustrated as being separate pieces, those skilled in the art will appreciate that any combination of the backrest upholstery member, the seat upholstery member, and the armrest upholstery members may be provided in a combined fashion. More specifically, and by way of example, those skilled in the art will appreciate that the backrest upholstery member 110, the seat upholstery member 114, and the armrest upholstery member 112 may be provided as a single monolithic unit. Alternatively, and also for example, the backrest upholstery member 110 and the armrest upholstery members 112 may be provided as a single monolithic unit while the seat upholstery member 114 may be provided as a separate member. Those skilled in the art will appreciate that any combination of the upholstery members is contemplated by the present invention.

Those skilled in the art will notice and appreciate that as a user sits down on the seat upholstery member 114, the vertical load from the weight of the person sitting on the seat upholstery member 114 is advantageously transferred to the seat members 102,104. Those skilled in the art will also notice and appreciate that although it is likely that the upper geared ends 140 will tend to rotate upward, the hard stops 214 will advantageously press against the upper portion of the central assembly 132 and limit or reduce the upward rotation of the upper geared ends 140.

As a user sits down on the seat upholstery member 114 there may be an inward force that may to cause the upper geared ends 140 to rotate towards the folded position. Advantageously an upper lock button 144 (also known throughout the specification and the claims as the upper lock member 144) may be positioned on an upper surface of the upper portion of the central assembly 132 that may include a lock feature 204 (also known throughout the specification and the claims as a upper lock member protrusion 204) that may engage a mating lock feature 202 (also known throughout the specification and the claims as a upper geared end lock receptacle 202) positioned on the upper geared end 140 so that the upper geared end 140 is constrained in rotational movement from this inward force.

Figure 15:
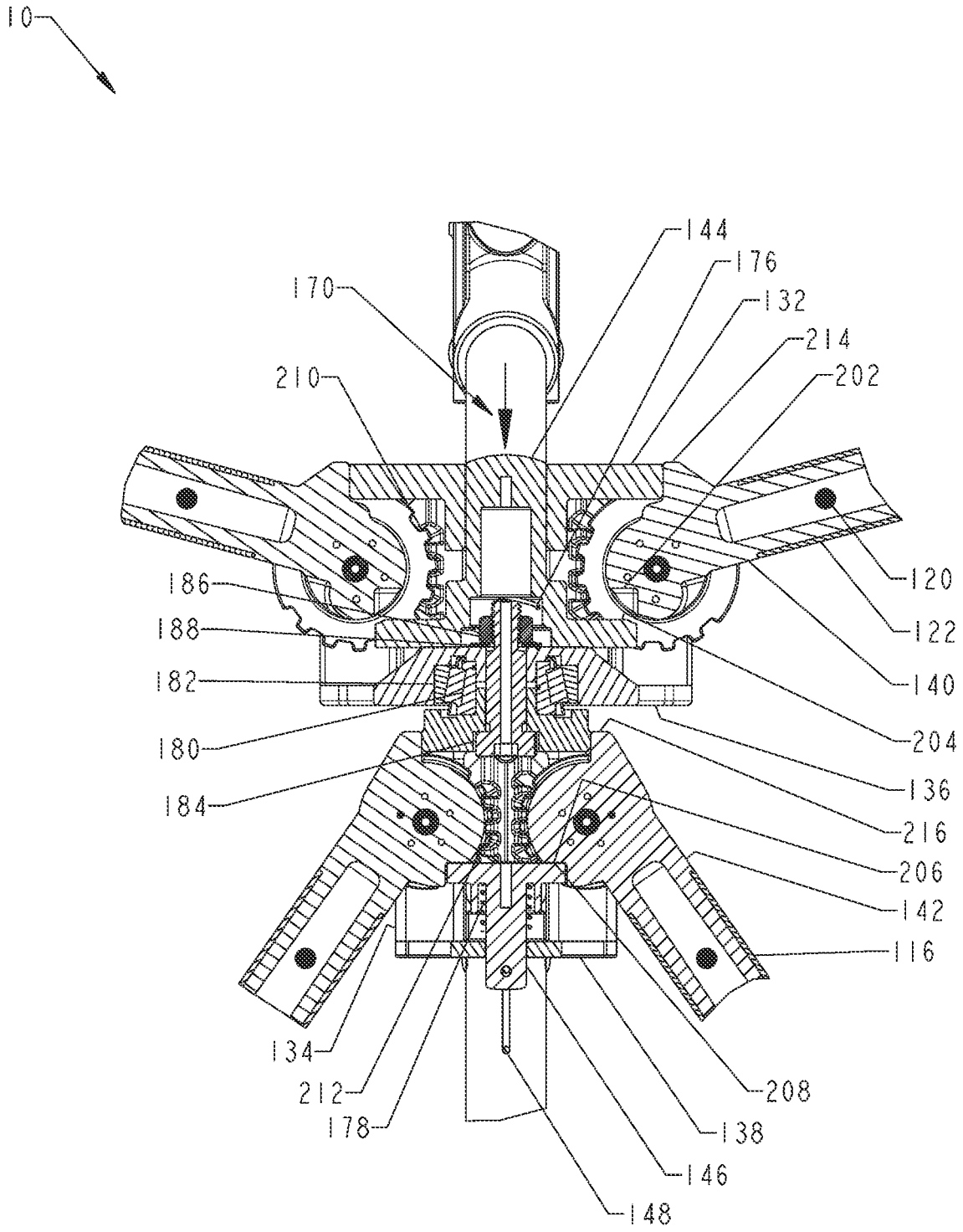
FIG. 15 is a partial perspective view of the portable folding chair illustrated in FIG. 13B.
Figure 16:
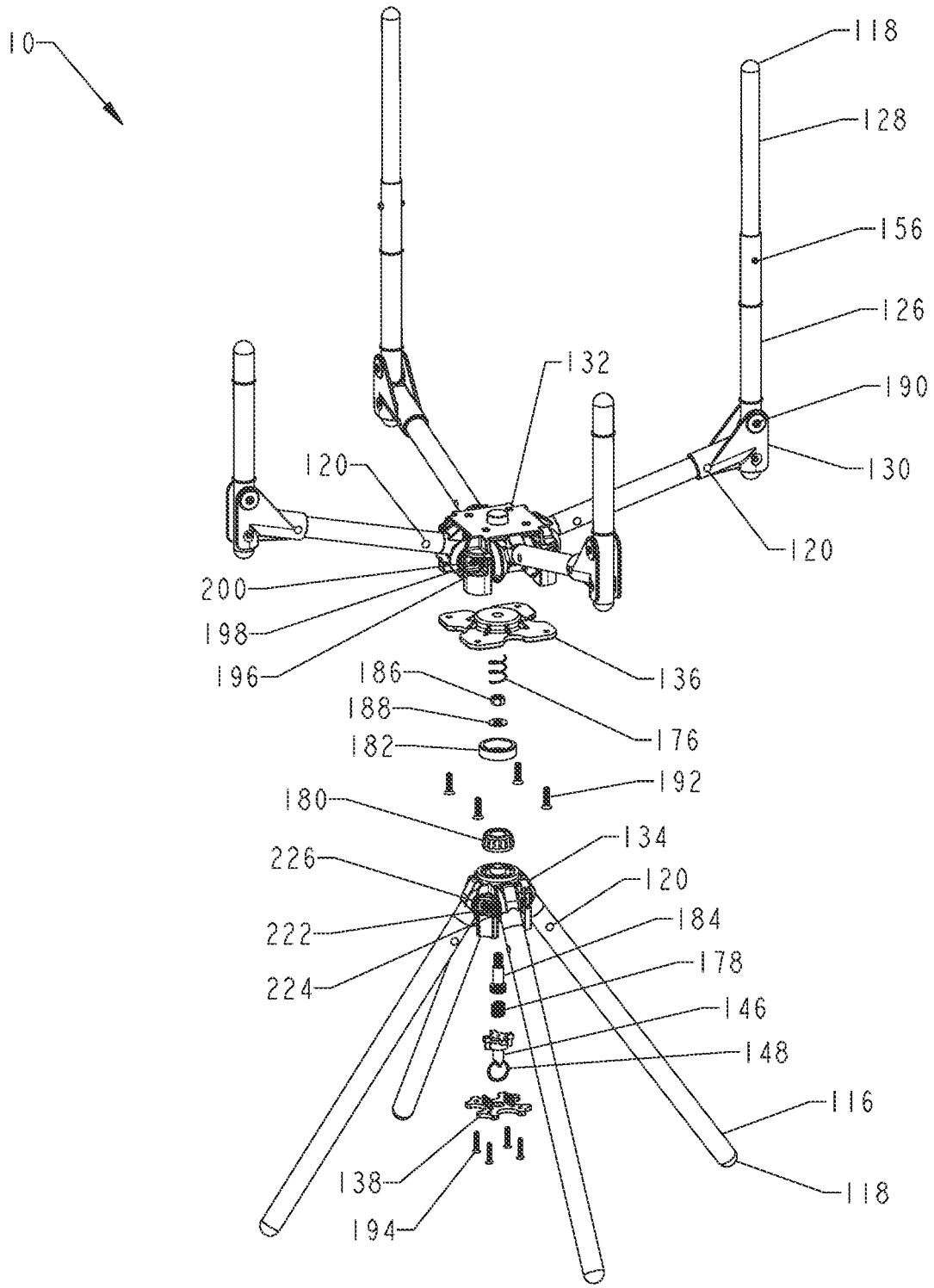
FIG. 16 is an perspective exploded view of a portable folding chair according to an embodiment of the present invention.
Figure 17:
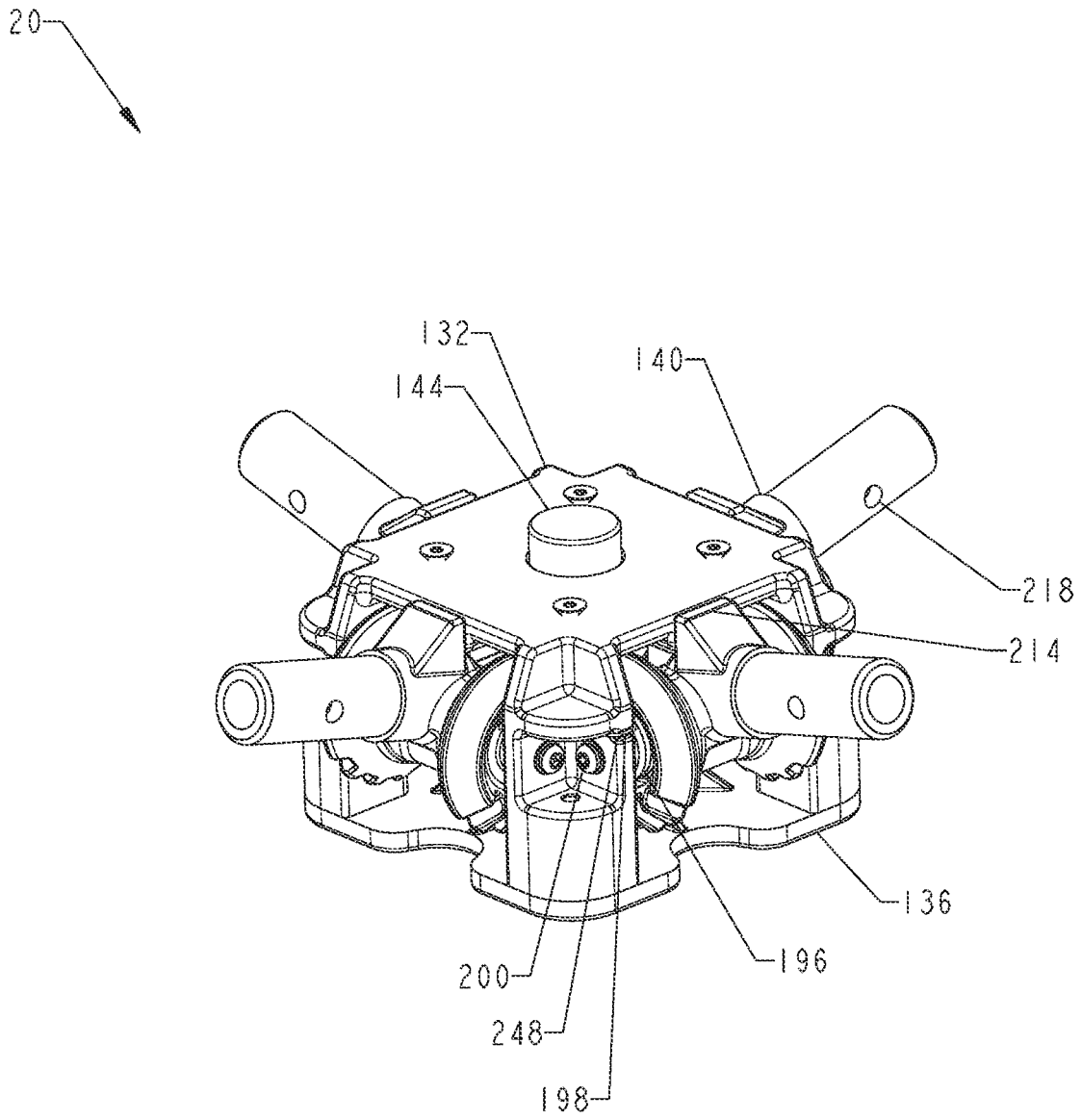
FIG. 17 is a perspective view of an upper portion of the central assembly according to an embodiment of the present invention, with upper geared ends attached thereto.
Figure 18:
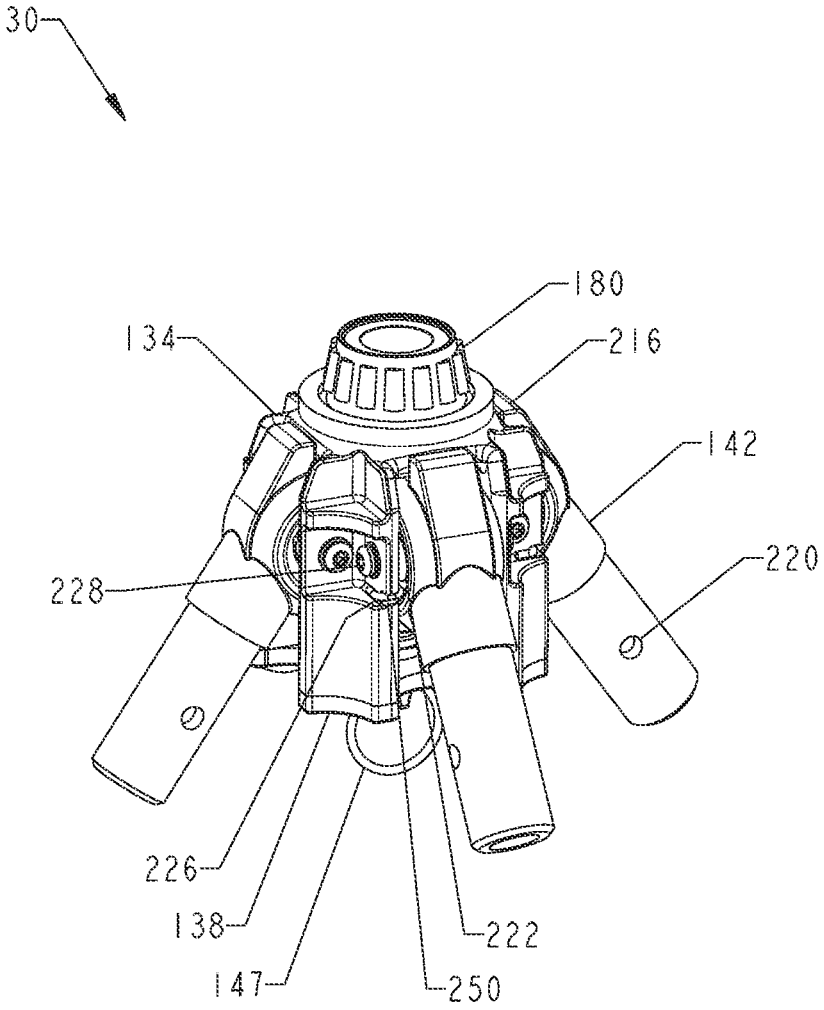
FIG. 18 is a perspective view of a lower portion of the central assembly according to an embodiment of the present invention, with lower geared ends attached thereto.
Figure 19:
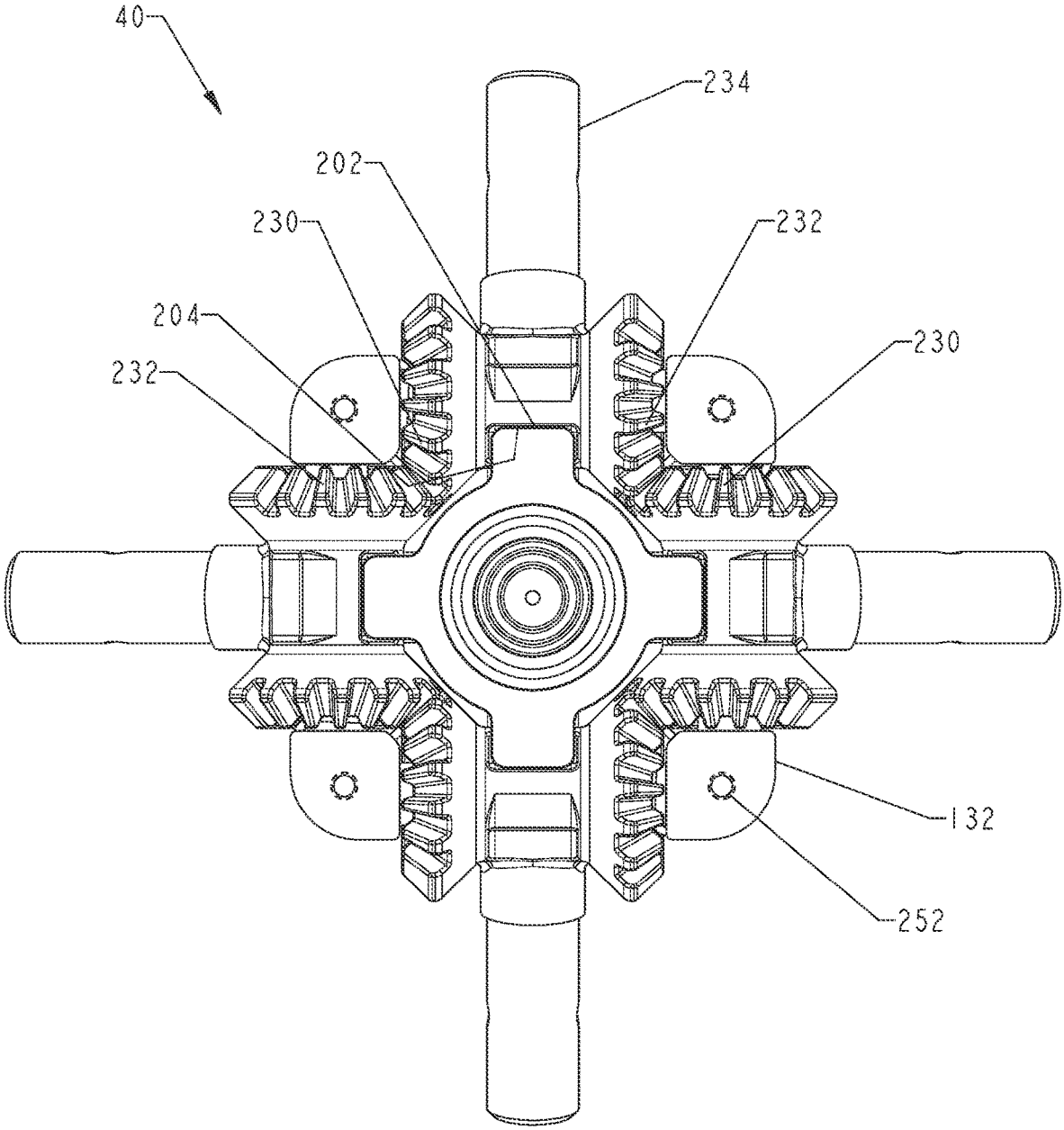
FIG. 19 is a bottom plan view of the upper portion of the central assembly illustrated in FIG. 17.
Figure 20:
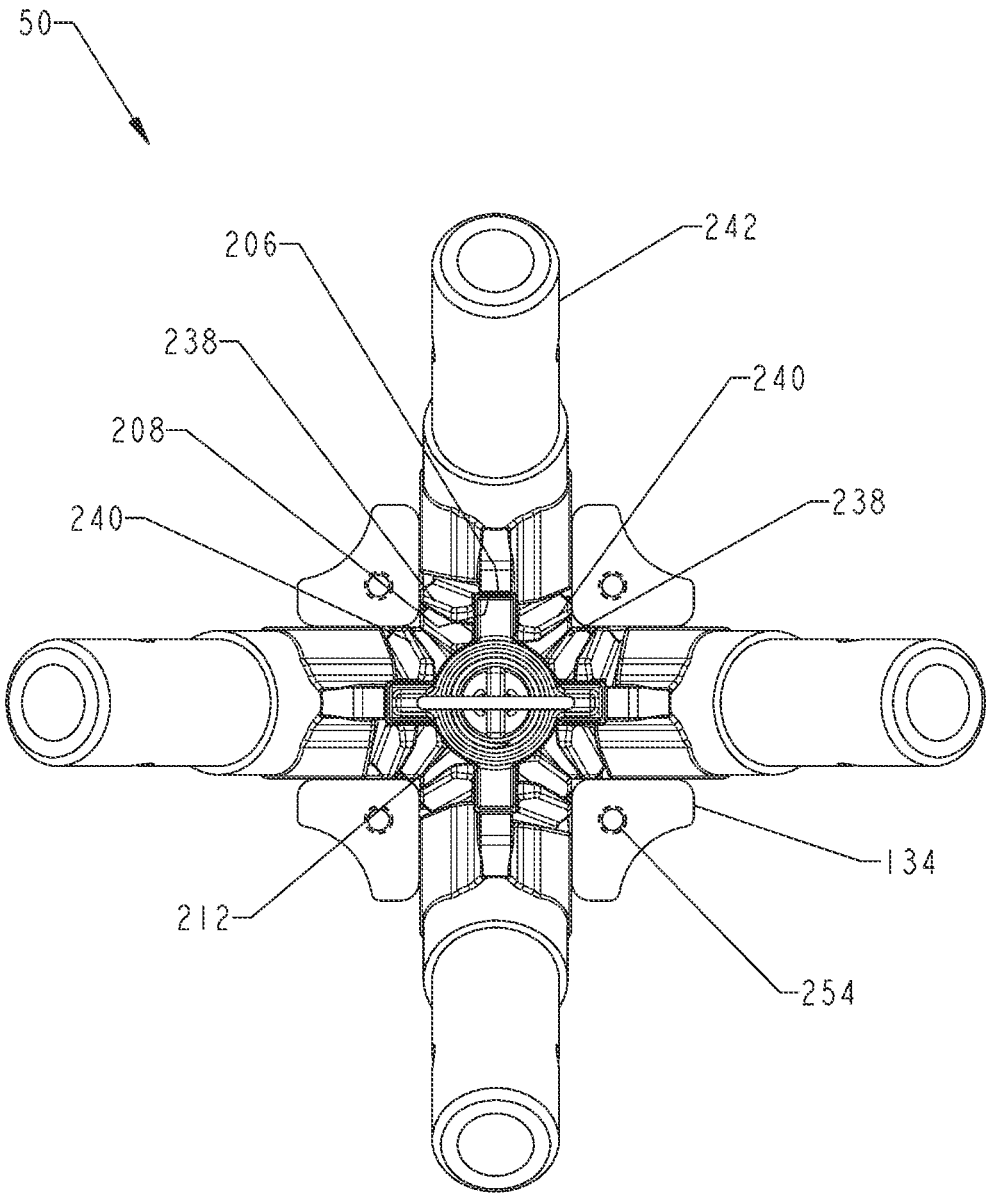
FIG. 20 is a bottom plan view of the lower portion of the central assembly illustrated in FIG. 18.
Figure 21:
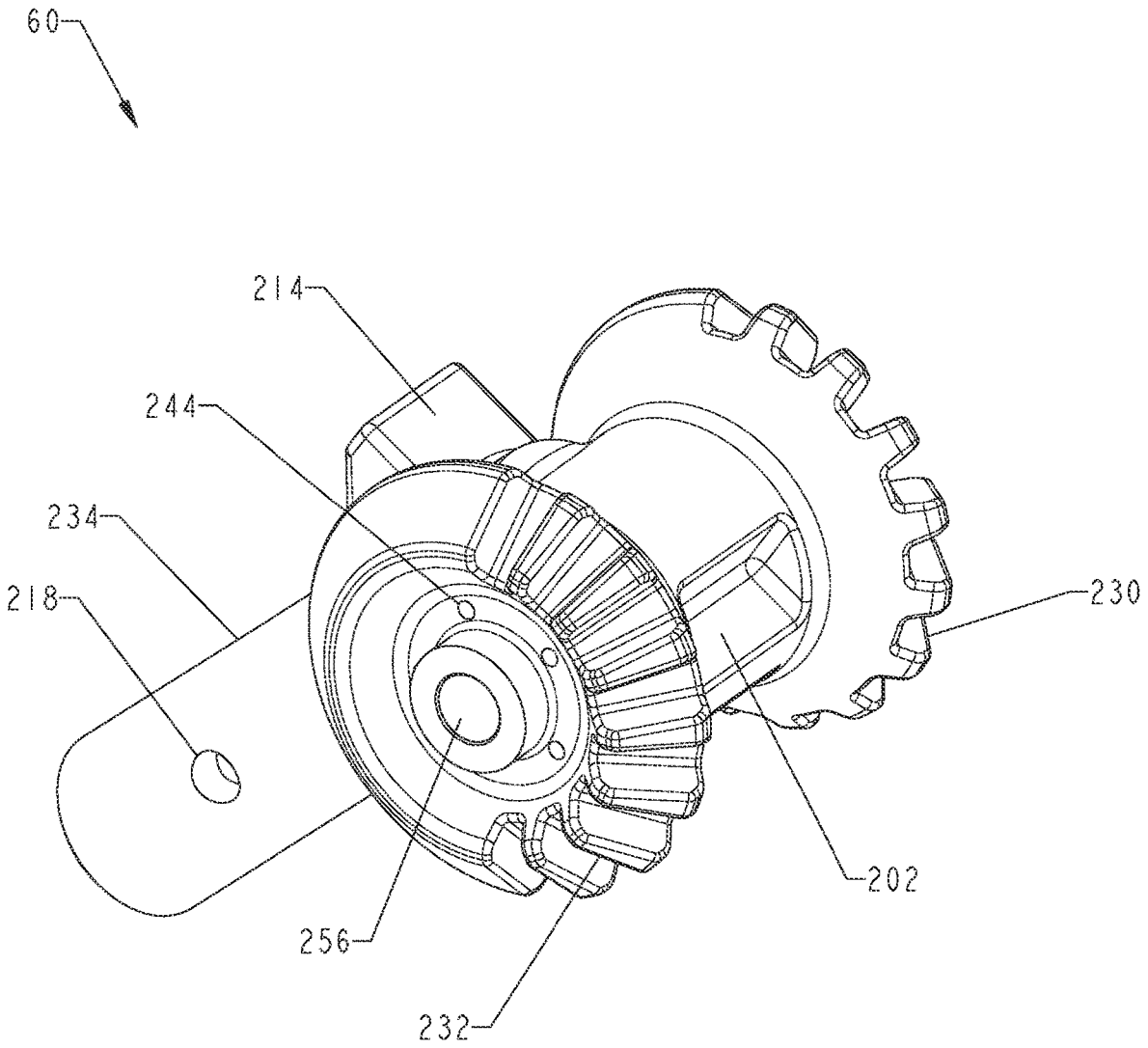
FIG. 21 is a perspective view of an upper geared end according to an embodiment of the present invention.
Figure 22:
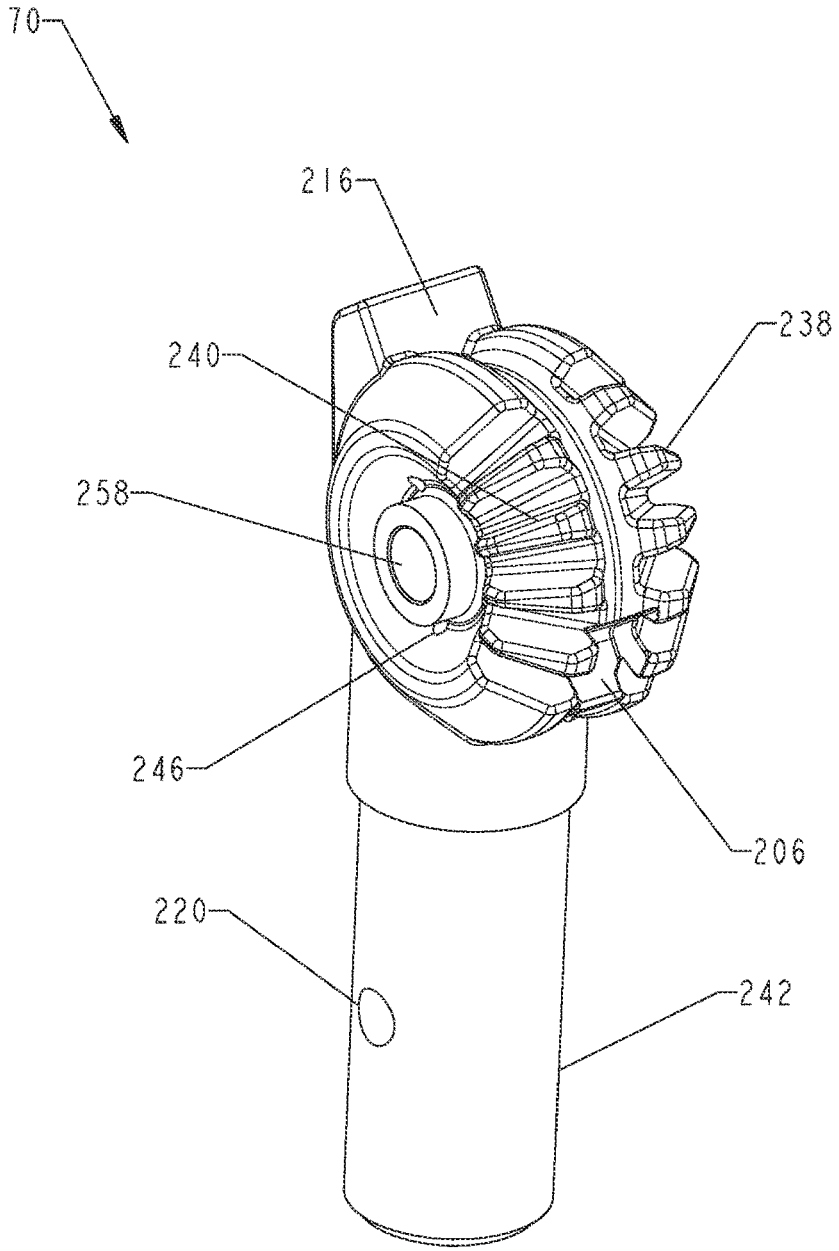
FIG. 22 is a perspective view of a lower geared end according to an embodiment of the present invention.

To move the upper assembly 20 to the folded position, the upper lock button 144 may be pressed in a downward direction 170 to disengage the upper geared end lock receptacle 202 (illustrated, for example, in FIG. 19) from the upper lock member protrusion 204 (illustrated, for example, in FIGS. 15 and 19). The upper geared ends 140 may then be allowed rotatably moved.

The lower geared end teeth 238, 240 may be concentric with the center of rotation of the lower geared end 142. The lower geared end teeth 238, 240 may be configured to be out of phase by a half tooth pitch with adjacent lower geared end teeth 238, 240 on adjacent lower geared ends 142 so that the lower geared end teeth 238, 240 on each lower geared end 142 may matingly engage each other so that all four lower geared ends 142 may be at the same angle of rotation. This out of phase configuration of the lower geared ends 142 may advantageously allow for rotational movement in all the lower geared ends 142 upon rotationally moving any one of the lower geared ends 142. The half tooth pitch out of phase gear configuration may enable the user to only have to move one leg member 116 that are each attached to a lower geared end 142 to move all leg members 116 between the deployed position and the folded position.

When an embodiment of the present invention is in the deployed position, the rotational movement of the lower geared ends 142 may be limited and/or prevented. In the outward rotation direction (i.e., opening the leg members 116 and/or lower geared ends 142 outwards from each other), the movement of the lower geared ends may be limited by including a hard stop 216 on one or more of the lower geared ends 142. The hard stop 216 may be configured to abut the lower portion of the central assembly 134 when the lower geared end 142 is rotationally moved to the fully deployed position or deployed position so that the lower geared end 142 may be prevented from rotationally moving any further in that direction.

Those skilled in the art will notice and appreciate that as a user sits down on the seat upholstery member 114, the vertical load from the weight of the person sitting on the seat upholstery member 114 may be transferred to the leg assemblies 100. Those skilled in the art will also notice and appreciate that it is likely that although the lower geared ends 142 will tend to rotate outward, the hard stops 216 on the lower geared ends 142 will press against the lower portion of the central assembly 134 and limit, reduce, and/or prevent the outward rotation of the geared ends 142.

The present invention may include a lower lock pull release 146 (also known throughout the specification and the claims as a lower lock member 146). The lower lock member 146 may be positioned on a lower surface of the lower portion of the central assembly 134. The lower lock member 146 may include a lock feature 208 (also referred to throughout the specification and the claims as a lower lock member protrusion 208) that may engage a mating lock feature 206 (also referred throughout the specification and the claims as a lower geared end lock receptacle 206). The lower geared end lock receptacle may be included on the lower geared ends 142 and may be adapted to stop, prevent, and/or reduce the movement of the lower geared ends in the inward direction towards the folding position. The lower lock member 146 may include a lower pull ring 148, which is also referred to throughout the specification and the claims as a ring member 148. The ring member 148 on the lower lock member 146 may advantageously provide a user a simplified and easy to use feature to operate the lower lock member 146. More specifically, the ring member 148 may be readily engaged by the user to unlock the lock member 146 in an efficient and simple to use fashion.

In some embodiments of the present invention, the lower assembly 30 may be folded by first moving the lower lock member 146 outwards from the central assembly 15 and in a downward direction. This allows for the lower lock member protrusion 208 to be disengaged from the lower geared end lock receptacles 206. When the lower lock member protrusion 208 is disengaged from the lower geared end lock receptacles 206, the lower geared ends 142 may be rotated in a downward direction 152 towards the folded position. The lower lock member 146 may include a pull release return spring 178 to ensure that the lower lock member protrusion 208 and the lower geared end lock receptacles 206 remain engaged with one other when the lower assembly 30 is in the deployed position.

The upper assembly 20 may be folded by moving the upper lock member 144 to a disengaged position to disengage the upper lock member protrusions 204 from the upper geared end lock receptacles 202. In some embodiments of the present invention the upper lock member 144 may include a lock button 328 that may be pressed in a downward direction 170 towards the central assembly 15 to move the upper lock member 144 to the disengaged position and to disengage the upper lock member protrusions 204 from the upper geared end lock receptacles 202. The upper geared ends 140 may then be rotatable in a downward direction 172 towards the folded position. The upper lock member 144 may include a lock button return spring 176, also known throughout the specification and the claims as an upper lock spring 176, that may be used to ensure that the upper lock member protrusions 204 and the upper geared end lock receptacles 202 remain engaged with one other when the upper assembly 20 is in the deployed position.

The central assembly 15 may include an upper bottom plate 136 and a lower bottom plate 138. The upper bottom plate 136 may be attached to a lower surface of the upper portion of the central assembly 132. The lower bottom plate 138 may be attached to a lower surface of the lower portion of the central assembly 134. Both of the upper bottom plate 136 and the lower bottom plate 138 may be attached with screws 192, 194 or other common fasteners as understood by those skilled in the art. The upper bottom plate 136 may include bottom plate attachment screw holes 252 adapted to matingly accept the screws 192, 194. The lower bottom plate 138 may include bottom plate attachment screw holes 254 adapted to matingly accept the screws 192, 194. The upper bottom plate 136 and the lower bottom plate 138 may enhance structural integrity to both the upper assembly 20 and the lower assembly 30.

A tapered bearing 180 and a bearing race 182 (as perhaps best illustrated in FIGS. 14 and 16) may be included between the upper portion of the central assembly 132 and the lower portion of the central assembly. The upper assembly 20 and lower assembly 30 may be joined together with the tapered bearing 180 matingly engaging with the bearing race 182 and may allow for the upper assembly 20 and lower assembly 30 to rotationally move with respect to each other. The upper assembly 20 and the lower assembly 30 may be fastened together with a shoulder bolt 184 (shown in FIGS. 12, 14 and 15), washer 188 (shown in FIGS. 12, 14, 15, and 16), and nut 186 (shown in FIGS. 12, 14, 15, and 16). Once the nut 186 has been sufficiently tightened on the threads of the shoulder bolt 184, the upper assembly 20 and the lower assembly 30 may then be adapted to rotate freely with respect to one another.

When the portable folding chair 10 is in the folded position, the upper assembly 20 and the lower assembly 30 may abut each other to prevent and/or reduce any rotational movement with respect to each other.

An embodiment of the present invention may include an upper cover 108 and a lower cover 106. The upper cover 108 may be positioned and/or attached covering the upper portion of the central assembly 132. The lower cover 106 may be positioned and/or attached covering the lower portion of the central assembly 134. The upper cover 108 and the lower cover 106 may protect the upper assembly 20 and the lower assembly 30 from contamination (e.g. sand, grass, and other debris), may protect a user's fingers from accidentally getting caught in the central assembly 15, and may also to provide for a more aesthetic appearance.

Tube ends 118 may be positioned, on ends of the seat members 102, 104, the lower seat members 122, the leg members 116, and the upper seat members 124, 126, 128. The tube ends 118 may reduce sinking on soft surfaces (e.g. sand, dirt, grass), and may prevent debris or insects from entering and getting lodged in the seat members 102, 104, the lower seat members 122, the leg members 116, and the upper seat members 124,126,128. The tube ends 118 may also reduce the possibility of a user getting injured (e.g. cuts and lacerations) from the otherwise exposed ends of the seat members 102, 104, the lower seat members 122, the leg members 116, and the upper seat members 124,126,128.

In some embodiments of the invention, the upper portion of the central assembly 132 may be configured to be prevented from swiveling with respect to the lower portion of the central assembly 134 when the leg members 116 and the seat members 102, 104 are in the folded position. The lower portion of the central assembly 134 may be configured to be fixed in place, and the upper portion of the central assembly 132 may be adapted to swivel with respect to the lower portion of the central assembly 134 when the leg members 116 and the seat members 102, 104 are in the deployed position.

The features of the above embodiments are incorporated to the below embodiments, even though the features of the above embodiments may not be included in the figures referenced below. It is understood that all of the features of the above embodiments may be included in the below embodiments and no further discussion or description of the above embodiments' features is required. Likewise, it is understood that all the features of the below embodiments may be included in the embodiments mentioned above and no further discussion or description of the below embodiments' features is required.

Now referring to FIGS. 23-29 and 33, an embodiment of the portable folding chair 10 may include a central assembly 15, an upper assembly 20, and/or a lower assembly 30. The central assembly 15 may include an upper portion of the central assembly 132, a medial portion 90 of the central assembly 15, and a lower portion of the central assembly 134. The upper assembly 20 may include the upper portion of the central assembly 132, upper geared ends 140, seat members 102, 104, seat connection members 130, upholstery members 80, upper seat members 124,126,128, and tube ends 118. The lower assembly 30 may include the medial portion 90 of the central assembly 15, the lower portion of the central assembly 134, and a leg assembly 100 that may include leg members 116, lower geared ends 142, and tube ends 118.

Figure 25:
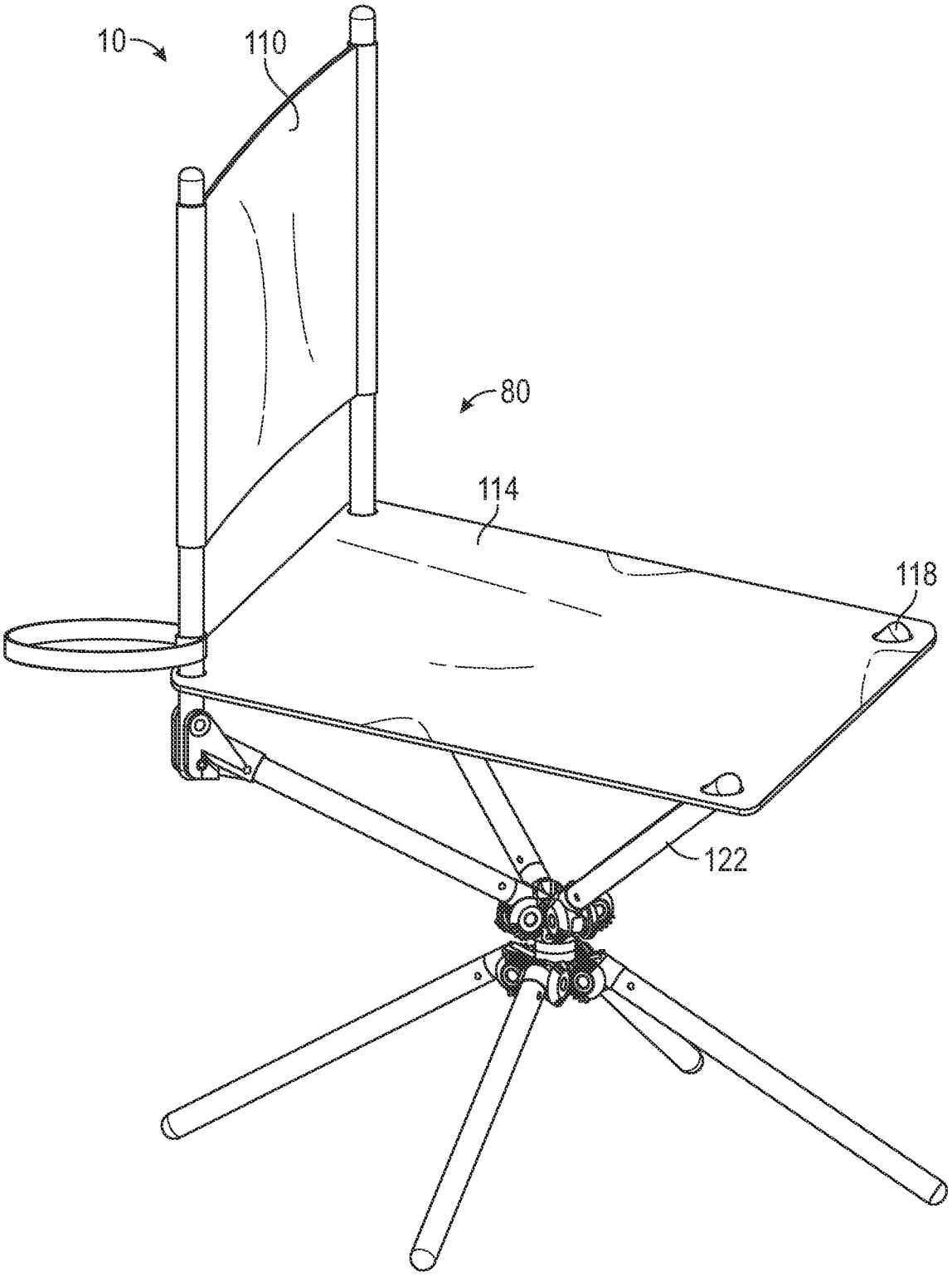
FIG. 25 is a perspective view of a portable folding chair according to an embodiment of the present invention, with upholstery members connected thereto.
Figure 26:
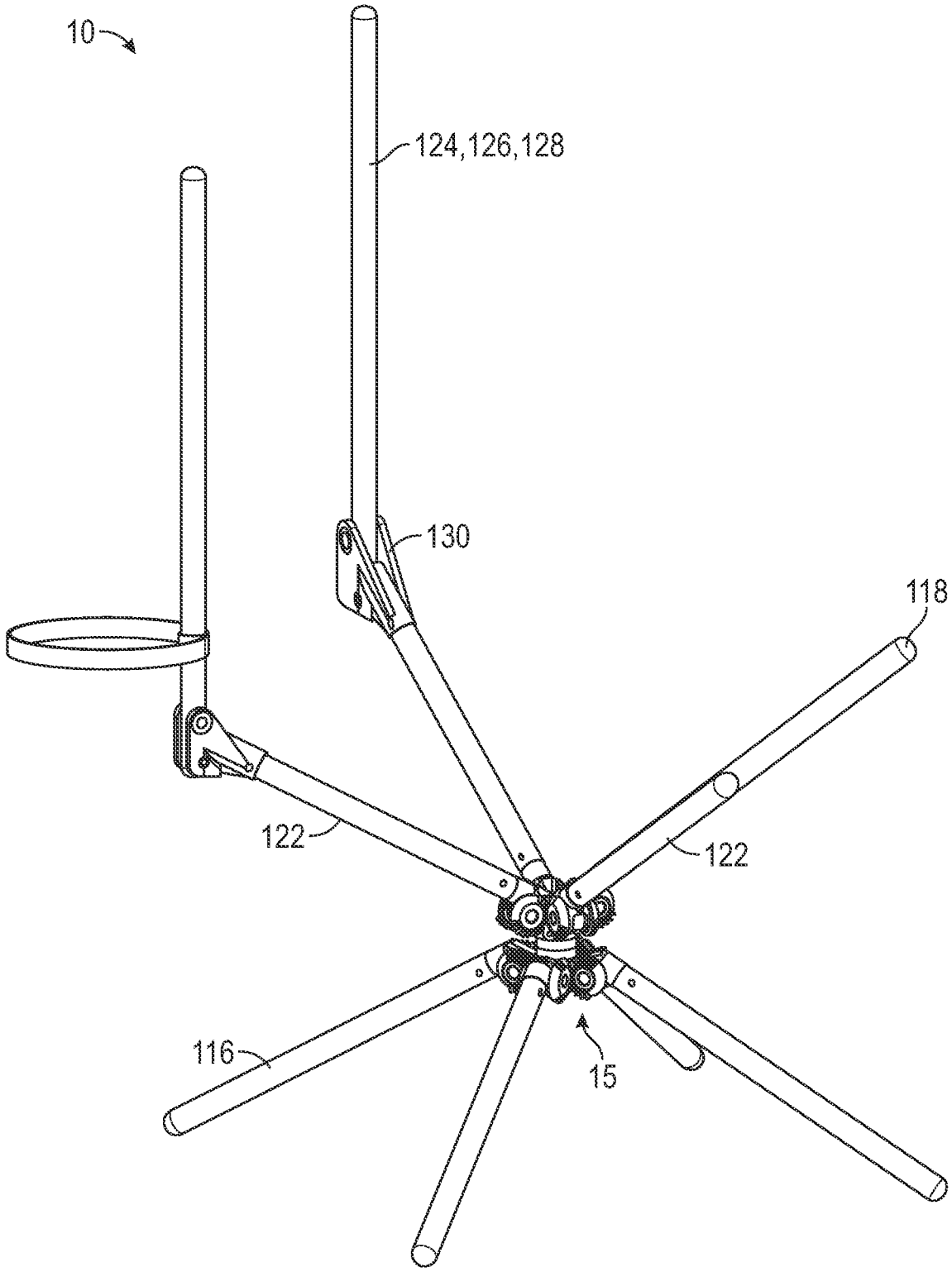
FIG. 26 is a perspective view of the portable folding chair illustrated in FIG. 25, with the upholstery members removed.
Figure 27:
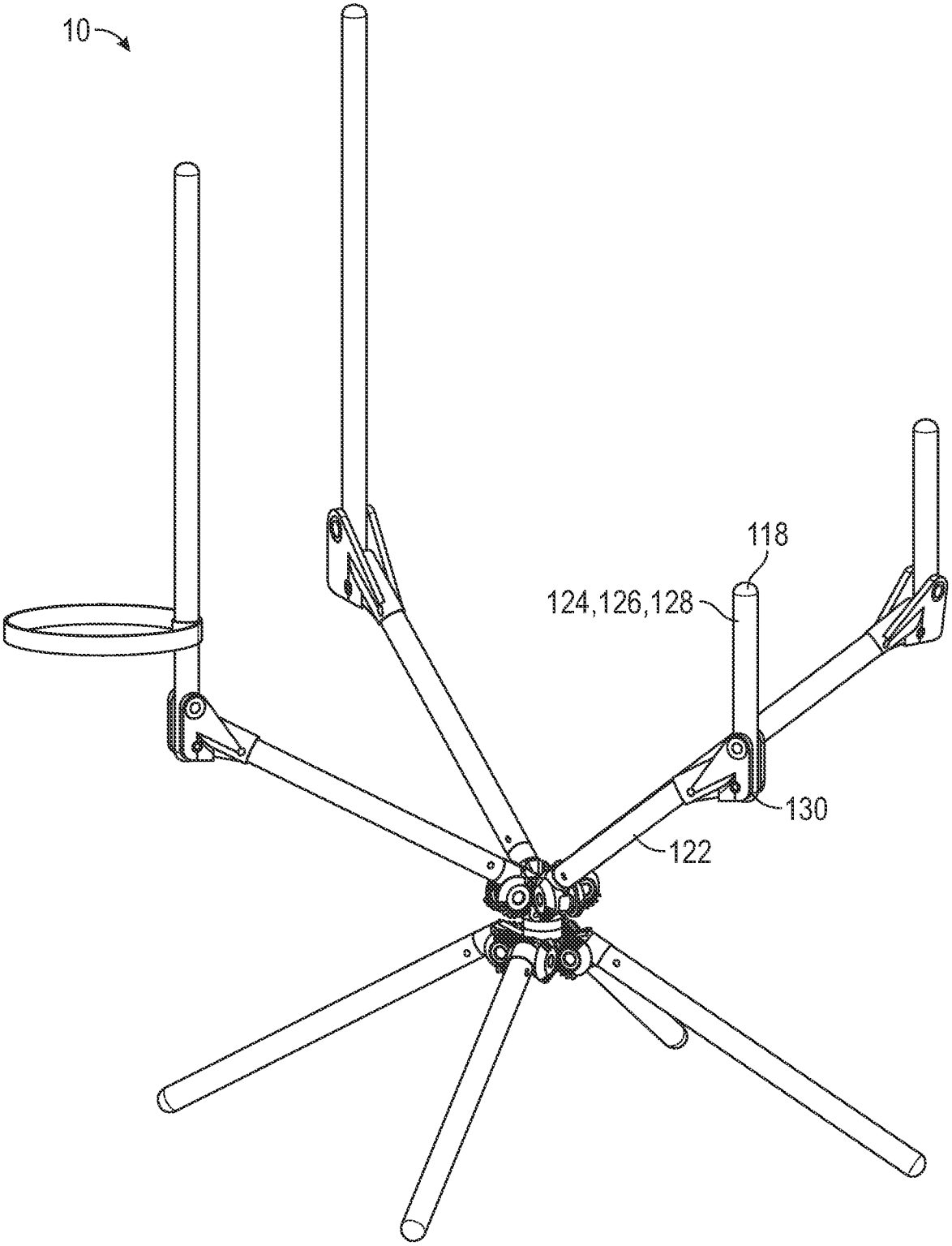
FIG. 27 is a perspective view of the portable folding chair illustrated in FIG. 23, with the upholstery members removed.
Figure 28:
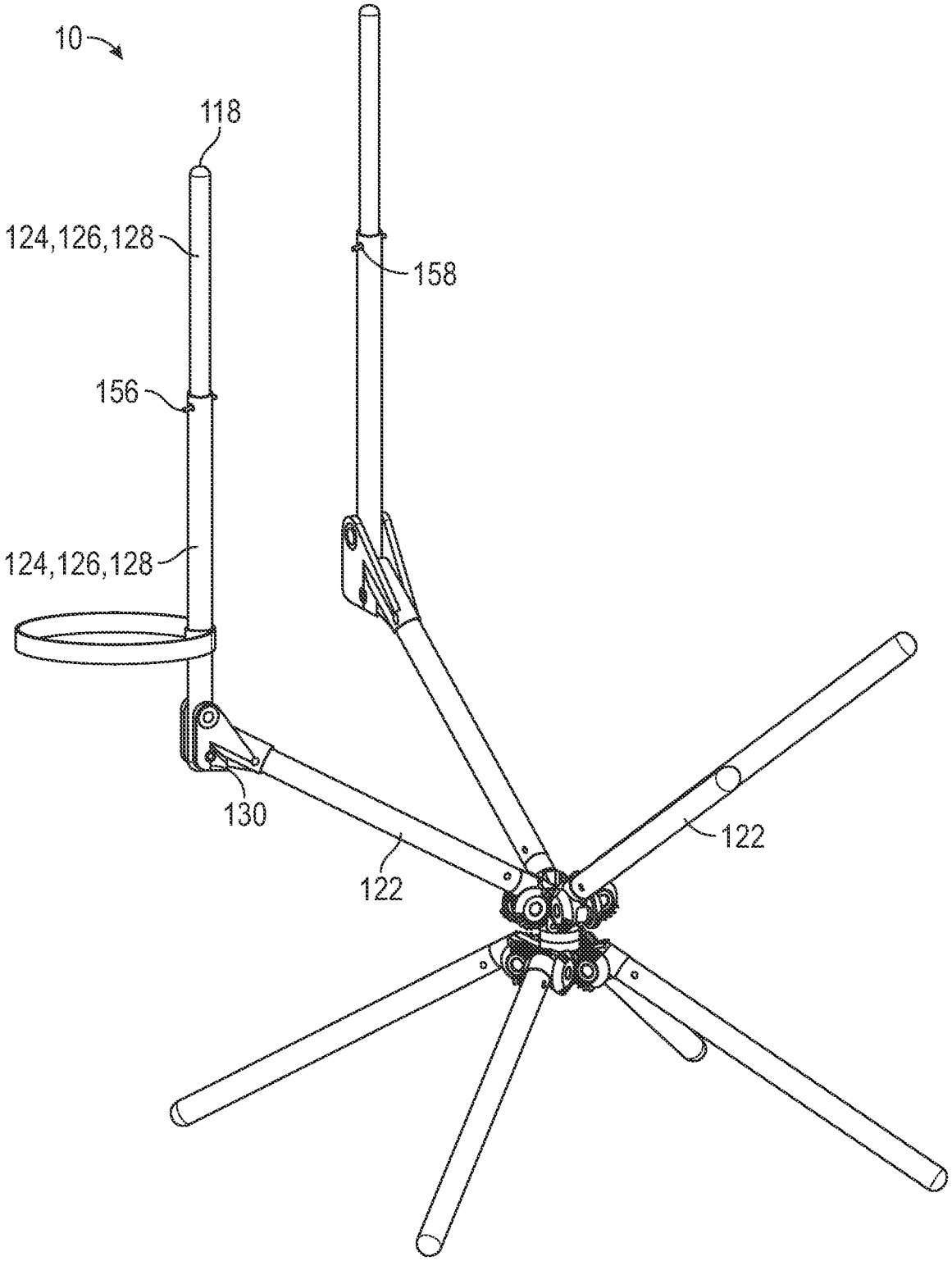
FIG. 28 is a perspective view of a portable folding chair according to an embodiment of the present invention, with two pairs of telescopically upper seat members.
Figure 32:
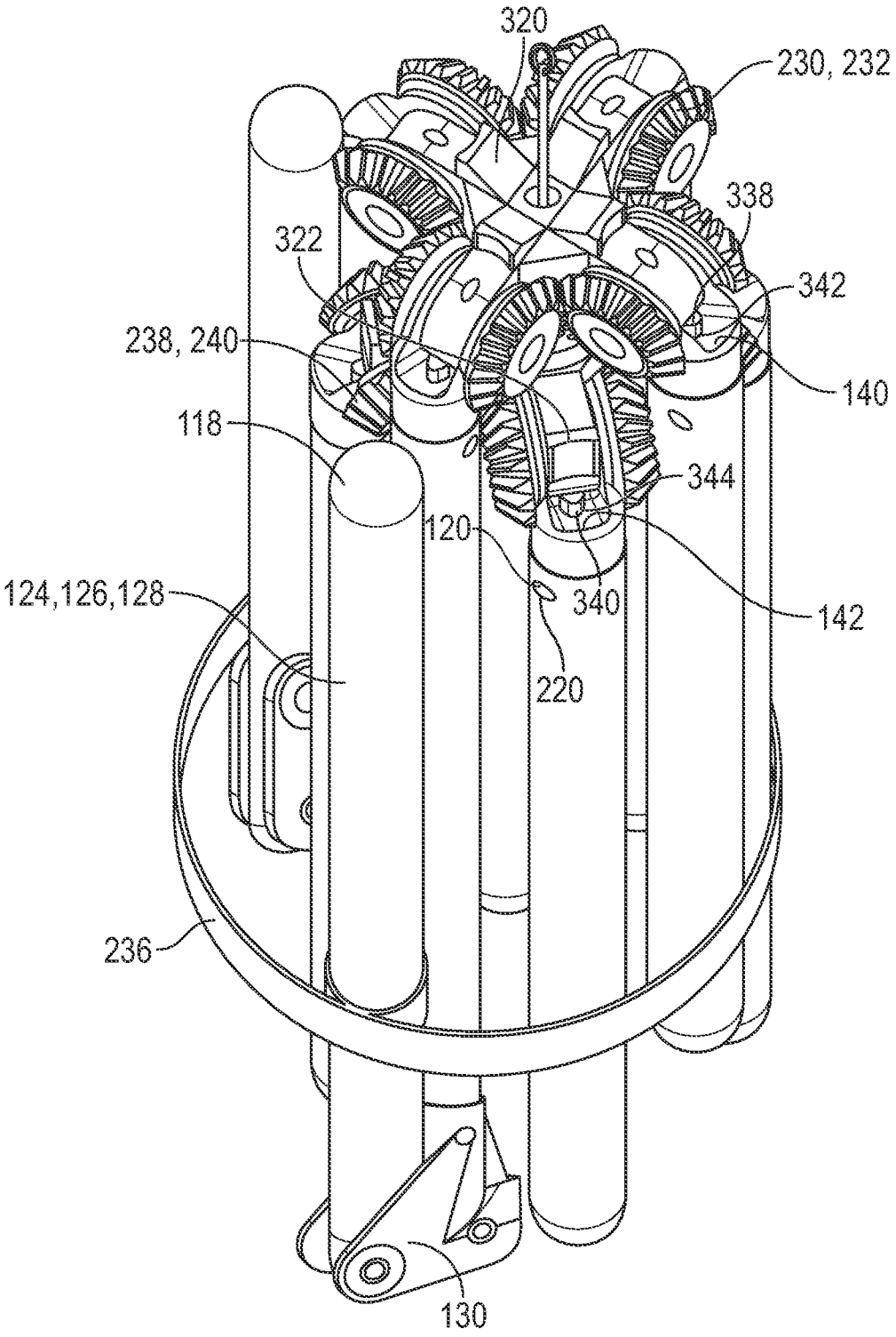
FIG. 32 is another perspective view of the portable folding chair illustrated in FIG. 31, with the upholstery members removed.
Figure 33:
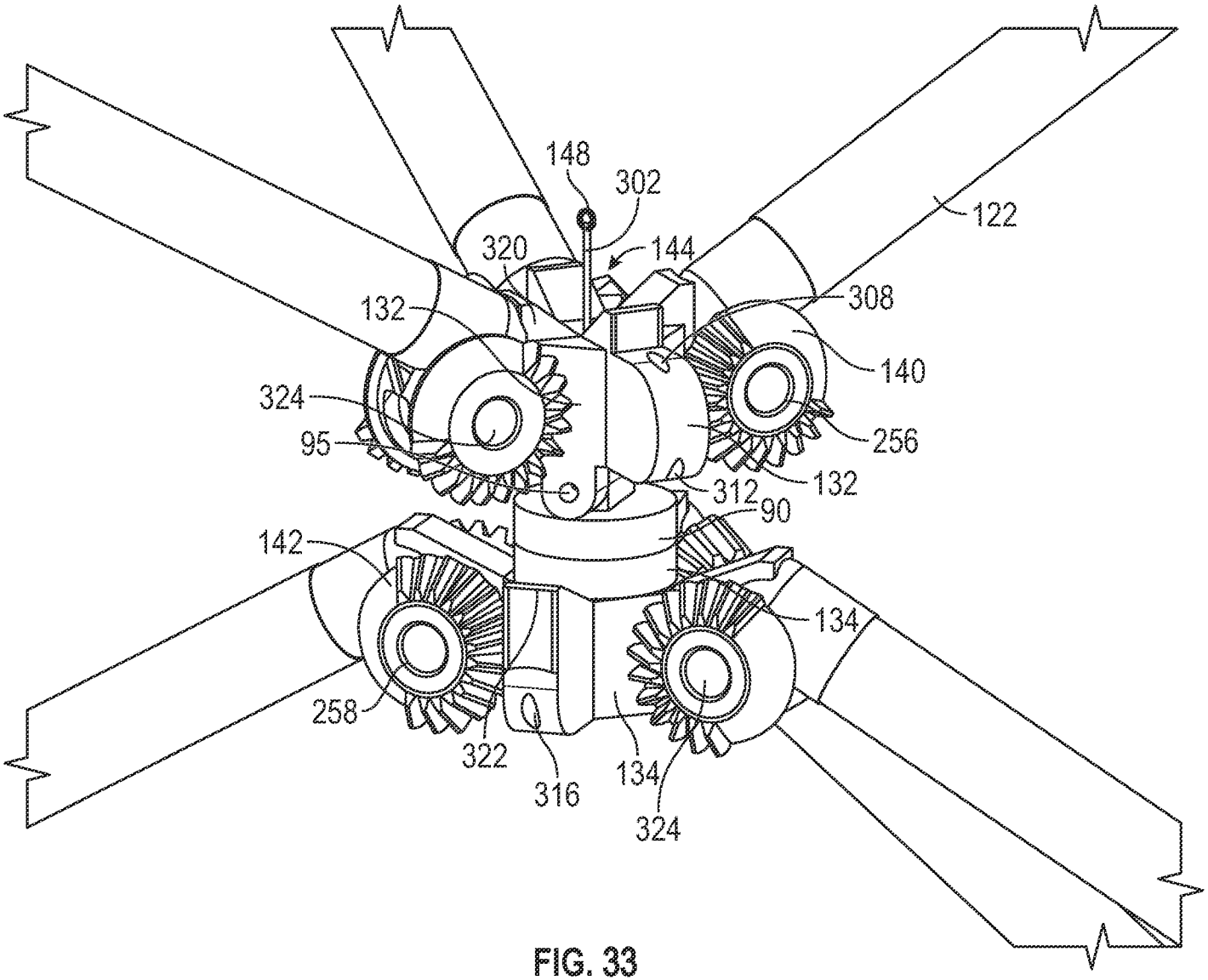
FIG. 33 is a partial perspective view of a portable folding chair according to an embodiment of the present invention.

An embodiment of the portable folding chair 10 according to the present invention may be adapted to be moved between a folded position and a deployed position, including a fully folded position and a fully deployed position, as best illustrated in FIGS. 25 and 32. The deployed position may be defined as when the upper assembly 20 and/or the lower assembly 30 are rotationally moved outward so that the upper assembly 20 and/or the lower assembly 30 is extended outward. The folded position may be defined as when the upper assembly 20 and/or the lower assembly 30 is rotationally moved inwards so that the upper assembly 20 and/or the lower assembly 30 is un-extended. The fully folded position may be defined as when the upper assembly 20 and/or the lower assembly 30 is rotationally moved inwards as far as an embodiment of the present invention functionally allows. The fully extended position may be defined as when the upper assembly and/or the lower assembly 30 is rotationally moved outwards so that they are extended as far as an embodiment of the present invention functionally allows.

One or more leg members 116 may be removably and/or rotatably attached at one end to the lower portion of the central assembly 134. One or more leg members 116 may also be attached at one end a respective number of lower geared ends 142 that may be removably and/or rotatably attached to the lower portion of the central assembly 134. The leg members 116 may include tube ends 118 that are attached to and/or matingly engaged with a respective number of the leg members 116 at an end opposite of the lower portion of the central assembly 134 and/or the lower geared ends 142.

The lower portion of the central assembly 134 may be fixedly and/or rotationally attached to a lower surface of the medial portion 90. The medial portion 90 may be adapted to swivel with respect to the lower portion of the central assembly 134. The medial portion 90 may be pivotally and/or ratably attached to the upper portion of the central assembly 132 at an opposite side on the medial portion 90 with respect to the lower portion of the central assembly 134. The medial portion 90 and the upper portion of the central assembly 132 may each include protrusions that matingly, pivotally, and/or rotationally engage each other. The protrusions on the medial portion 90 and the upper portion of the central assembly 132 may include a medial connection channel 95 that may be positioned extending through each of the protrusions on the medial portion 90 and the upper portion of the central assembly 132. As illustrated, for example, in FIG. 36, the medial connection channel may be adapted to matingly accept a medial through pin 96 that may be used to matingly, pivotally, and/or rotationally attached the medial portion 90 and the upper portion of the central assembly 132 together. The upper portion of the central assembly 132 and/or the medial portion 90 may be adapted to swivel and/or rotate with respect to the lower portion of the central assembly 134.

Figure 34:
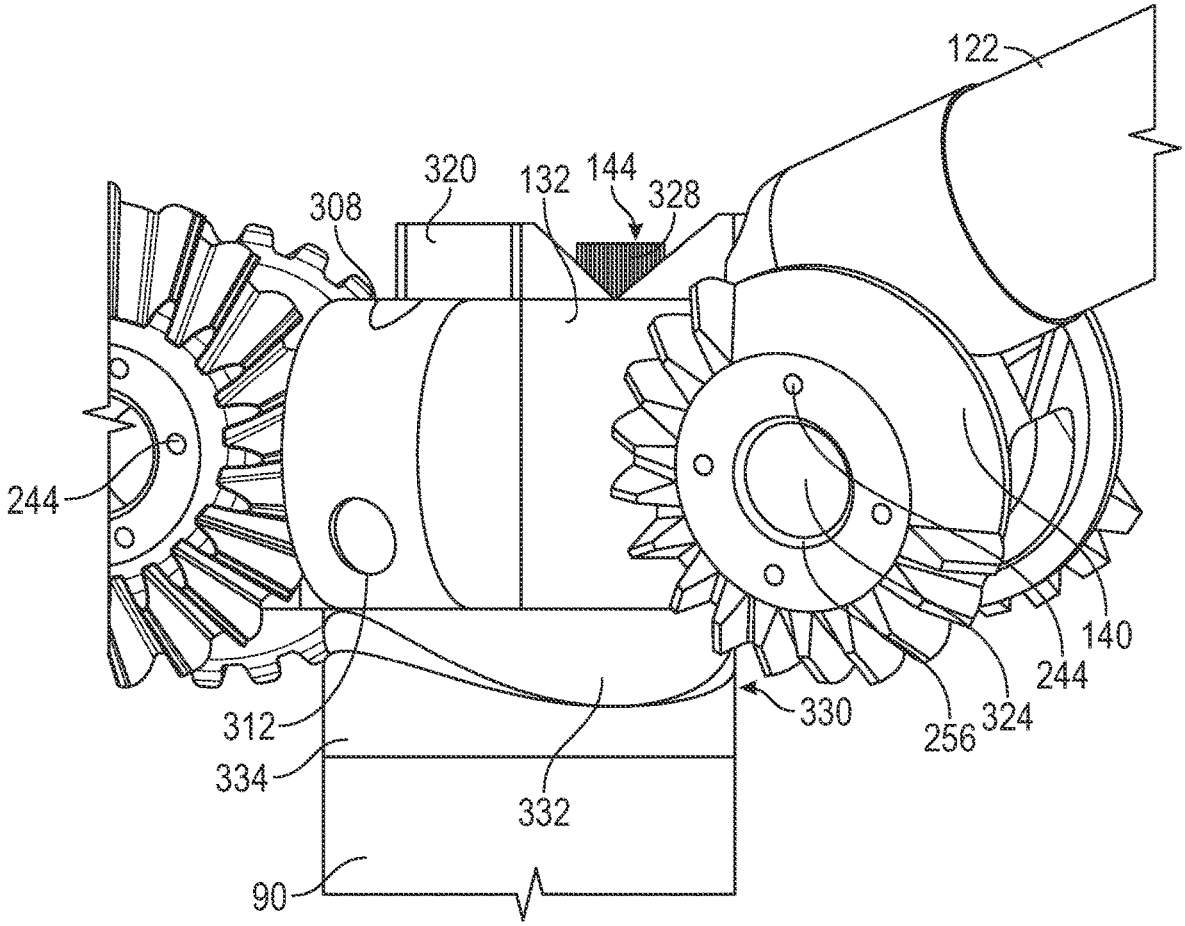
FIG. 34 is another partial perspective view of a portable folding chair according to an embodiment of the present invention, with an upper cradle member and lower cradle member connected thereto.
Figure 35:
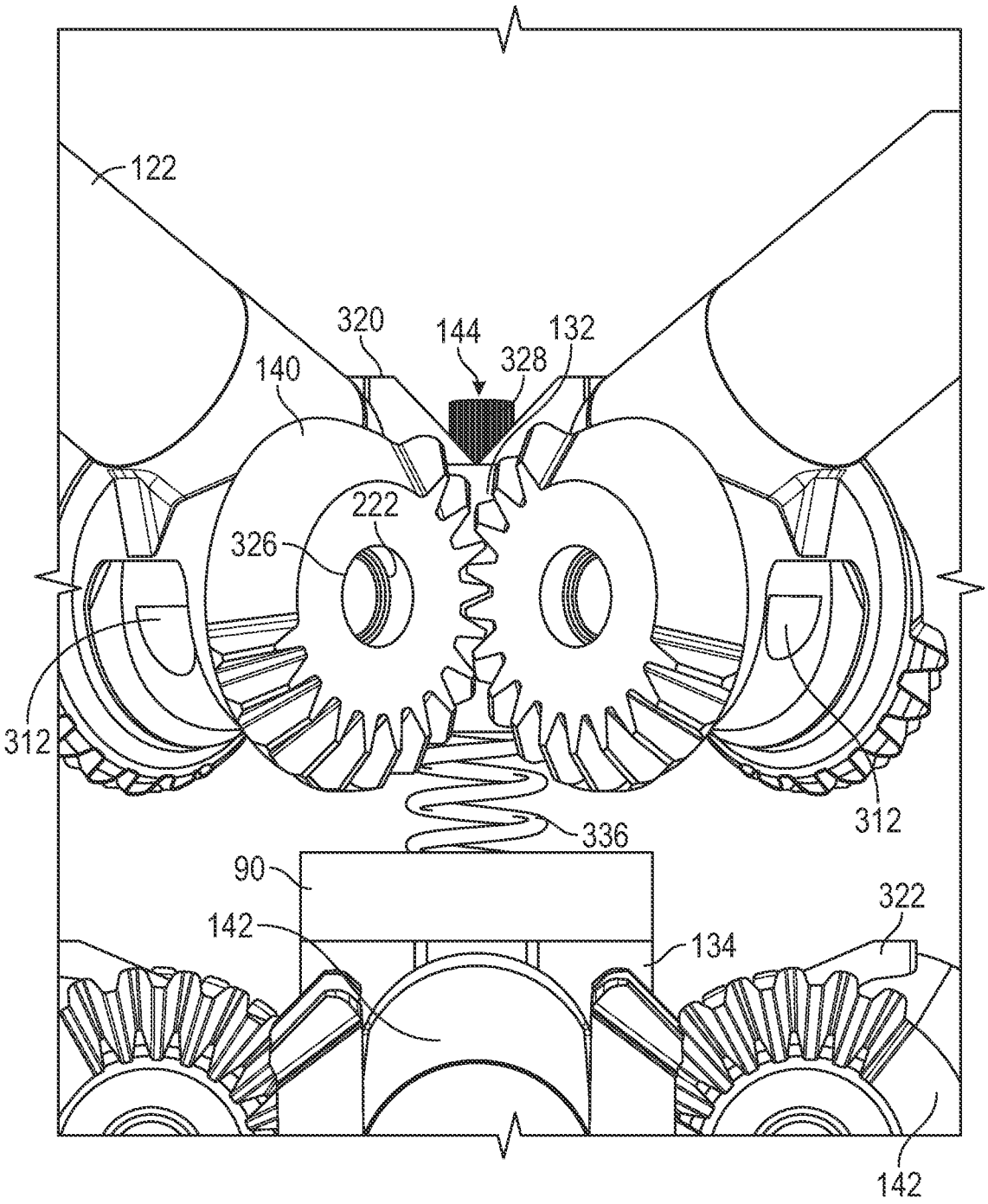
FIG. 35 is another partial perspective view of a portable folding chair according to an embodiment of the present invention, with a tension support member connected thereto.
Figure 36:
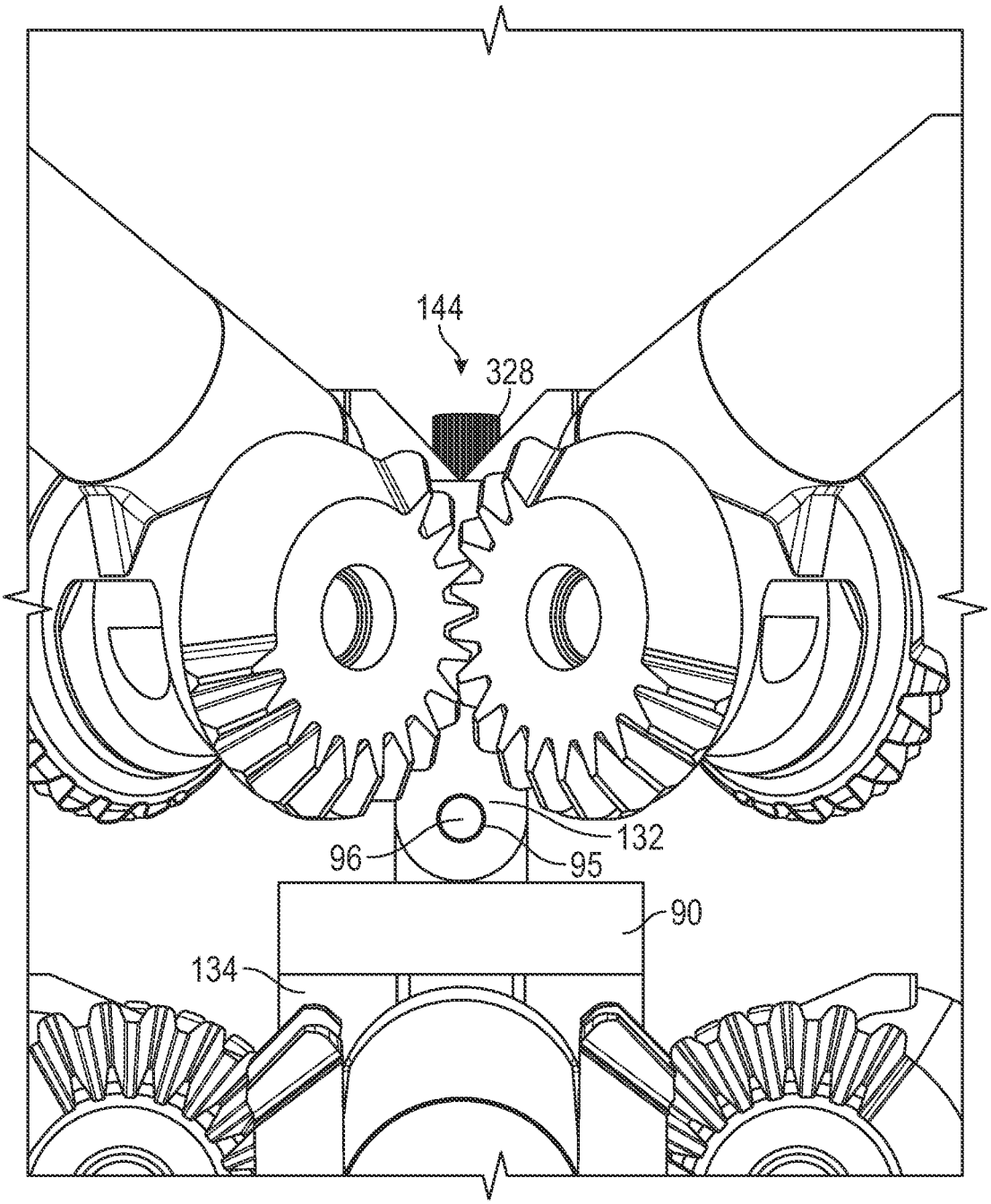
FIG. 36 is another partial perspective view of a portable folding chair according to an embodiment of the present invention.
Figure 37:
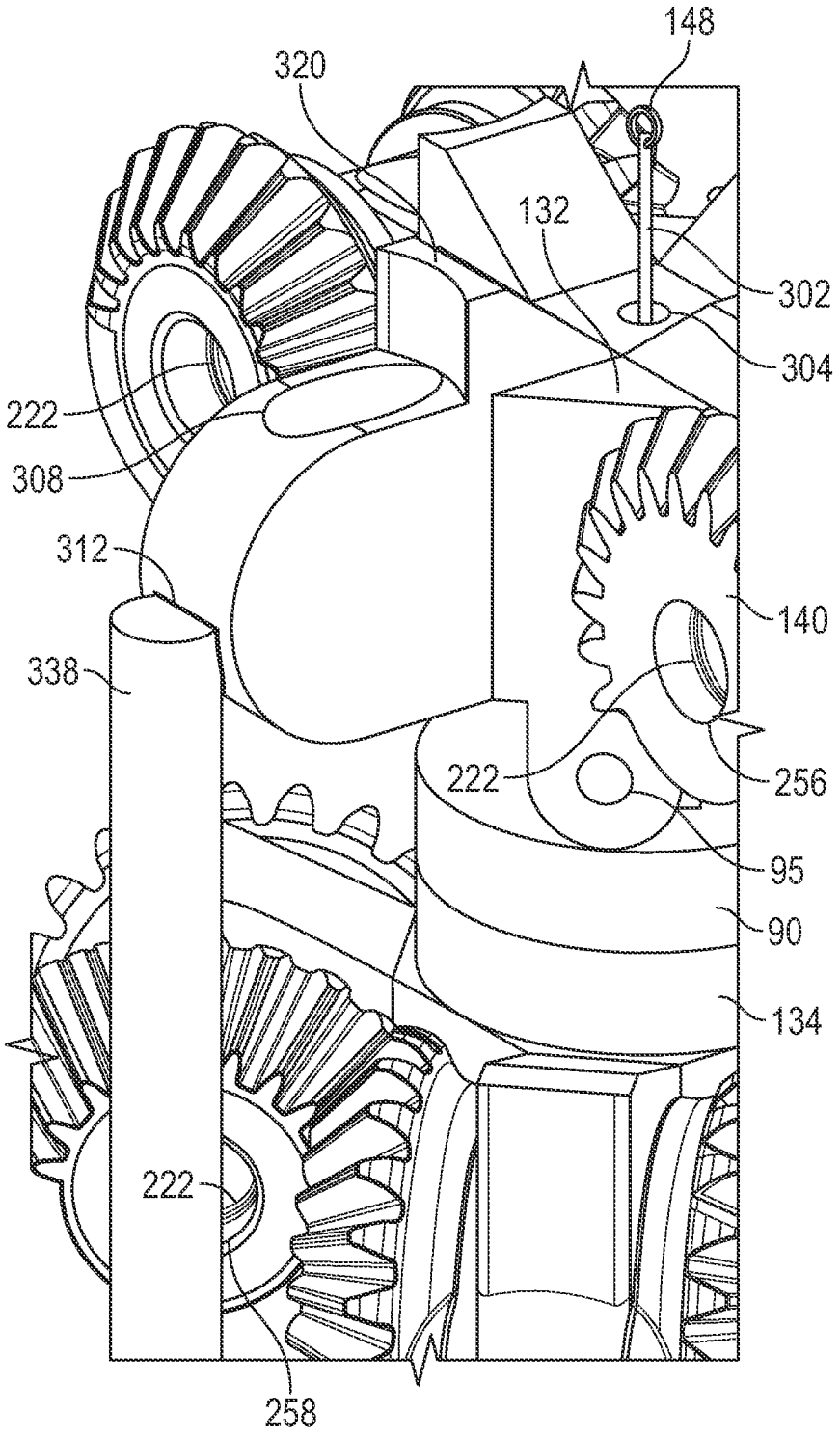
FIG. 37 is a partial perspective view of a portable folding chair according to an embodiment of the present invention, with a seat member lock rod matingly engaging a seat member fold channel on the upper portion of the central assembly.
Figure 38:
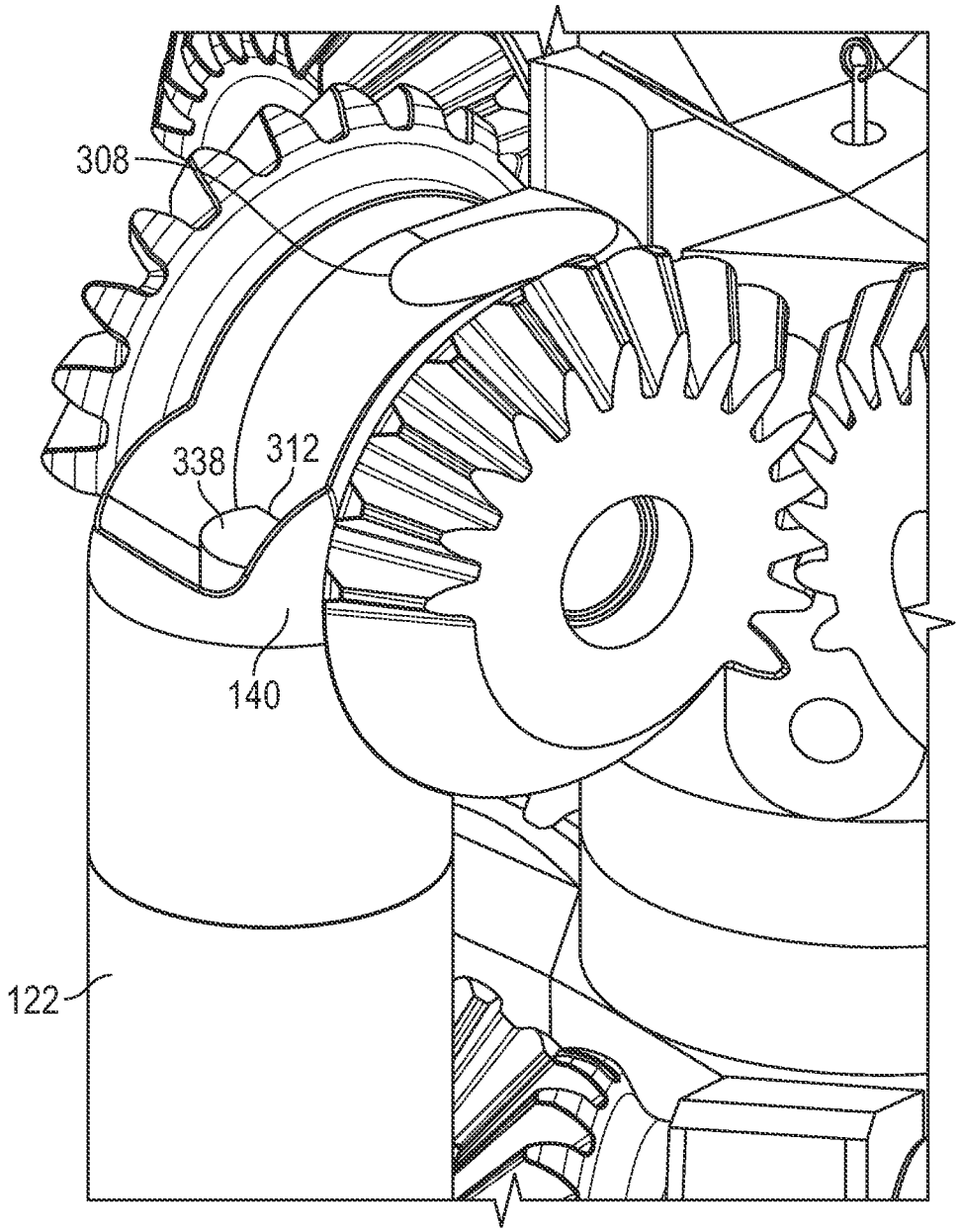
FIG. 38 is a partial perspective view of the portable folding chair illustrated in FIG. 37, showing the seat member lock rod being carried by the upper geared end and lower seat member.
Figure 39:
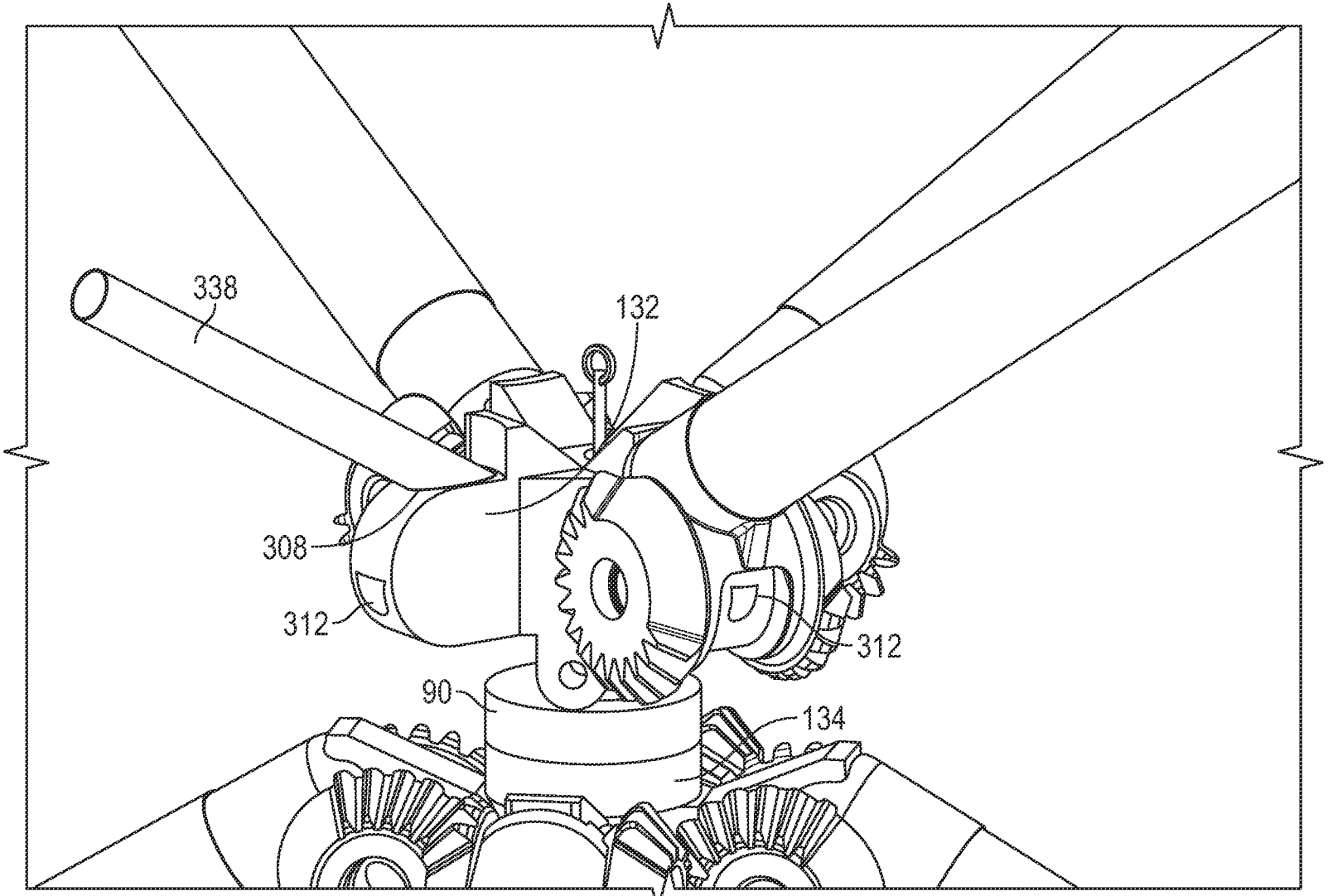
FIG. 39 is another partial perspective view of the portable folding chair illustrated in FIG. 37, showing the seat member lock rod being matingly engaged with a seat member deployment channel on the upper portion of the central assembly.
Figure 40:
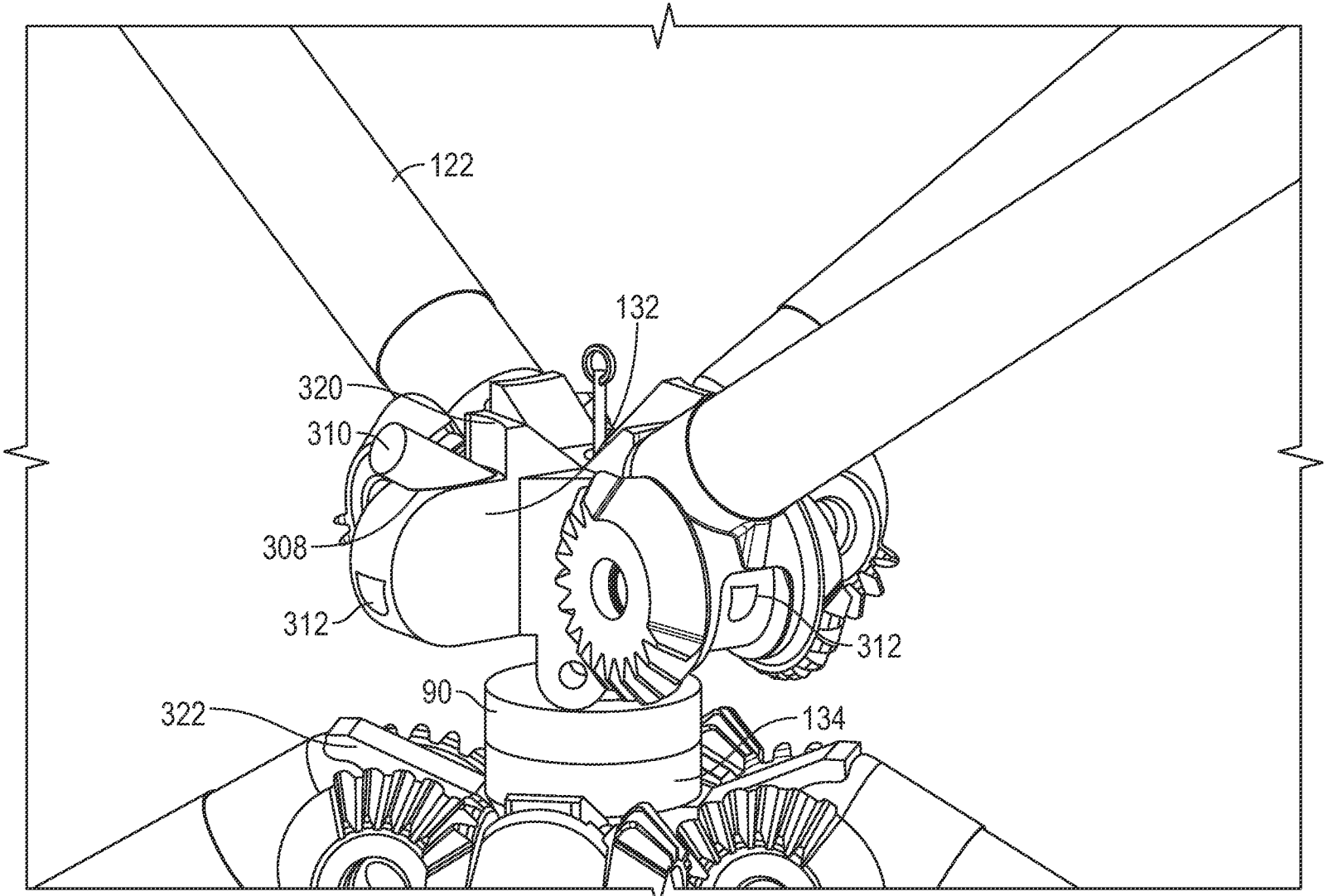
FIG. 40 is a partial perspective view of the portable folding chair illustrated in FIG. 39, with the seat member lock rod removed and showing a seat member deployment piston in a seat rod deployment removal position.
Figure 41:
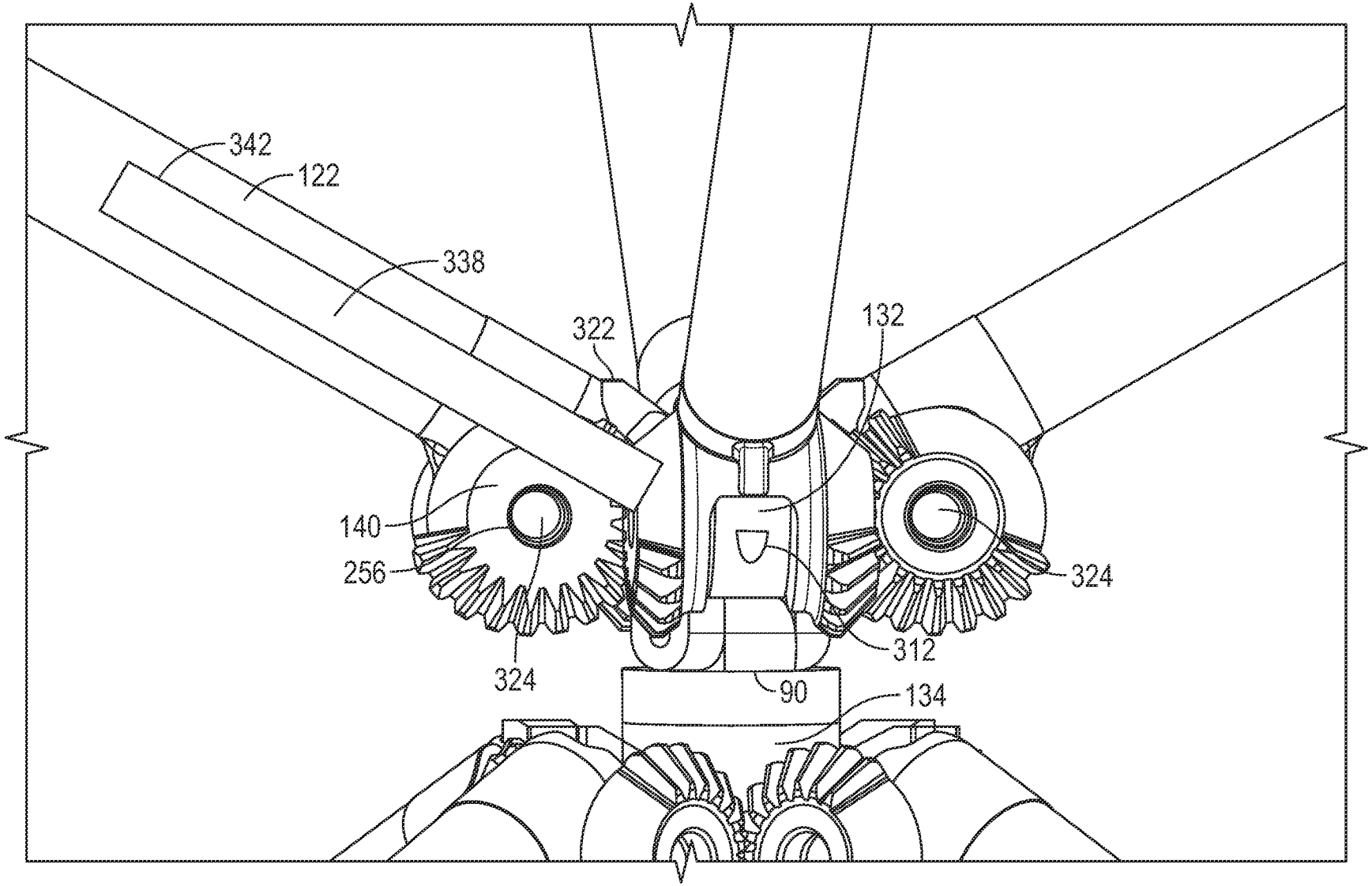
FIG. 41 is a partial perspective view of the portable folding chair illustrated in FIG. 39, with the seat member lock rod being carried by an upper geared end and lower seat member.
Figure 42:
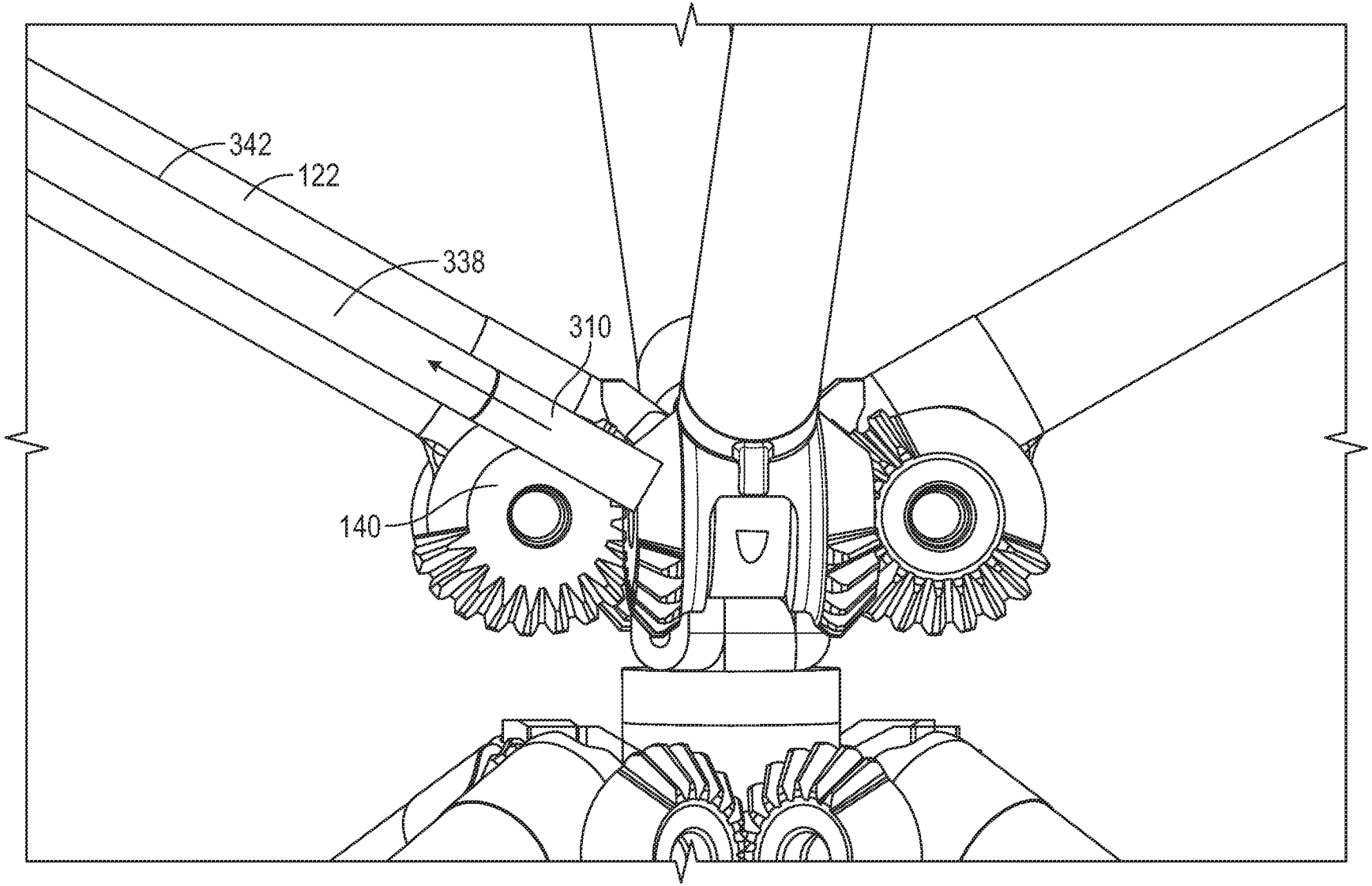
FIG. 42 is a partial perspective view of the portable folding chair illustrated in FIG. 41, showing the seat member lock rod being disengaged with the seat member deployment channel by the seat member deployment piston being moved to the seat rod deployment removal position.
Figure 43:
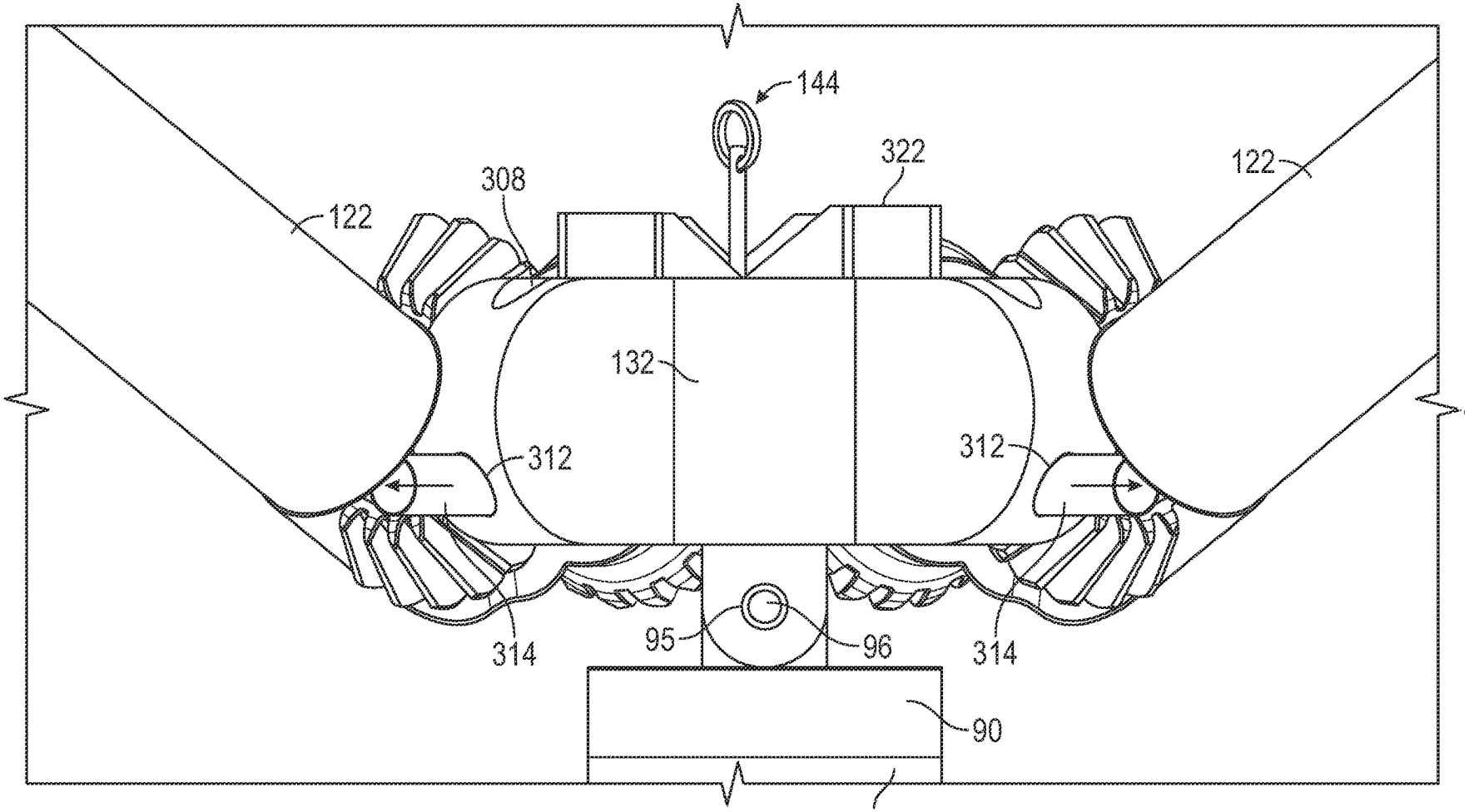
FIG. 43 is a partial perspective view of a portable folding chair according to an embodiment of the present invention, showing the seat member fold pistons in a seat rod fold removal position.
Figure 44:
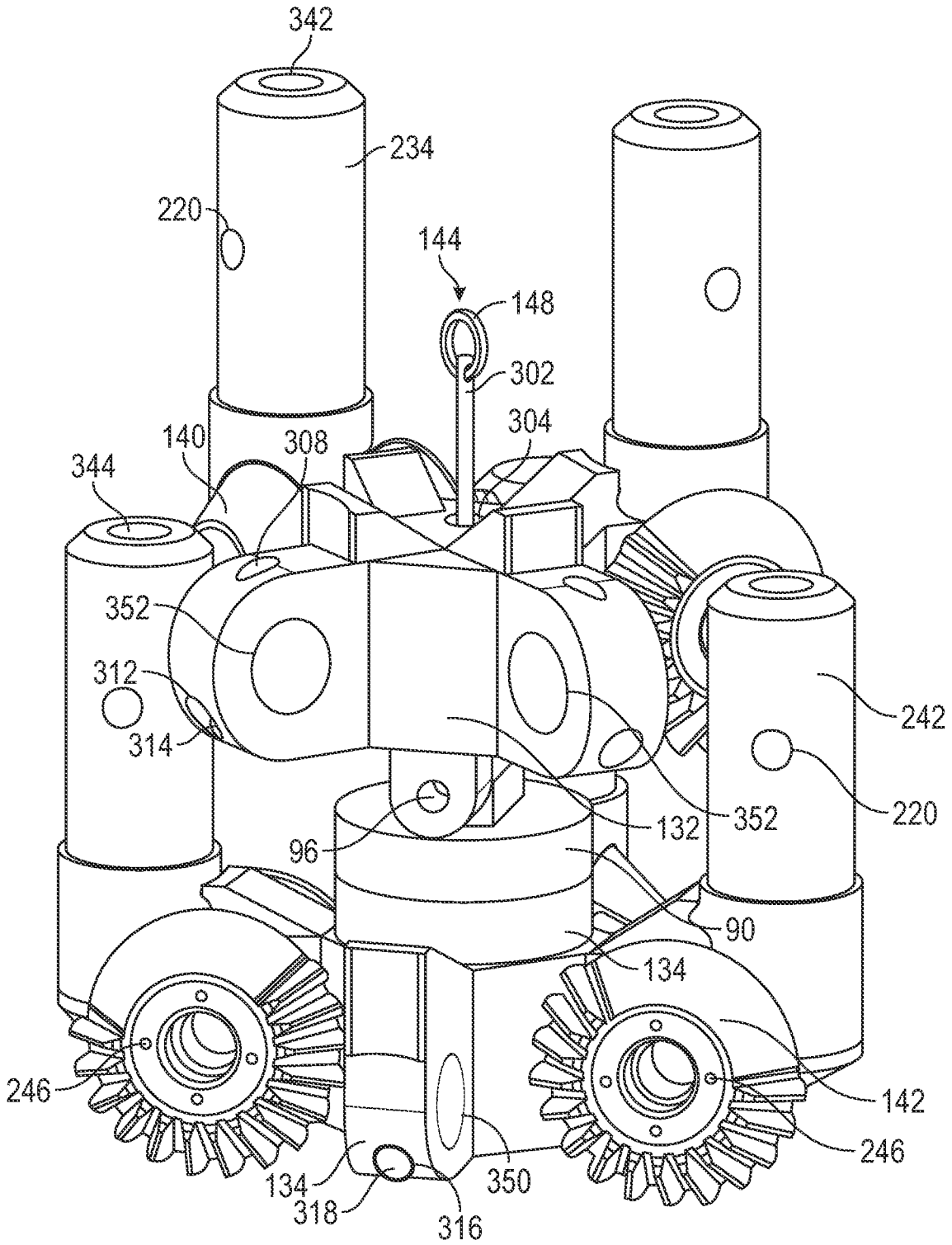
FIG. 44 is a perspective view of a central assembly according to an embodiment of the present invention, with lower geared ends and upper geared ends connected thereto.
Figure 45:
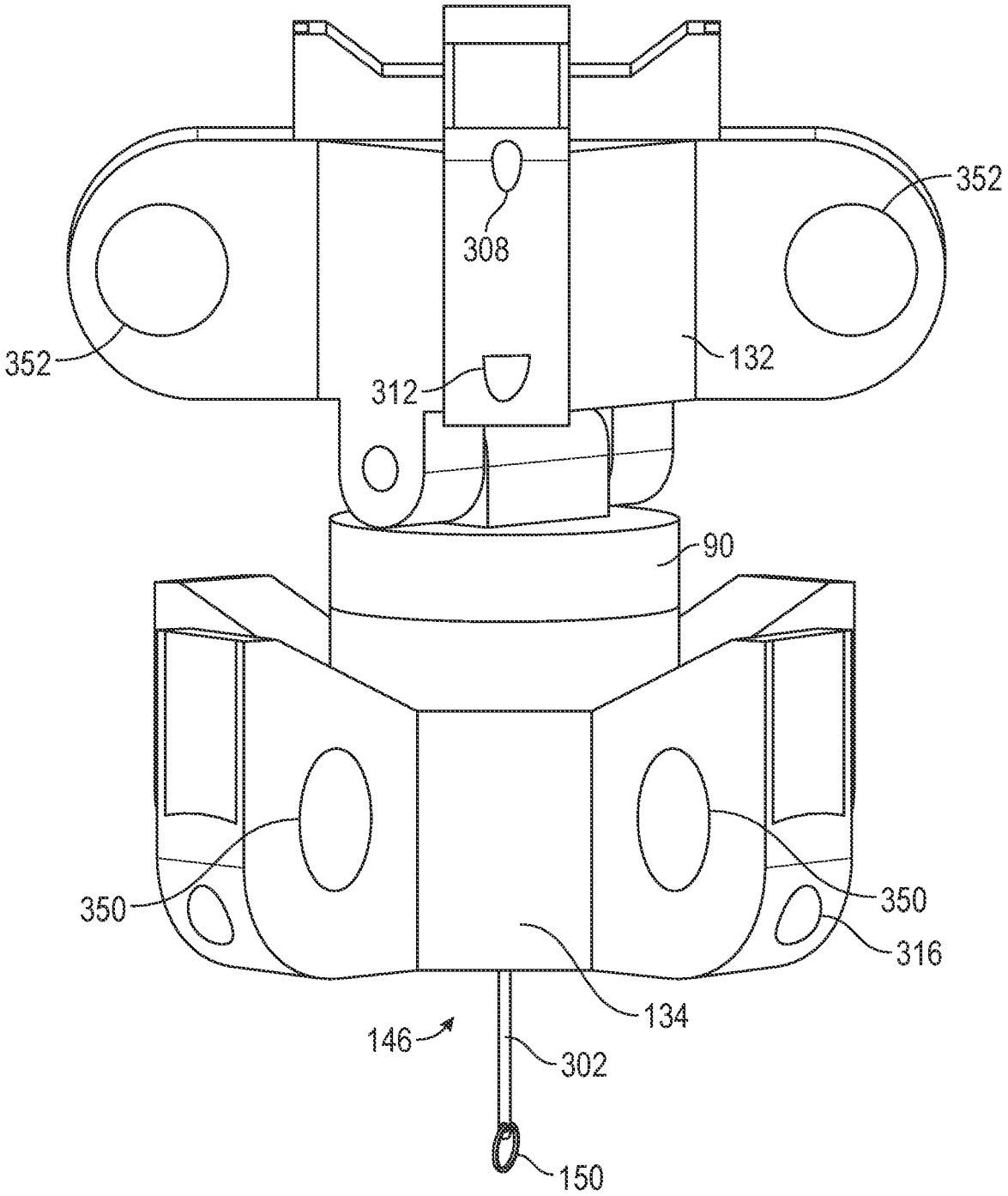
FIG. 45 is a perspective view of the central assembly illustrated in FIG. 44, with the lower geared ends and upper geared ends removed.

Now referring to FIGS. 34 and 35, an embodiment of the portable folding chair 10 may include a tension support member 336, an upper cradle member 332, and a lower cradle member 334. The tension support member 336 may be positioned extending between a lower area of the upper portion of the central assembly 132 and an upper area of the medial portion 90. The tension support member 336 may be connected at one end to the lower area of the upper portion of the central assembly 132, and the tension support member 336 may be connected at another end to the upper area of the medial portion 90. Although the protrusions on each of the medial portion 90 and the upper portion of the central assembly 132 are not illustratively shown in FIG. 35, it is understood that the tension support member 336 is not in conflict with said protrusions. The tension support member 336 may be used to support a swiveling motion and/or pivoting motion done by the upper portion of the central assembly 132 and/or the medial member 90 with reference to the lower portion of the central assembly 134. Further details on the swiveling motion and pivoting motion follows further below.

The upper cradle member 332 and the lower cradle member 334 may be positioned to abut one another between the upper portion of the central assembly 132 and the medial portion 90. The upper cradle member 332 may be connected on one side to a lower surface and an upper surface of the central assembly 132, and maybe matingly engaged with (or abuttingly engaged with), on another side to an upper surface of the lower cradle member 334. The lower cradle member 334 may be rotatably attached to a lower surface to an upper area of the medial member 90. The upper cradle member 332 and the lower cradle member 334 may be configured to each have a curvature that is inverted with respect to each other that may be adapted to allow for the upper portion of the central assembly 132 and the upper cradle member 332 to pivotally move with respect to the lower portion of the central assembly 134. The upper cradle member 332 and the lower cradle member 334 may be adapted to cover the protrusions of the upper portion of the central assembly 132 and the medial portion 90, without restricting the upper portion of the central assembly 132 and/or the medial portion 90 from pivotally and/or rotationally moving with respect to the lower portion of the central assembly 134.

Now referring back to FIGS. 23-29 and 33, one or more lower seat members 122 may be rotationally and/or removably attached to the upper portion of the central assembly 132. A respective number of upper geared ends 142 may be attached to one end of the lower seat members 122 and may be rotationally and/or removably attached to the upper portion of the central assembly 132. One or more seat connection members 130 may be rotatably, pivotally, hingedly, and/or fixedly attached to one or more of the lower seat members 122. One or more tube ends 118 may be attached to and/or matingly engaged with an end of one or more of the seat members 112.

One or more upper seat members 124,126,128 may be rotatably, pivotally, hingedly, and/or fixedly attached to one or more of the seat connection members 130. One or more tube ends 118 may be attached to and/or matingly engaged with an end of the upper seat members 124,126,128. In some embodiments, there may be one or more pairs of upper seat members 124,126,128 that may be telescopically attached, defined as telescopically attached upper seat members 124, 126,128. As best illustratively shown in FIGS. 28 and 29, the telescopically attached upper seat members 124,126,128 may be adapted to translate telescopically into and out from each other between a collapsed position and an extended position. The collapsed position may be defined as when the telescopically attached upper seat members 124,126,128 are telescopically moved inwards of each other, up to and including, a fully collapsed position. The extended position may be defined as when the telescopically attached upper seat members 124, 126, 128 are moved outwards from each other up to, and including, a fully extended position.

The telescopically attached upper seat members 124,126, 128 may include a telescope lock passageway 158 positioned at a middle area between the telescopically attached upper seat members 124,126,128. The telescope lock passageway 158 may be positioned to extend through one or more of the telescopically attached upper seat members 124,126,128. One or more telescopically attached upper seat members 124, 126, 128 may also include one or more telescope locks 156. The telescope locks 156 may be configured to removably matingly engage the telescope lock passageways 158, which may be when the telescopically attached upper seat members 124,126,128 are telescopically moved to the fully extended position and/or the fully collapsed position. The telescope locks 156 may comprise of spring loaded buttons.

Figure 23:
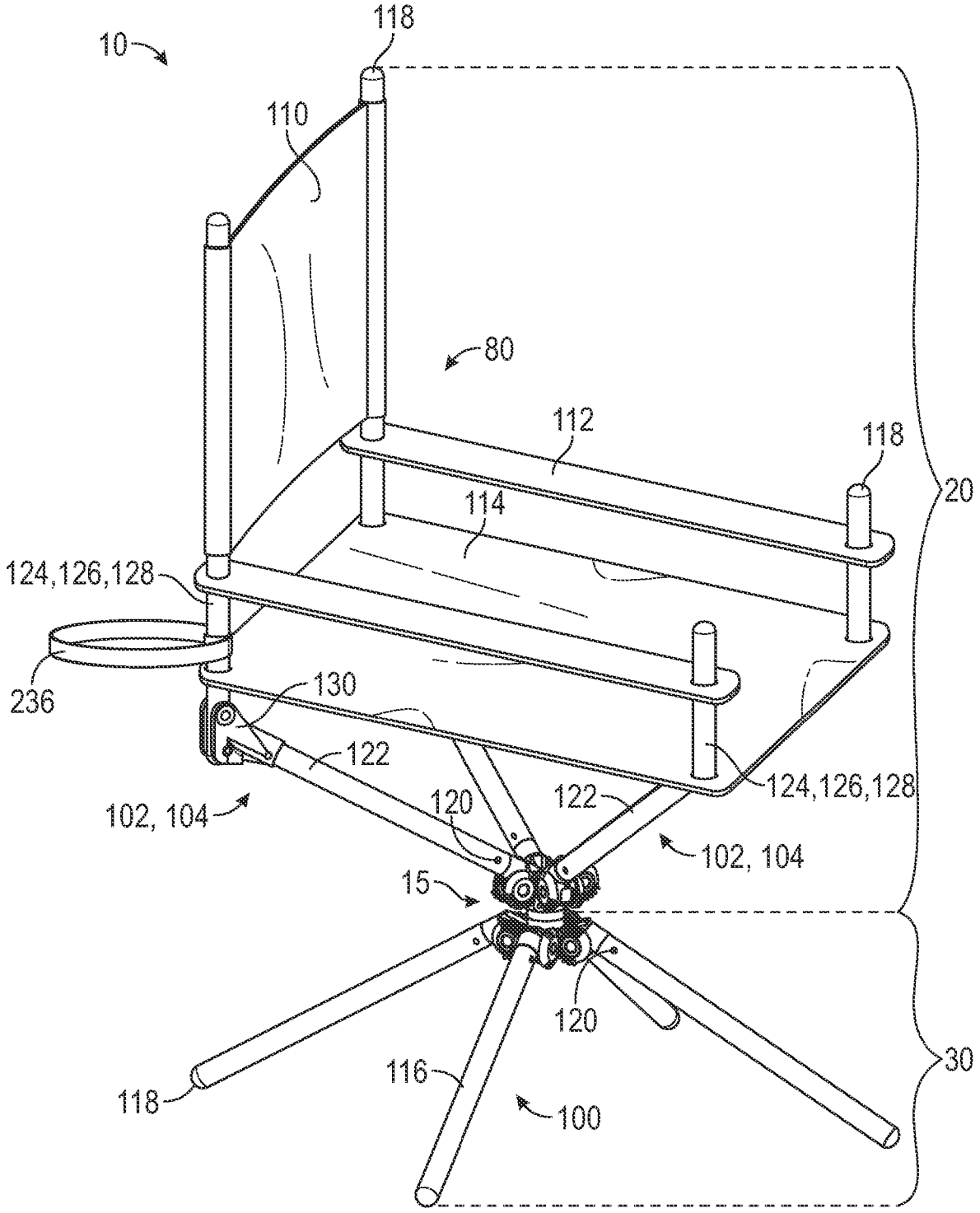
FIG. 23 is a perspective view of a portable folding chair according to an embodiment of the present invention, with upholstery members connected thereto.
Figure 24:
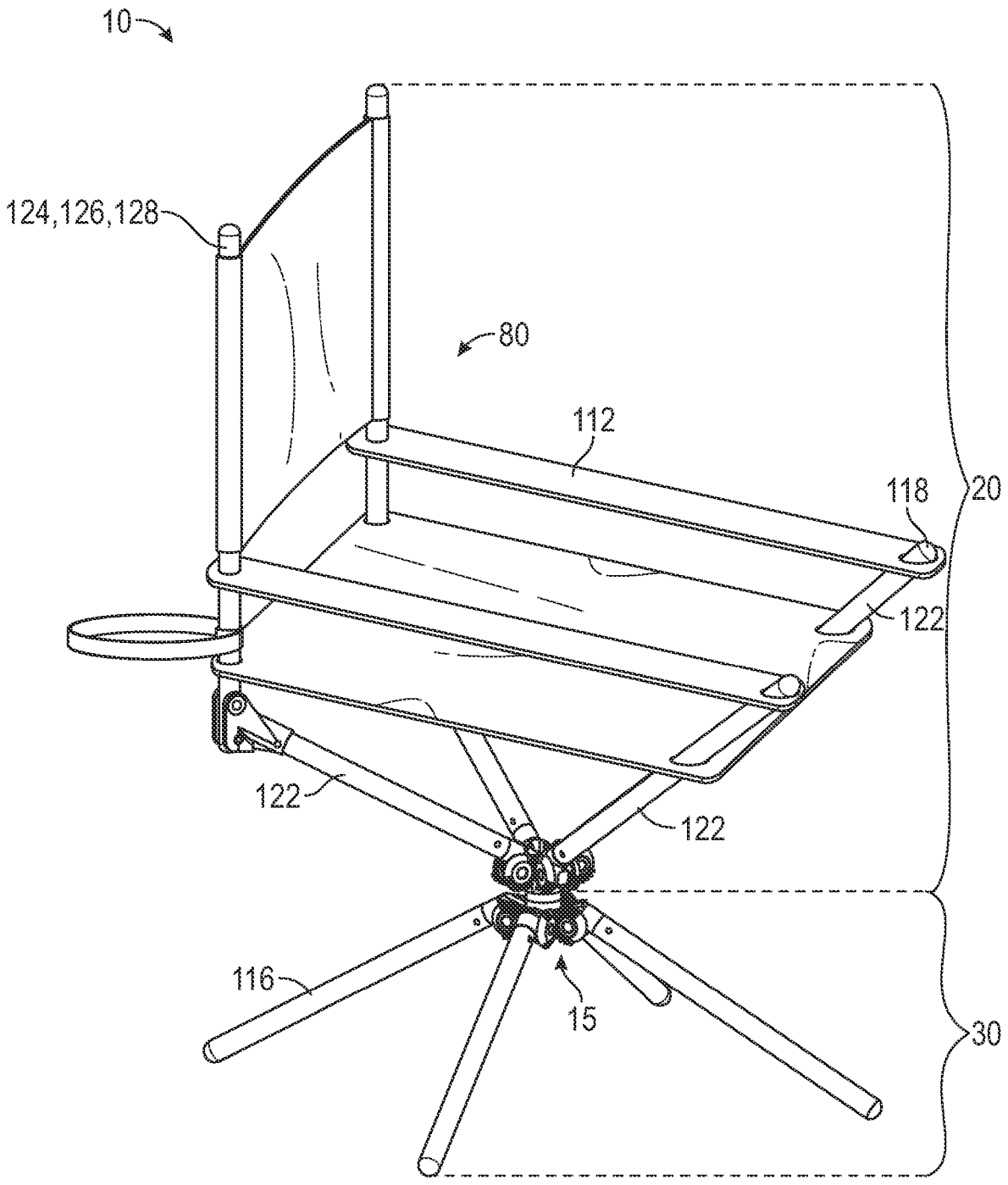
FIG. 24 is a perspective view of a portable folding chair according to an embodiment of the present invention, with upholstery members connected thereto.

Now referring to FIGS. 23-25, the upholstery members 80 may include a backrest upholstery member 110, one or more armrest upholstery members 112, and a seat upholstery member 114. The backrest upholstery member 110, the armrest upholstery members 112, and/or the seat upholstery member 114 may have portions adapted to be attached or removably attached to one or more of the lower seat members 122, the lower seat members 122, the seat connection members 130, and/or the upper seat members 124,126,128. As indicated above, the illustrated upholstery members may be provided individually and separately, or, as may be understood by those skilled in the art, some of the upholstery members may be provided as a single monolithic unit, i.e., connected to one another.

Figure 31:
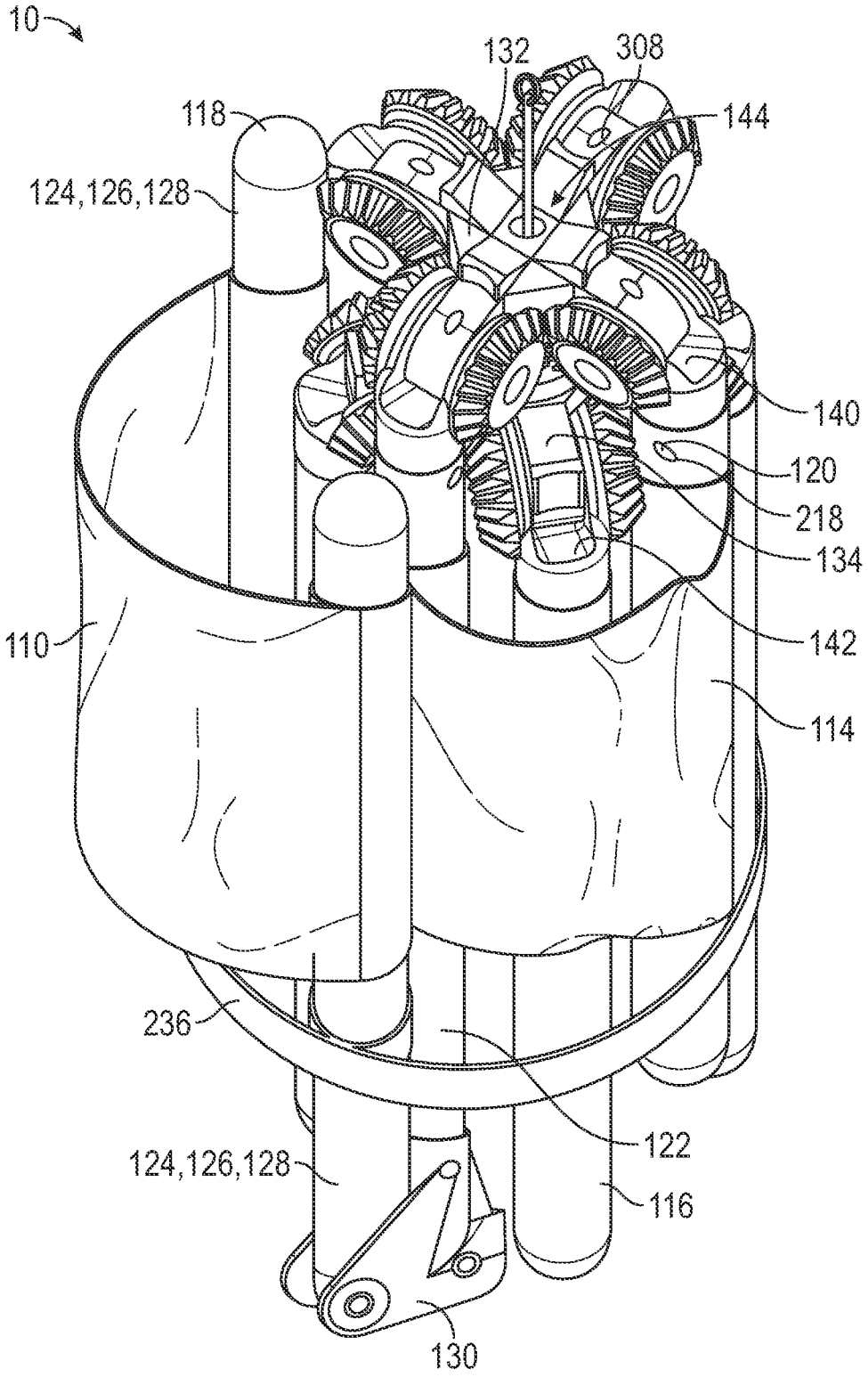
FIG. 31 is a perspective view of a portable folding chair according to an embodiment of the present invention, shown in a folded position with upholstery members connected thereto.

Now additionally referring to FIGS. 31 and 32, an embodiment of the present invention may include an attachment strap 236. The attachment strap 236 may comprise two enclosed loops attached to each other on one side. The attachment strap 236 may be removably attached to one or more of the lower seat members 122, the lower seat members 122, the seat connection members 130, the leg members 116, and/or the upper seat members 124,126,128. The attachment strap 236 may be adapted to retain the upper assembly 20 and the lower assembly 30 in the folded position when the portable folding chair 10 is moved into the folded position. The attachment strap 236 may be configured to be adjustable to increase and/or decrease a circumference of the attachment strap 236.

Now referring to FIGS. 21, 22, and 32-45, the upper geared ends 140 may include upper geared end teeth 230, 232, a seat member connection stem 234, one or more torsion members 196, 222, one or more upper geared end torsion member engagement channels 244, and an upper geared end channel 256. The upper geared end teeth 230, 232 may be positioned on at least one side of the upper geared end 140, and the upper geared end teeth 230, 232 may be configured to matingly engage upper geared end teeth 230, 232 that are on one or more adjacent upper geared ends 140, so that all the upper geared ends 140 of the portable folding chair system 10 may be rotationally moved between the deployed state and the folded state in unison and/or concert. The seat member connection stems 234 may be positioned and configured on the upper geared ends 140 to be matingly engaged with one of the lower seat members 122. The seat member connection stems 234 may also be attached to one of the lower seat members 122 with one or more rivets 120 that may matingly engage with one of a plurality of upper rivet channels 218 that are positioned where the seat member connection stem 234 and lower seat member 122 overlap in their matingly engagement.

Each upper geared end 140 may have an upper geared end channel 256 may be positioned to extend through a side of the upper geared end 140 that is near a center area of the upper geared end teeth 230, 232. The upper portion of the central assembly 132 may have one or more seat member attachment channels 352 positioned to align with the upper geared end channel 256 of an upper geared end 140. The upper geared ends 140 may include a geared end attachment member 324 that may be adapted to matingly engage the seat member attachment channel 352 and the upper geared end channel 256 when the seat member attachment channel 352 and the upper geared end channel 256 are aligned with each other. The geared end attachment member 324 may be used to hingedly, rotationally, and/or pivotally attached the upper geared end 140 to the upper portion of the central assembly 132.

The upper geared ends 140 may include one or more torsion members 196, 222 that may be positioned within the seat member attachment channel 352 and/or the upper geared end channel 256. The torsion members 196, 222 may be connected to and extending between the upper geared end 140 and the upper portion of the central assembly 132. The upper geared ends 140 may include one or more upper geared end torsion member engagement channels 244 that may be configured to attach to one end of one or more of the torsion members 196, 222. The torsion members 196, 222 may be used to assist in moving the upper geared ends 140 and/or the upper assembly 20 to and/or between the deployed position and the folded position.

Now referring to FIGS. 21, 22, and 32-45, the lower geared ends 142 may include lower geared end teeth 238, 240, a leg member connection stem 242, one or more torsion members 196, 222, one or more lower geared end torsion member engagement channels 246, and a lower geared end channel 258.

The lower geared end teeth 238, 240 may be positioned on at least one side of the lower geared end 142, and the lower geared end teeth 238, 240 may be configured to matingly engage lower geared end teeth 238, 240 that are on one or more adjacent lower geared ends 142, so that all the lower geared ends 142 of the portable folding chair system 10 may be rotationally moved between the deployed state and the folded state in unison and/or concert. The leg member connection stem 242 may be positioned on the lower geared end 142 and adapted to be matingly engaged with one of the leg members 116. The leg member connection stem 242 may also be attached to the leg members 116 with one or more rivets 120 that may matingly engage with one of a plurality of lower rivet channels 220 that may be positioned where the leg member connection stem 242 and leg member 116 overlap in their matingly engagement.

Each lower geared end 142 may have a lower geared end channel 258 may be positioned to extend through a side of the lower geared end 142 that is near a center area of the lower geared end teeth 238, 240. The lower portion of the central assembly 134 may have one or more leg member attachment channels 350 positioned to align with the lower geared end channels 258 of a lower geared end 142. The lower geared ends 142 may include a geared end attachment member 324 that may be adapted to matingly engage the leg member attachment channel 350 and the lower geared end channel 258 when the leg member attachment channel 350 and the lower geared end channel 258 are aligned with each other. The geared end attachment member 324 may be used to hingedly, rotationally, and/or pivotally attached the lower geared end 142 to the lower portion of the central assembly 134.

The lower geared ends 142 may include one or more torsion members 196,222 that may be positioned within the leg member attachment channel 350 and/or the lower geared end channel 258. The torsion members 196, 222 may be connected to and extending between the lower geared end 142 and the lower portion of the central assembly 134. The lower geared ends 142 may include one or more lower geared end torsion member engagement channels 246 that may be configured to attach to one end of one or more of the torsion members 196, 222. The torsion members 196, 222 may be used to assist in moving the lower geared ends 142 and/or the lower assembly 30 to and/or between the deployed position and the folded position.

Now referring to FIGS. 23, 32, 33, 35, and 40, the upper portion of the central assembly 132 may include one or more seat member bumpers 320. The seat member bumpers 320 may be connected to an upper side of the upper portion of the central assembly 132. The upper geared ends 140 may be configured to matingly engage, abut, and/or press against the seat member bumpers 320 when the upper assembly 20 is in the deployed position. A seat member bumper 320 may be positioned on an upper side the upper portion of the central assembly 132 for each upper geared end 140. The seat member bumpers 320 may be used to prevent the upper geared ends 140 from rotationally and/or pivotally moving in a direction further than the position of the seat member bumpers 320.

The lower portion of the central assembly 134 may include one or more leg member bumpers 322. The leg member bumpers 322 may be connected to an upper side of the lower portion of the central assembly 134. The lower geared ends 142 may be configured to matingly engage, abut, and/or press against the leg member bumpers 322 when the lower assembly 30 is in the deployed position. A leg member bumper 322 may be positioned on an upper side the lower portion of the central assembly 134 for each lower geared end 142. The leg member bumpers 322 may be used to prevent the lower geared ends 142 from rotationally and/or pivotally moving in a direction further than the position of the leg member bumpers 322.

Now referring to FIGS. 23, and 31-45, the central assembly 15 may include an upper lock member 144 and a lower lock member 146. The upper lock member 144 may be positioned and/or connected to an upper side of the upper portion of the central assembly 132. The upper lock member 144 may be adapted to allow and/or prevent the upper geared ends 140 and/or the lower seat members 122 from moving between the deployed position and the folded position. The upper lock member 144 may be adapted to move between an upper lock engaged position and an upper lock disengaged position. When the upper lock member 144 is in the upper lock engaged position, the upper geared ends 140, the lower seat members 122, the upper seat members 124,126,128, and/or the upper assembly 20 may be prevented from rotationally, hingedly, and/or pivotally moving. When the upper lock member 144 is in the upper lock disengaged position, the upper geared ends 140, the lower seat members 122, the upper seat members 124, 126, 128, and/or the upper assembly 20 may not be prevented from rotationally, hingedly, and/or pivotally moving. The upper lock member 144 may be configured to readily return to the upper lock engaged position after it has been moved to the upper lock disengaged position.

The upper lock member 144 may comprise a lock pin 302, a ring member 148, and/or a lock button 328. The lock pin 302 may be carried by and/or matingly engaged with an upper lock passageway 304 that may be positioned to extend from an upper surface of the upper portion of the central assembly 132 towards the medial portion 90. The lock pin 302 may also be carried by and/or matingly engaged with medial lock passageway 306 (not shown) that may be positioned to extend from an upper surface of the medial portion 90 towards the lower portion of the central assembly 134. The medial lock passageway 306 and the upper lock passageway 304 may be positioned to align with each other when the upper portion of the central assembly 132 is centered with respect to the lower portion of the central assembly. The ring member 148 may be connected to an end portion of the lock pin 302.

The lock pin 302 and/or the upper lock member 144 may be adapted to be moved between an engaged pin position and a disengaged pin position. The engaged pin position may be defined similarly as the upper lock engaged position mentioned above and may be also defined as when the lock pin 302 is moved to matingly engage the upper lock passageway 304 and/or the medial lock passageway 306 so that the upper portion of the central assembly 132 may not pivotally, hingedly, rotationally, and/or adapted to swivel with respect to the lower portion of the central assembly 134. The disengaged pin position may be defined similarly as the upper lock disengaged position as mentioned above and may also be defined as when the lock pin 302 is moved to not matingly engage the upper lock passageway 304 and/or the medial lock passageway 306 so that the upper portion of the central assembly 132 may pivotally, hingedly, rotationally, and/or adapted to swivel with respect to the lower portion of the central assembly 134.

The lower lock member 146 may be connected and/or positioned on a lower area of the lower portion of the central assembly 134. The lower lock member may include a lock pin 302, and a ring member 148. The ring member 148 may be connected to an end portion of the lock pin 302. The lower lock member 146 may be adapted to allow and/or prevent the lower geared ends 142 and/or the leg members 116 from moving between the deployed position and the folded position. The lower lock member 146 may be adapted to move between a lower lock engaged position and a lower lock disengaged position. The lower lock engaged position may be defined as when the lower lock member 146 is engaged so that the lower geared ends 142 and/or the leg member 116 may not rotationally, pivotally, and/or hingedly move between the deployed position and the folded position. The lower lock disengaged position may be defined may be defined as when the lower lock member 146 is disengaged so that the lower geared ends 142 and/or the leg member 116 may rotationally, pivotally, and/or hingedly move between the deployed position and the folded position. The lower lock member 146 may be configured to readily return to and/or maintain the lower lock engaged position after being moved to the lower lock disengaged position. The upper lock member 144 and/or the lower lock member 146 may comprise a wedge lock, hook lock, button lock, pin lock, pull pin lock, and any other type of lock as understood by those skilled in the art. Those skilled in the art will notice and appreciate that some embodiments of the present invention may not include an upper lock member 144 and/or a lower lock member 146 while still accomplishing all the goals, features, and advantages of the present invention.

Now referring to FIGS. 16-37, the torsion members 196, 222 may apply a constant torsion member force on and/or between the leg members 116, lower seat members 122, upper seat members 124,126,128, upper geared ends 140, lower geared ends 142, central assembly 15, upper portion of the central assembly 132, and/or lower portion of the central assembly 134. The constant torsion member force may be applied in an outwards direction on the leg members 116, lower geared ends 142, lower seat members 122, and/or the upper geared ends 140 so that the leg members 116, lower geared ends 142, lower seat members 122, and/or the upper geared ends 140 may be readily moved to the deployed position and/or fully deployed position. The leg members 116, lower geared ends 142, lower seat members 122, and/or the upper geared ends 140 may be only readily moved to the deployed position and/or fully deployed position by the torsion members 196, 222 when the upper lock member 144 is in the upper lock disengaged position and/or when the lower lock 146 is in the lower lock disengaged position.

Now referring to FIGS. 23, and 31-45, one or more of the upper geared ends 140 may include a seat lock rod channel 342. The seat lock rod channel 342 may be positioned extending through the length of the upper geared end 140, and along the length of the seat member connection stem 234 of the upper geared end 140, and the seat lock rod channel 342 may be positioned extending through all or a portion of a lower seat member 122 connected to the upper geared end 140 and/or seat member connection stem 234. An embodiment of the present invention may include one or more seat lock rods 338. Each of the seat lock rods 338 may be carried by one of the seat lock rod channels 342. The seat lock rods 338 may be adapted to readily travel in a direction towards the upper geared end 140 with respect to the lower seat member 122, that is generally towards the upper portion of the central assembly 132.

The upper portion of the central assembly 132 may include one or more seat member deployment channels 308 and seat member fold channels 312. The seat member deployment channels 308 may be positioned to extend through a portion of the upper portion of the central assembly 132. The seat member deployment channels 308 may be positioned to align with a seat lock rod 338 when the upper geared ends 140 and/or lower seat members 122 are in the deployed position and/or the fully deployed position. The seat lock rod 338 may be configured to be removably engaged to the seat member deployment channel 308 when the upper geared ends 140 and/or lower seat members 122 are in the deployed position and/or the fully deployed position to maintain the upper geared ends 140 and/or lower seat members 122 in the deployed position and/or the fully deployed position.

The upper portion of the central assembly 132 may include one or more seat member deployment pistons 310 that may be carried in each of the seat member deployment channels 308. The seat member deployment pistons 310 may be adapted to be extended and/or retracted from the upper portion of the central assembly 132. The seat member deployment pistons 310 may be adapted to move between a seat rod deployment retainment position and a seat rod deployment removal position. The seat rod deployment retainment position may be defined as when one or more of the seat member deployment pistons 310 are retracted to allow the seat lock rods 338 to matingly engage their respective aligned seat member deployment channel 308. The seat rod deployment removal position may be defined as when the seat member deployment pistons 310 are extended to prevent the seat lock rods 308 from matingly engaging their respective aligned seat member deployment channel 308.

The seat member fold channels 312 may be positioned to extend through a portion of the upper portion of the central assembly 132. The seat member fold channels 312 may be positioned to align with a seat lock rod 338 when the upper geared ends 140 and/or lower seat members 122 are in the folded position and/or the fully folded position. The seat lock rod 338 may be configured to have a portion of it removably matingly engage the seat member fold channel 312 when the upper geared ends 140 and/or lower seat members 122 are in the folded position and/or the fully folded position to maintain the upper geared ends 140 and/or lower seat members 122 in the folded position and/or the fully folded position.

The upper portion of the central assembly 132 may include one or more seat member fold pistons 314 that may be carried in each of the seat member fold channels 312. The seat member fold pistons 314 may be adapted to be extended and/or retracted from the upper portion of the central assembly 132. The seat member fold pistons 314 may be adapted to move between a seat rod fold retainment position and a seat rod fold removal position. The seat rod fold retainment position may be defined as when one or more of the seat member fold pistons 314 are retracted to allow the seat lock rods 338 to matingly engage their respective aligned seat member fold channel 312. The seat rod fold removal position may be defined as when the seat member fold pistons 314 are extended to remove/prevent the seat lock rods 338 from matingly engaging their respective aligned seat member fold channel 312.

The features and adaptations mention herein for the seat member fold pistons 314 and the seat member deployment pistons 310 may be operated and/or controlled by or via the upper lock member 144 and/or the lower lock member 146.

One or more of the lower geared ends 142 may include a leg lock rod channel 344. The leg lock rod channel 344 may be positioned to extend through the length of the lower geared end 142, and along the length of the leg member connection stem 242 of the lower geared end 142. Further, the leg lock rod channel 344 may be positioned to extend through all or a portion of a leg member 116 connected to the lower geared end 142 and/or leg member connection stem 242. An embodiment of the present invention may include one or more leg lock rods 340. Each of the leg lock rod 340 may be carried by one of the leg lock rod channels 344. The leg lock rods 340 may be adapted to readily travel in a direction towards the lower geared end 142 with respect to the leg member 116, that is generally towards the lower portion of the central assembly 134.

The lower portion of the central assembly 134 may include one or more leg member fold channels 316. The leg member fold channels 316 may be positioned to extend through a portion of the lower portion of the central assembly 134. The leg member fold channels 316 may be positioned to align with a leg lock rod 340 when the lower geared ends 142 and/or leg members 116 are in the folded position and/or the fully folded position. The leg lock rod 340 may be configured to have a portion thereof that is adapted to be removably engaged to the leg member fold channel 316 when the lower geared ends 142 and/or leg members 116 are in the folded position and/or the fully folded position to maintain the lower geared ends 142 and/or leg members 116 in the folded position and/or the fully folded position.

The lower portion of the central assembly 134 may include one or more leg member fold pistons 318 that may be carried in each of the leg member fold channels 316. The leg member fold pistons 318 may be adapted to be extended and/or retracted from the lower portion of the central assembly 134. The leg member fold pistons 318 may be adapted to move between a leg rod fold retainment position and a leg rod fold removal position. The leg rod fold retainment position may be defined as when one or more of the leg member fold pistons 318 are retracted to allow the leg lock rods 340 to matingly engage their respective aligned leg member fold channel 316. The leg rod fold removal position may be defined as when the leg member fold pistons 318 are extended to remove/prevent the leg lock rods 340 from matingly engaging their respective aligned leg member fold channel 316.

The features and adaptations mention herein for the leg member fold pistons 318 may be operated and/or controlled using the upper lock member 144 and/or the lower lock member 146.

Figure 46A:
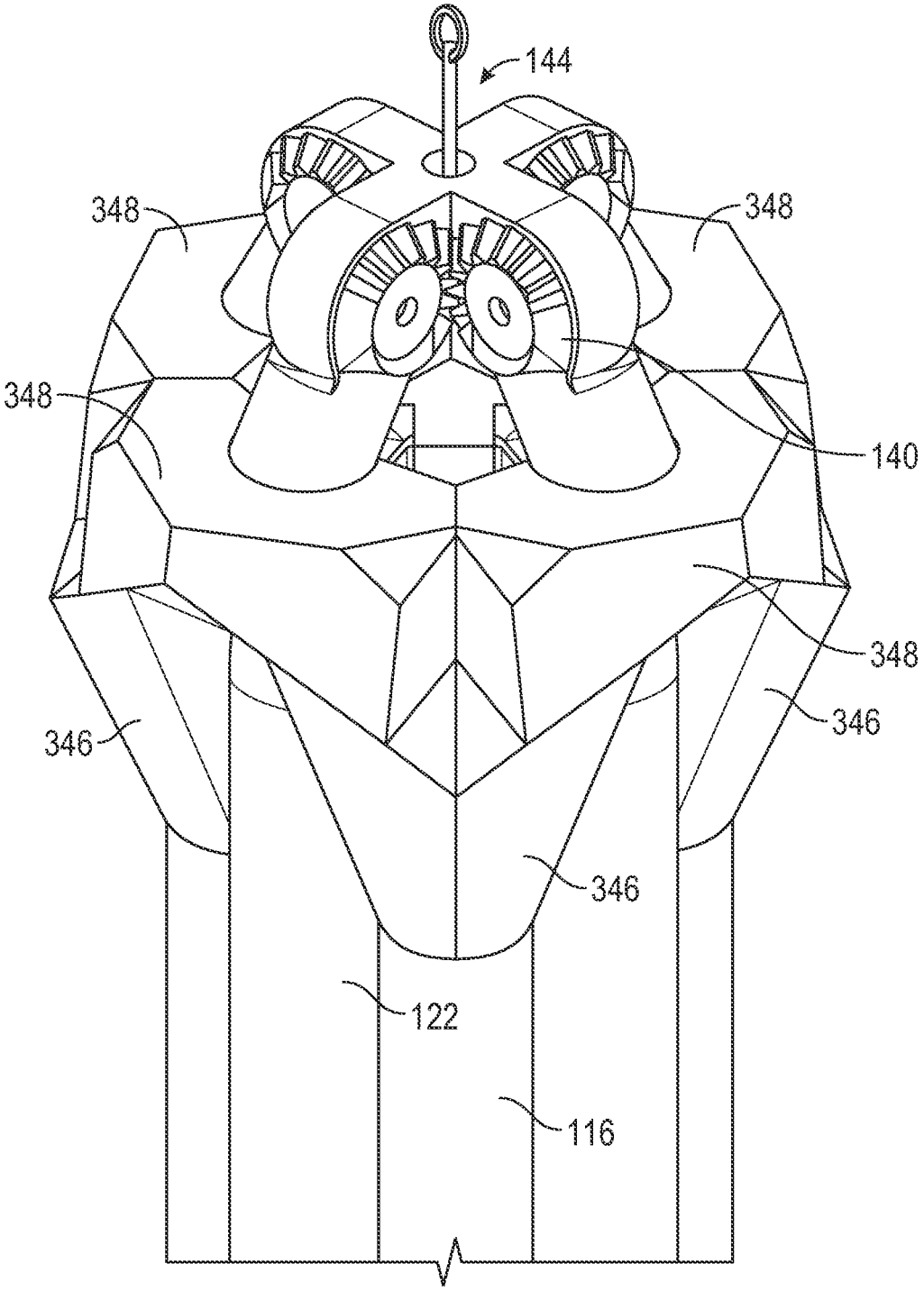
FIG. 46A is a partial perspective view of a portable folding chair according to an embodiment of the present invention, in a folded position with upper gear cover members and lower gear cover members connected thereto.
Figure 46B:
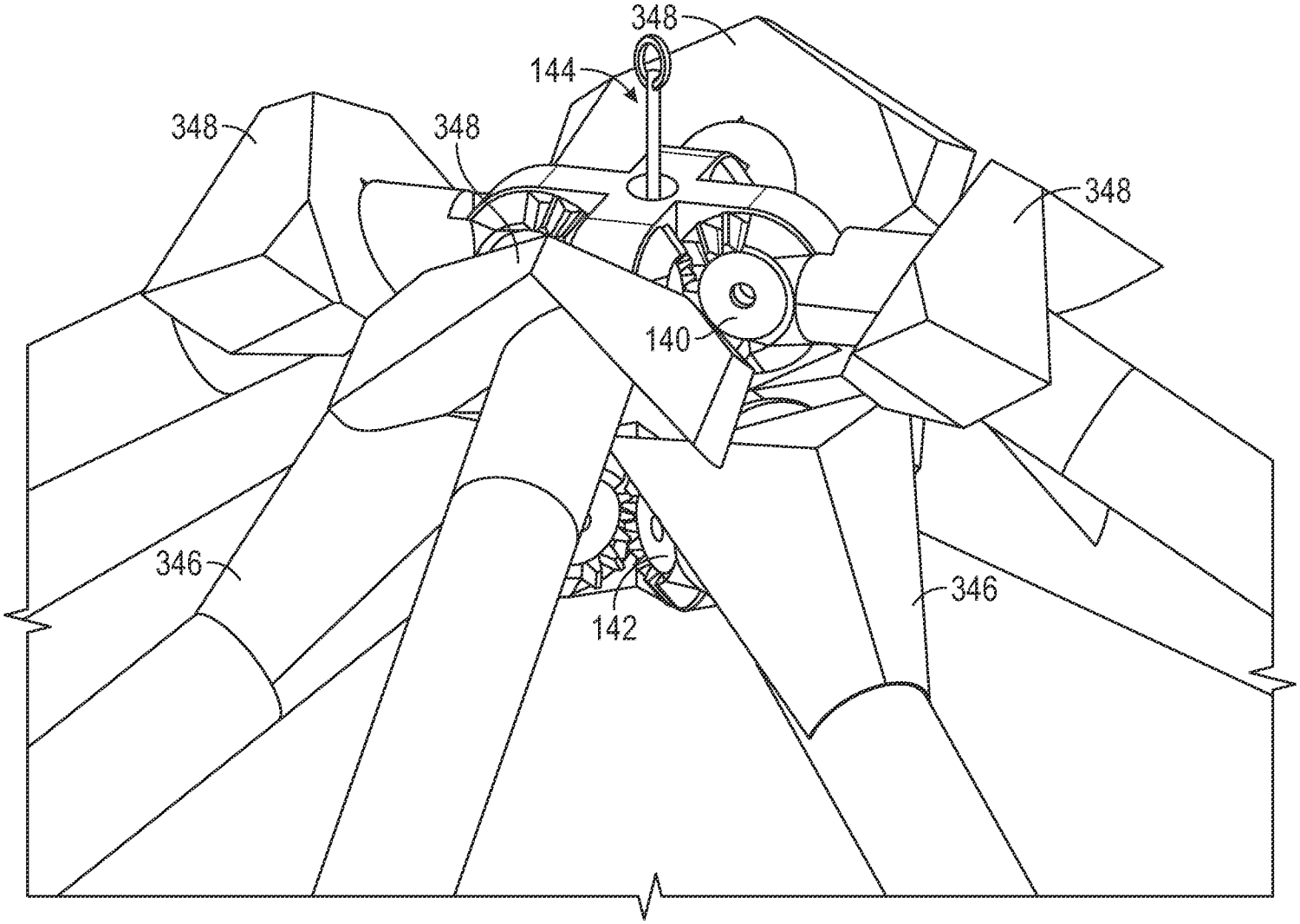
FIG. 46B is a partial perspective view of a portable folding chair illustrated in FIG. 46A, in a deployed position.
Figure 47A:
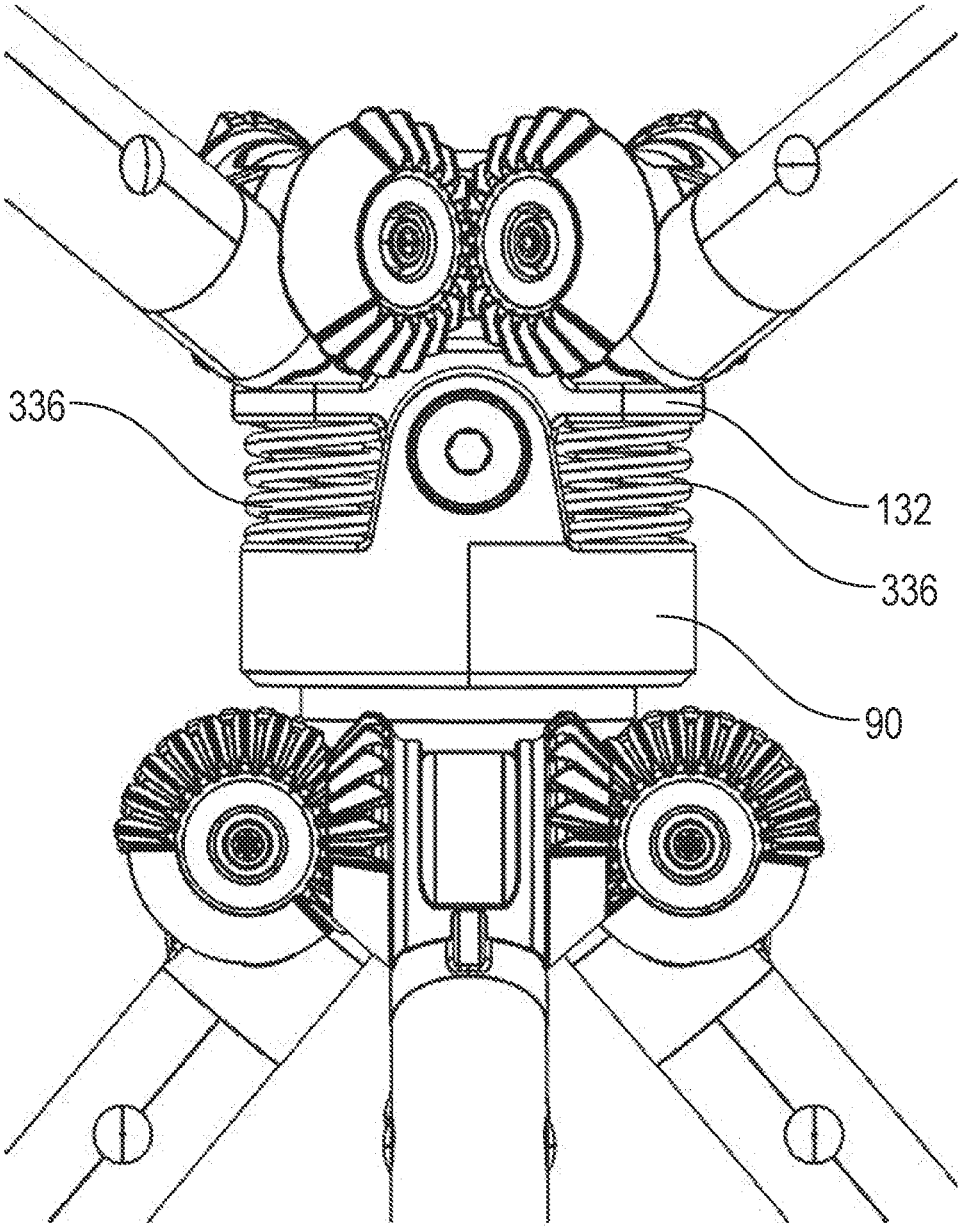
FIG. 47A is a partial perspective view of a portable folding chair according to an embodiment of the present invention, having two tension support members.
Figure 47B:
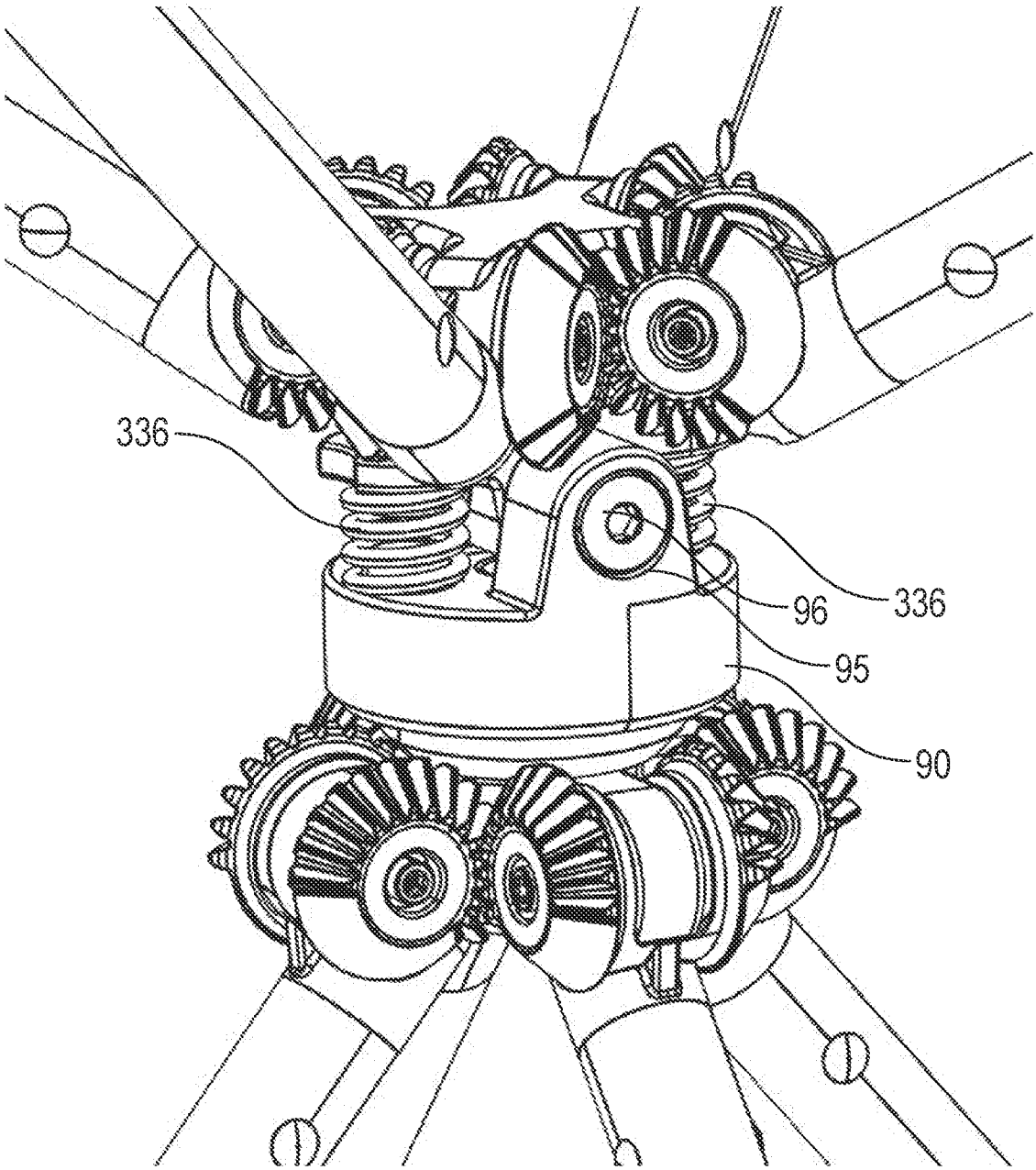
FIG. 47B is another partial perspective view of the portable folding chair illustrated in FIG. 47A.
Figure 47C:
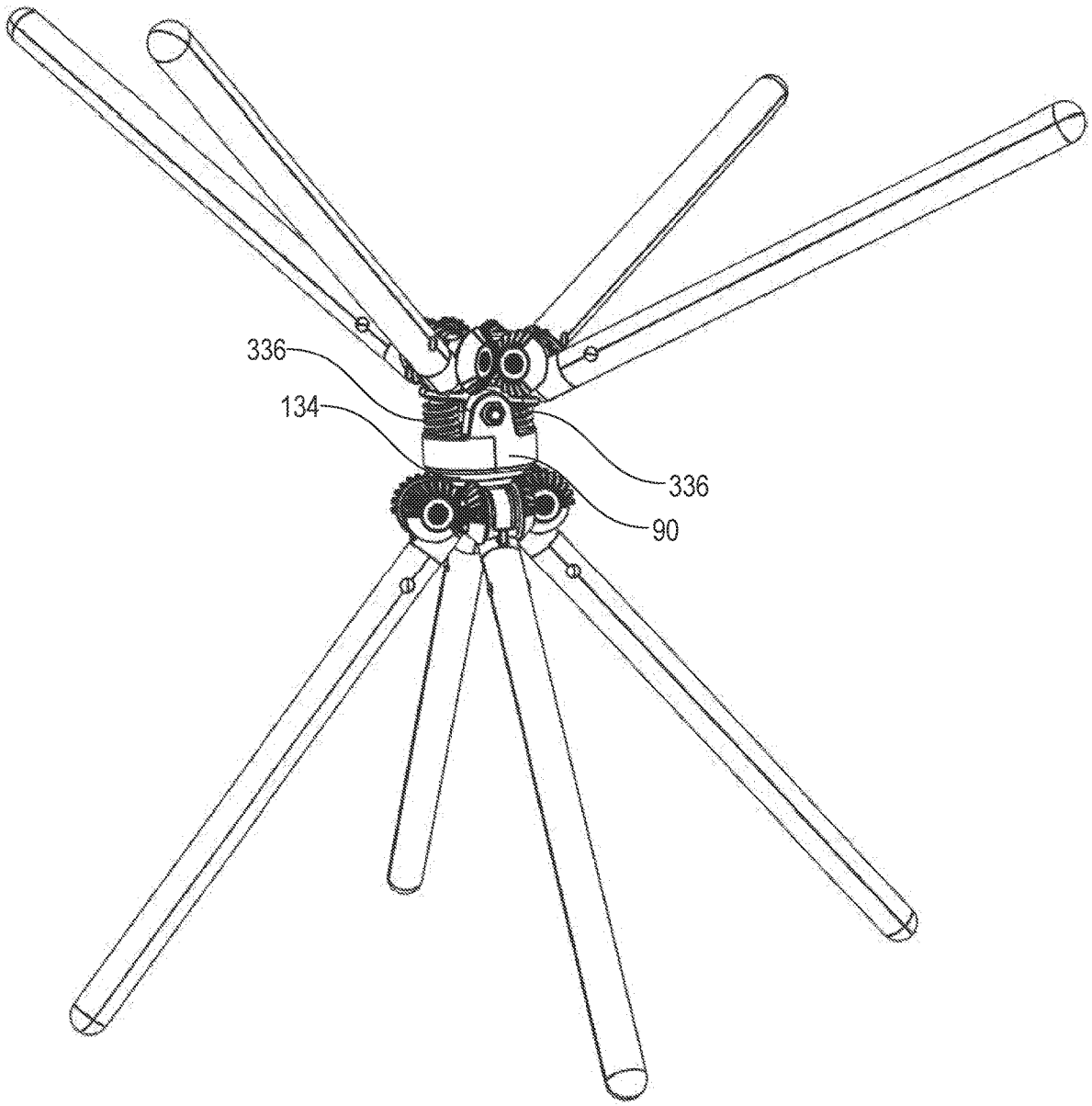
FIG. 47C is a perspective view of a portable folding chair according to an embodiment of the present invention, with two tension support members connected thereto.
Figure 47D:
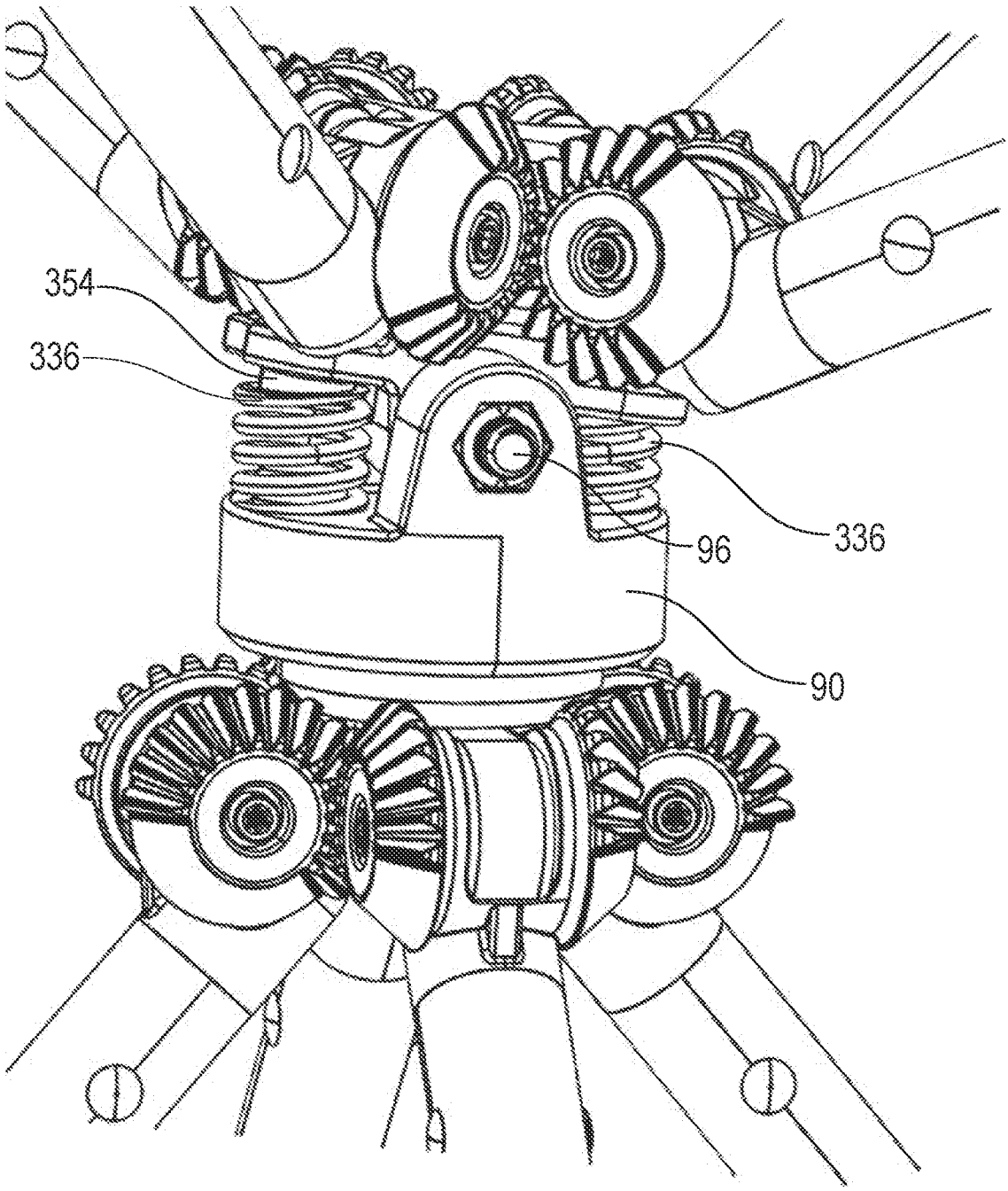
FIG. 47D is a partial perspective view of the portable folding chair illustrated in FIG. 47C.
Figure 47E:
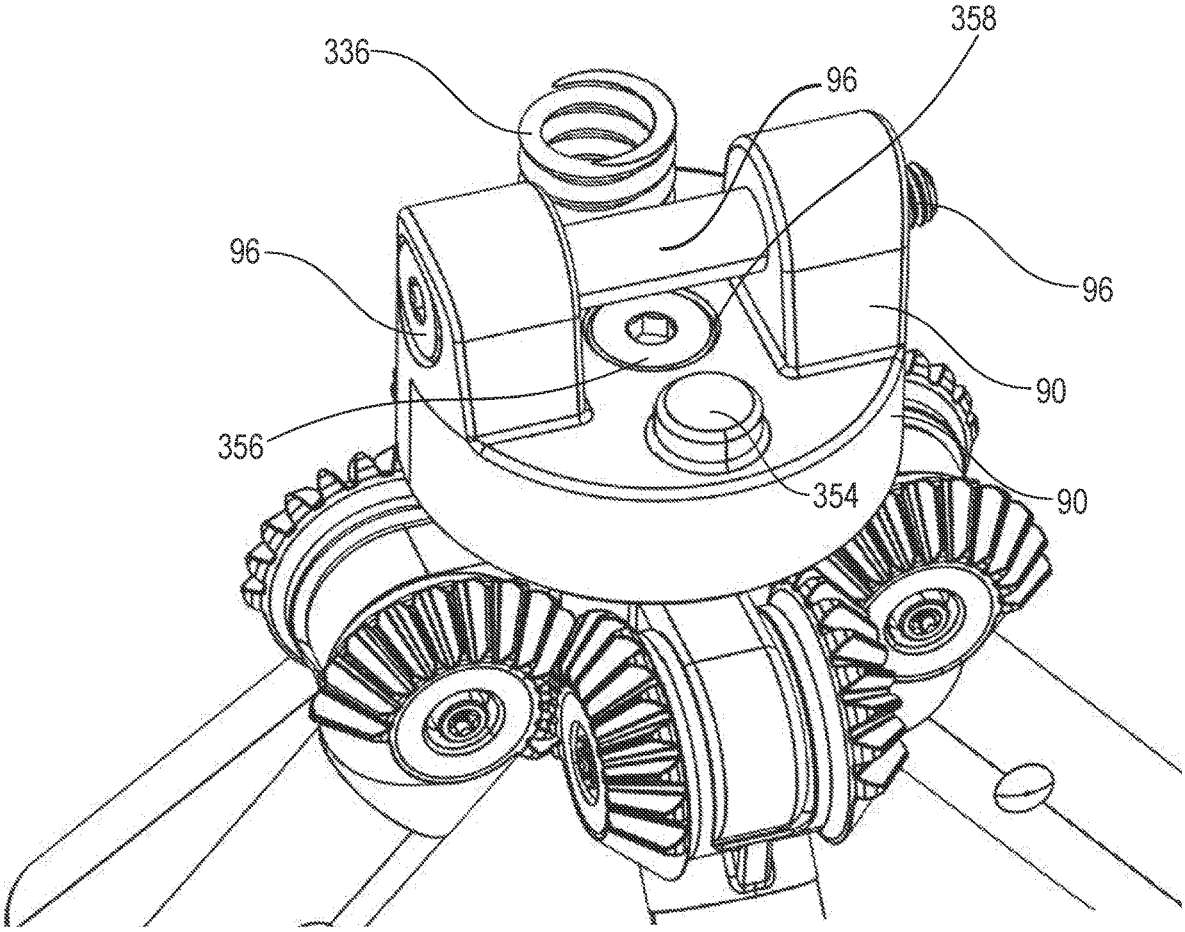
FIG. 47E is a partial perspective view of the portable folding chair illustrated in FIG. 47D, showing the medial attachment member connected thereto and having one of the two tension support members shown in FIG. 47A removed to show a retention member.

Now referring to FIGS. 46A and 46B, an embodiment of the present invention may include a plurality of lower gear cover members 346 and a plurality of upper gear cover members 348. The lower gear cover members 346 may be attached and/or connected to one or more of the lower geared ends 142 and/or the leg members 116. The lower gear cover members 346 may be positioned to cover all or a portion of the lower geared ends 142 and/or the leg members 116. The lower gear cover members 346 may be configured to partially abut one or more of each other when the portable folding chair 10 is in a deployed position, fully deployed position, folded position, and/or fully folded position.

The upper gear cover members 348 may be attached and/or connected to one or more of the lower geared ends 140 and/or the lower seat members 122. The upper gear cover members 348 may be positioned to cover all or a portion of the upper geared ends 140 and/or the lower seat members 122. The upper gear cover members 348 may be configured to partially abut one or more of each other and when the portable folding chair 10 is in a deployed position, fully deployed position, folded position, and/or fully folded position. The upper gear cover members 348 and the lower gear cover members 346 may be configured to partially abut adjacent upper gear cover members 348 and lower gear cover members 346 other and when the portable folding chair 10 is in a deployed position, fully deployed position, folded position, and/or fully folded position.

Figure 29:
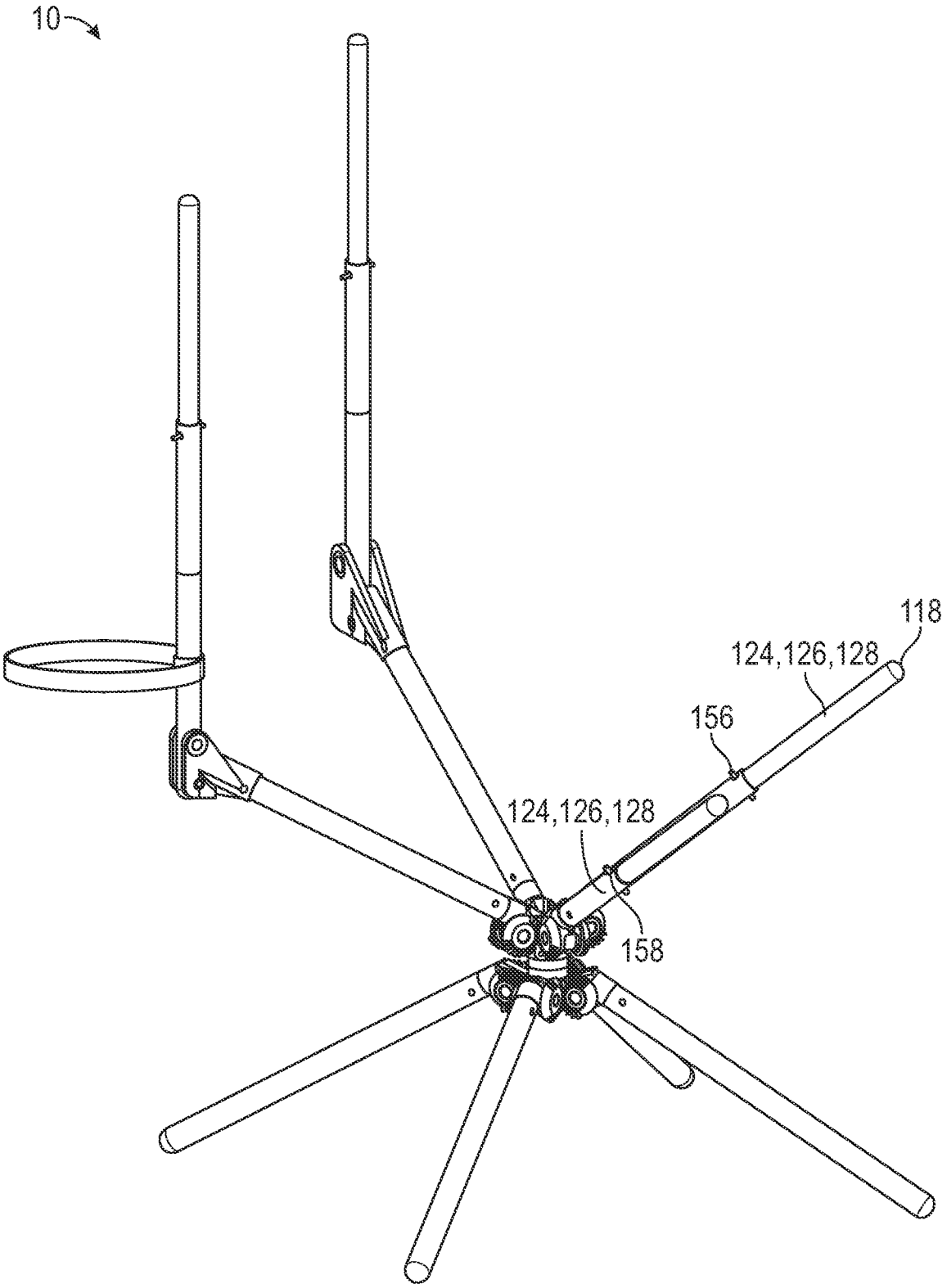
FIG. 29 is a perspective view of a portable folding chair according to an embodiment of the present invention, with two pairs of telescopically attached upper seat members and two pairs of telescopically attached lower seat members.
Figure 30A:
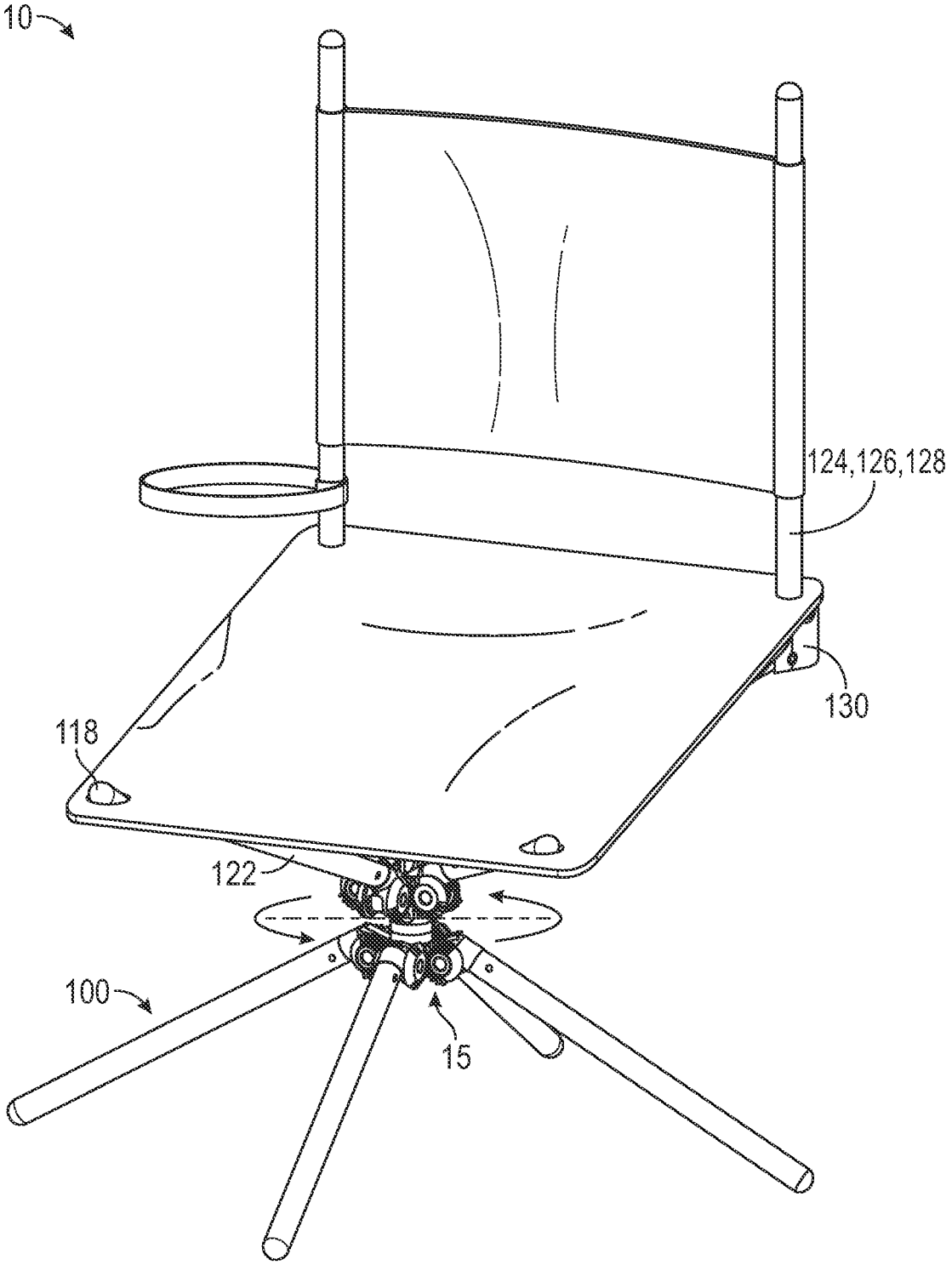
FIG. 30A is a perspective view of a portable folding chair according to an embodiment of the present invention, showing the upper portion of the central assembly swiveling with respect to the lower portion of the central assembly.
Figure 30B:
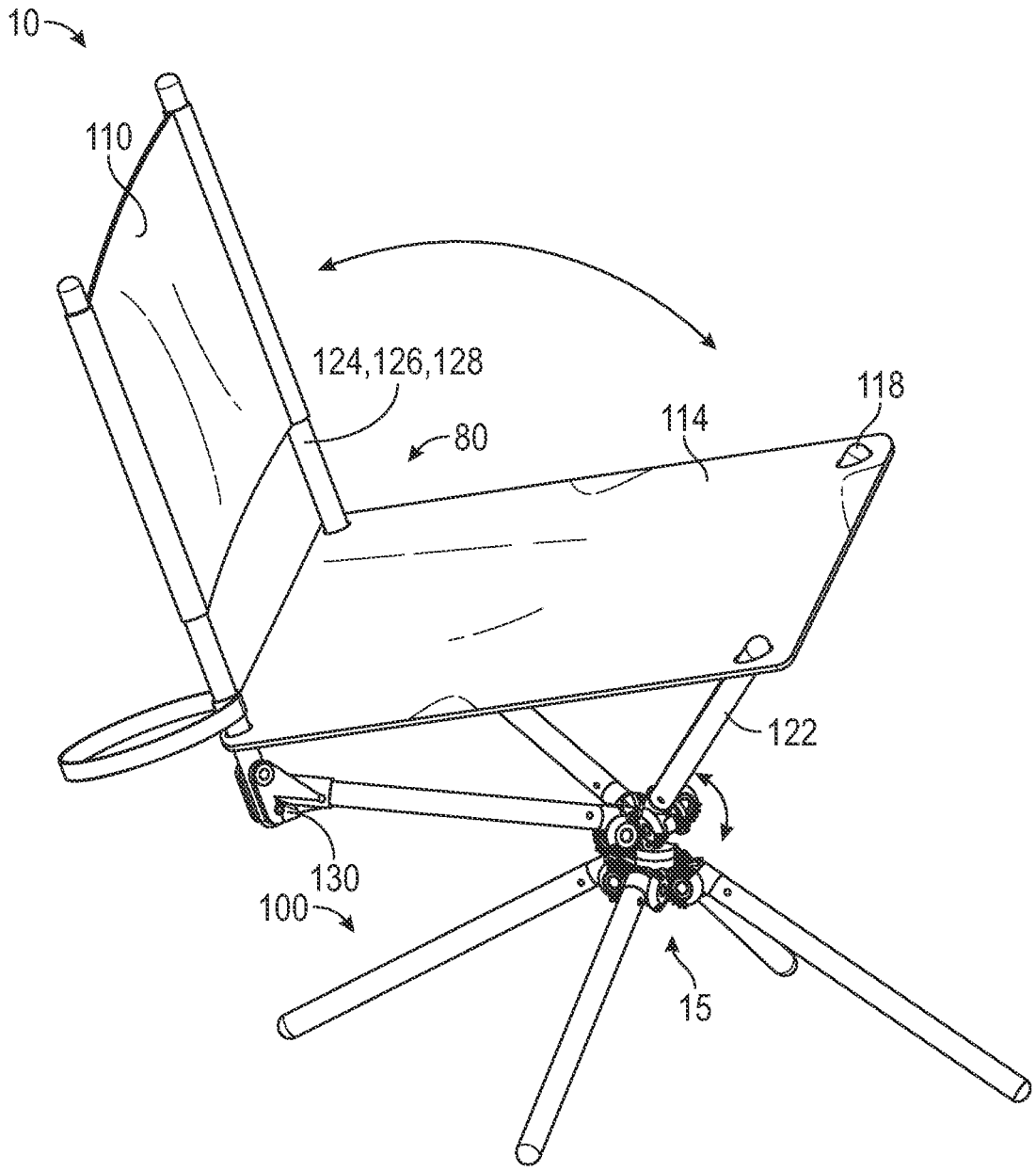

Now referring to FIG. 29, some embodiments of the present invention may include upper seat members 124,126, 128, that may be in telescopically attached pairs as mentioned above, that may be attached to the upper geared ends 140 and/or seat member connection stems 234, then all what is mentioned herein about the lower seat members 122 may also apply to the upper seat members 124,126,128.

Now referring to FIGS. 47A-47E, an embodiment of the portable folding chair 10 may include more than one tension support member 336 that may be positioned between and connected to the upper portion of the central assembly 132 and the medial portion 90. The upper portion of the central assembly 132 may include one or more retention members 354 connected on a lower surface of the upper portion of the central assembly 132 that may be positioned to align with a respective number of tension support members 336. The medial portion 90 may include one or more retention members 354 connected on an upper surface of the medial portion 90 that may be positioned to align with a respective number of tension support members 336. The medial portion 90 may also include a central through hole 358 that may be positioned extending through a center area of the medial portion 90 and/or the lower portion of the central assembly 134. The medial portion 90 may include a medial attachment member 356 configured to matingly engage the central through hole 358 and may allow the medial member 90 to rotationally move with respect to the lower portion of the central assembly 134.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A portable folding chair comprising:

a central assembly having an upper portion and a lower portion that is connectable to the upper portion so that the upper portion can swivel with respect to the lower portion;

a plurality of leg members attached to the lower portion of the central assembly, wherein each of the plurality of leg members are moveable between a folded position and a deployed position;

a plurality of seat members attached to the upper portion of the central assembly, wherein each of the plurality of seat members are moveable between a folded position and a deployed position;

wherein the lower portion of the central assembly is fixed in place and the upper portion is adapted to swivel with respect to the lower portion of the central assembly; and a plurality of upper geared ends and a plurality of lower geared ends; wherein each of the plurality of upper geared ends comprises a seat member connection stem; wherein the respective plurality of seat members are connectable to the respective plurality of seat member connection stems; wherein each of the plurality of lower geared ends comprises a leg member connection stem; and wherein the respective plurality of leg members are connectable to each of the respective plurality of leg member connection stems.

2. The portable folding chair of claim 1, further comprising a plurality of seat connection members each connected to an end portion of the respective seat members; a respective plurality of lower seat members each rotatably connected to a respective one of the seat connection members; and a pair of upper seat members connected to two of the plurality of lower seat members; and wherein the lower seat members and the upper seat members are moveable between a folded position and a deployed position; wherein the lower seat members and the upper seat members are movable to the deployed position when the seat members are in the deployed position.

3. The portable folding chair of claim 2, wherein the upper seat members are connectable to end portions of the lower seat members; wherein the upper seat members are each telescoping; and wherein the upper seat members are adapted to be moved between a collapsed position and an extended position.

4. The portable folding chair of claim 2, further comprising a chair upholstery member having portions adapted to be removably attached to the lower seat members and portions adapted to be attached to both the lower seat members and the upper seat members; and wherein the chair upholstery member comprises a backrest upholstery member, a seat upholstery member and a pair of armrest upholstery members.

5. The portable folding chair of claim 1, wherein adjacent ones of the upper geared members are adapted to matingly engage one another so that rotation of one of the plurality of upper geared members causes rotation of each of the plurality of upper geared members; and wherein adjacent ones of the lower geared members are adapted to matingly engage one another so that rotation of one of the plurality of lower geared members causes rotation of each of the plurality of lower geared members.

6. The portable folding chair of claim 1, further comprising an upper lock member and a lower lock member; wherein each of the upper lock member and lower lock member is moveable between an engaged position and a disengaged position; wherein when each of the upper lock member and the lower lock member is in the engaged position, the respective seat members and leg members are prevented from being moved between the deployed position and the folded position; and wherein when each of the upper lock member and the lower lock member is in the disengaged position, the respective seat members and leg members are moveable between the deployed position and the folded position.

7. The portable folding chair of claim 6, further comprising a respective plurality of torsion members connected between the lower portion of the central assembly and each of the respective plurality of lower geared members and also between the upper portion of the central assembly and each of the respective plurality of upper geared members; wherein each of the torsion members are configured to move the plurality of leg members connected to the lower gear members to the deployed position when the lower lock member is in the disengaged position and configured to move the plurality of seat members connected to the upper gear members to the deployed position when the upper lock member is in the disengaged position.

8. The portable folding chair of claim 1, wherein the upper portion of the central assembly is prevented from swiveling with respect to the lower portion of the central assembly when the plurality of leg members and the plurality of seat members are in the folded position.

9. A portable chair comprising:

a central assembly having an upper portion, a medial portion connected to the upper portion, and a lower portion connected to the medial portion;

a plurality of leg members attached to the lower portion of the central assembly, wherein each of the plurality of leg members are moveable between a folded position and a deployed position;

a plurality of seat members attached to the upper portion of the central assembly, wherein each of the plurality of seat members are moveable between a folded position and a deployed position;

wherein the medial portion of the central assembly can swivel with respect to the lower portion of the central assembly;

wherein the upper portion of the central assembly is pivotable with respect to the medial portion of the central assembly; and a plurality of upper geared ends and a plurality of lower geared ends; wherein each of the plurality of upper geared ends comprises a seat member connection stem; wherein the respective plurality of seat members are connectable to the respective plurality of seat member connection stems; wherein each of the plurality of lower geared ends comprises a leg member connection stem; and wherein the respective plurality of leg members are connectable to each of the respective plurality of leg member connection stems.

10. The portable chair of claim 9, further comprising at least a pair of seat connection members connected to an end portion of a respective pair of the plurality of seat members; a respective pair of lower seat members each rotatably connected to the respective pair of the plurality of the seat connection members; and wherein the lower seat members are moveable between a folded position and a deployed position; wherein the lower seat members are movable to the deployed position when the seat members are in the deployed position.

11. The portable chair of claim 10, further comprising a chair upholstery member having portions adapted to be removably attached to the lower seat members and portions adapted to be attached to both the lower seat members and the seat members; and wherein the chair upholstery member comprises a backrest upholstery member and a seat upholstery member.

12. The portable chair of claim 9, wherein adjacent ones of the upper geared members are adapted to matingly engage one another so that rotation of one of the plurality of upper geared members causes rotation of each of the plurality of upper geared members; and wherein adjacent ones of the lower geared members are adapted to matingly engage one another so that rotation of one of the plurality of lower geared members causes rotation of each of the plurality of lower geared members.

13. The portable chair of claim 9, further comprising an upper lock member and a lower lock member; wherein each of the upper lock member and lower lock member is moveable between an engaged position and a disengaged position; wherein when each of the upper lock member and the lower lock member is in the engaged position, the respective seat members and leg members are prevented from being moved between the deployed position and the folded position; and wherein when each of the upper lock member and the lower lock member is in the disengaged position, the respective seat members and leg members are moveable between the deployed position and the folded position.

14. The portable chair of claim 13, further comprising at respective plurality of torsion members connected between the lower portion of the central assembly and each of the respective plurality of lower geared members and also between the upper portion of the central assembly and each of the respective plurality of upper geared members; wherein each of the torsion members are configured to move the plurality of leg members connected to the lower gear members to the deployed position when the lower lock member is in the disengaged position and configured to move the plurality of seat members connected to the upper gear members to the deployed position when the upper lock member is in the disengaged position.

15. The portable chair of claim 9, further comprising a lower gear cover member adapted to overlie the plurality of lower geared members, and an upper gear cover member adapted to overlie the plurality of upper geared members.

16. The portable chair of claim 9 further comprising a lock pin; wherein the lock pin is adapted to engage an upper assembly portion passageway formed through portions of the upper portion of the central assembly and a medial assembly portion passageway formed through portions of the medial portion of the central assembly; wherein the lock pin is moveable between an engaged position and a disengaged position; and wherein, when the pin is in the engaged position, the upper portion of the central assembly is prevented from pivoting with respect to the medial portion of the central assembly; and wherein when the lock pin is in the disengaged position, the upper portion of the central assembly is pivotable with respect to the medial portion of the central assembly.

17. The portable chair of claim 9, wherein the medial portion of the central assembly is prevented from swiveling with respect to the lower portion of the central assembly when the plurality of leg members and the plurality of seat members are in the folded position; and wherein the upper portion of the central assembly is prevented from pivoting with respect to the medial portion of the central assembly when the plurality of leg members and the plurality of seat members are in the folded position.

18. A portable chair comprising:

a central assembly having an upper portion, a medial portion connected to the upper portion, and a lower portion connected to the medial portion;

a plurality of leg members attached to the lower portion of the central assembly, wherein each of the plurality of leg members are moveable between a folded position and a deployed position;

a plurality of seat members attached to the upper portion of the central assembly, wherein each of the plurality of seat members are moveable between a folded position and a deployed position;

wherein the upper portion of the central assembly is pivotable with respect to the medial portion of the central assembly; and a plurality of upper geared ends and a plurality of lower geared ends; wherein each of the plurality of upper geared ends comprises a seat member connection stem; wherein the respective plurality of seat members are connectable to the respective plurality of seat member connection stems; wherein each of the plurality of lower geared ends comprises a leg member connection stem; and wherein the respective plurality of leg members are connectable to each of the respective plurality of leg member connection stems.

19. The portable chair of claim 18, further comprising at least a pair of seat connection members connected to an end portion of a respective pair of the plurality of seat members; a respective pair of lower seat members each rotatably connected to the respective pair of the plurality of the seat connection members; and wherein the lower seat members are moveable between a folded position and a deployed position; wherein the lower seat members are movable to the deployed position when the seat members are in the deployed position.

20. The portable chair of claim 18, wherein adjacent ones of the upper geared members are adapted to matingly engage one another so that rotation of one of the plurality of upper geared members causes rotation of each of the plurality of upper geared members; and wherein adjacent ones of the lower geared members are adapted to matingly engage one another so that rotation of one of the plurality of lower geared members causes rotation of each of the plurality of lower geared members.

21. The portable chair of claim 18, further comprising an upper lock member and a lower lock member; wherein each of the upper lock member and lower lock member is moveable between an engaged position and a disengaged position; wherein when each of the upper lock member and the lower lock member is in the engaged position, the respective seat members and leg members are prevented from being moved between the deployed position and the folded position; and wherein when each of the upper lock member and the lower lock member is in the disengaged position, the respective seat members and leg members are moveable between the deployed position and the folded position.

22. The portable chair of claim 21, further comprising at respective plurality of torsion members connected between the lower portion of the central assembly and each of the respective plurality of lower geared members and also between the upper portion of the central assembly and each of the respective plurality of upper geared members; wherein each of the torsion members are configured to move the plurality of leg members connected to the lower gear members to the deployed position when the lower lock member is in the disengaged position and configured to move the plurality of seat members connected to the upper gear members to the deployed position when the upper lock member is in the disengaged position.

23. The portable chair of claim 18 further comprising a lock pin; wherein the lock pin is adapted to engage an upper assembly portion passageway formed through portions of the upper portion of the central assembly and a medial assembly portion passageway formed through portions of the medial portion of the central assembly; wherein the lock pin is moveable between an engaged position and a disengaged position; and wherein, when the pin is in the engaged position, the upper portion of the central assembly is prevented from pivoting with respect to the medial portion of the central assembly; and wherein when the lock pin is in the disengaged position, the upper portion of the central assembly is pivotable with respect to the medial portion of the central assembly.

24. The portable chair according to claim 18 wherein the upper portion of the central assembly is prevented from pivoting with respect to the medial portion of the central assembly when the plurality of leg members and the plurality of seat members are in the folded position.

* * * * *